United States Patent [19]

Hannigan et al.

[11] 4,211,483

[45] Jul. 8, 1980

[54] COPY PRODUCTION MACHINES HAVING JOB SEPARATION AND COLLATION CAPABILITIES

[75] Inventors: Noreen A. Hannigan, Farmington Hills, Mich.; Terence Travis, Boulder, Colo.

[73] Assignee: International Business Machines Corporation, Armonk, N.Y.

[21] Appl. No.: 945,726

[22] Filed: Sep. 25, 1978

[51] Int. Cl.[2] ..... G03G 15/00

[52] U.S. Cl. ..... 355/14 R; 93/93 D; 270/58; 271/288; 355/3 SH

[58] Field of Search ..... 355/3 R, 3 SH, 14, 14 R, 355/14 SH; 271/4, 64, 173, 288, 296, 297, 298; 93/93 D; 270/58, 59

[56] References Cited

U.S. PATENT DOCUMENTS

| | | | |
|---|---|---|---|
| Re. 27,976 | 4/1974 | Sahley | 355/64 |
| 3,205,739 | 9/1965 | Meyer-Jagenberg | 93/93 D X |
| 3,273,882 | 9/1966 | Pearson | 270/58 |
| 3,830,590 | 8/1974 | Harris et al. | 355/14 |
| 3,870,295 | 3/1975 | Kukucka | 271/173 |
| 3,871,640 | 3/1975 | Ritzerfeld | 271/9 |
| 3,871,643 | 3/1975 | Kukucka et al. | 271/173 |
| 3,979,112 | 9/1976 | Munn et al. | 93/93 D X |

*Primary Examiner*—Fred L. Braun

*Attorney, Agent, or Firm*—Carl M. Wright; Herbert F. Somermeyer

[57] ABSTRACT

A copy production machine selectively interleaves copy separation sheets between successive copy jobs, subjobs or job portions. The copy separation sheets can be from the same copy sheet supply source or from an alternate source. The supplied copy separation sheets need not be operated upon by the copy production machines for receiving an image. Such sheets may have been preimaged under certain situations. Before and after a copy job, the number of separation sheets supplied has a predetermined relationship to the number of copy receiving bins in an output portion receiving the copy separation sheets. The number of separator sheets supplied intermediate successive runs of a copy job equals the number of copies to be produced in the next succeeding copy run. The effective capacity of a collator is extended by such interleaving plus a programmable control that tallies copies made versus copies selected greater than the capacity of a collator such that the collator job is automatically segmented.

11 Claims, 29 Drawing Figures

| INSTR | SEQ 1 CL | SEQ 1 ALU | SEQ 2 CL | SEQ 2 ALU | SEQ 3 CL | SEQ 3 ALU | SEQ 4 CL | SEQ 4 ALU | SEQ 5 CL | SEQ 5 ALU | SEQ 6 CL | SEQ 6 ALU |
|---|---|---|---|---|---|---|---|---|---|---|---|---|
| AR SR LR | IBL | M | (TB⇒IB) IRH | M X | PCI | M NOTE 4 | (TERM) | NOTE 4 | | | | |
| LRE LRD | IBL | M | (TB⇒IB) IRH | M X | PCI | M NOTE 5 | WRT IRL | NOTE 5 | WRT IRH | TBNS (XX→DB) ACH + DO | (TERM) | TBNS |
| STR | PCI | M | (TB⇒IB) WRT IRH | X (X→DB) ACH→DO | WRT IRL | ACL→DO | (TERM) | TBNS | | | | |
| AI SI | PCI | M | PCI | M NOTE 1 | (TERM) | NOTE 5 | | | | | | |
| CI GPI [LI XI OI NI] | PCI | M | PCI | M ACL x TB → DO → [ACL] | (TERM) | X | | | | | | |
| CB [AB SB LB XB OB NB] | PCI | M | TB | M (ACL→DO) | (TB ⇒ IB) PCI | X | (TERM) | ACL ± TB → DO → [ACL] | | | | |
| STB | PCI | M | WRT TB | ACL→DO | (TB⇒IB) PCI | X | (TERM) | X | | | | |
| A1 S1 SHL SHR | PCNI | M | (TB⇒IB) PCI | M NOTE 2 | (TERM) | NOTE 2 | | | | | | |
| TRA | PCI | M | (TERM) | NOTE 3 | | | | | | | | |
| CLA / [IC] | PCI | M CL AC / SET IC | (TERM) | X / COT ± → EQ | | | | | | | | |
| TBP [TBR] | PCI | M | (TERM) | ACL M → DO → [ALL] | | | | | | | | |
| POR (IJD) | | | | | | | IB→"CLA" POR CODE | X RST LOGIC 32→DO | | | | |
| TIME | Ø2 220 | Ø1 | Ø2 | Ø1 | Ø2 | Ø1 | Ø2 | Ø1 | Ø2 | Ø1 | Ø2 | Ø1 | Ø2 |

PREVIOUS INSTRUCTION

NOTE 1: ACL ± TB ; + DB → ACH ; ACH → DO → ACL
NOTE 2: ACL MODIF → DB → ACH ; ACH → DO → ACL
NOTE 3: ACL → DB → ACH ; ACH → DO → ACL
NOTE 4: ACL ± TB → DB → ACH ; ACH → DO → ACL
NOTE 5: ACL + Δ → BB → ACH ; ACH → DO → ACL

FIG. 7

| INSTR | SEQ 1 CL | SEQ 1 ALU | SEQ 2 CL | SEQ 2 ALU | SEQ 3 CL | SEQ 3 ALU | SEQ 4 CL | SEQ 4 ALU | SEQ 5 CL | SEQ 5 ALU | SEQ 6 CL | SEQ 6 ALU |
|---|---|---|---|---|---|---|---|---|---|---|---|---|
| BAL | PCI | | IB SET PCI | (ACH→DO) ACL→DB | NOTE 7 | PCL→DO | WRT IRH | PCH-1 + CR →DO | NOTE 9 | NOTE 10 | (TERM) | SET TRA |
| RTN | IBL | | IRH | NOTE 5 | IRL + 8 | (ACH→DO) ACL→DB | NOTE 8 | NOTE 10 | PCI | NOTE 11 | (TERM) | (ACL→DO) |
| BØØ | PCNI | | NOTE 3 | PCH-1 → [AOH] | PCI | X | (TERM) | X | | | | |
| $\overline{\text{BØØ}}$ | PCI | | PCI | X | (TERM) | X | | | | | | |
| IJO | PCNI | | NOTE 4 | PCH-1 → [ACH] | PCI | X | (TERM) | X | | | | |
| $\overline{\text{IJO}}$ | PCI | | (TERM) | X | | | | | | | | |
| BLI | IBL | | (TB ⟹ IB) IRH | NOTE 5 | PCI | (ACH→DO) ACL→DB | ACL→AOH TB→AOL | NOTE 10 | (TERM) | ITAL | | |
| BSI | IBL | | (TB ⟹ IB) IRH | NOTE 5 | PCI | (ACH→DO) ACL→DB | WRT ACL→AOH TB→AOL | NOTE 10 | (TERM) | TBNS | | |
| IN | PCI | | OUT 1st IO WRT TB | NOTE 6 | OUT 2nd IO WRT TB | ACL→DO | (TB ⟹ IB) PCI | X | (TERM) | IOD AC7* →EQ | | |
| OUT | PCI | | OUT 1st IO WRT TB | NOTE 6 | OUT 2nd IO WRT TB | ACL→DO | (TB ⟹ IB) PCI | X | (TERM) | IOD AC7* →EQ | | |
| INTERUPT 1-5 | NOTE 1 | | STR ACH WRT 4H | NOTE 5 | STR LOW AC WRT 4L | ACL→DB ACH→DO | STR OLD STAT WRT 8L | TBNS STAT →DO→ACL | HI ADD READ 12 H | TBNS PCL→DO →ACL | (TERM) | |
| INTERUPT 6-10 | NOTE 2 | ACL-1→DO | STR PCH WRT OH | PCH-1 + CR →DO | NEW STAT 8H | X | NOTE 9 | NOTE 10 | PCI | UPDATE STAT | (TERM) | |
| | 220 | Ø1 | Ø2 | Ø1 | Ø2 | Ø1 | Ø2 | Ø1 | Ø2 | Ø1 | Ø2 | Ø1 Ø2 |

PREVIOUS INSTRUCTION

NOTE 1: LOW ADDRESS READ 12L
NOTE 2: STR PCL WRT OL
NOTE 3: CAL HIGH BITS; TB→AOL
NOTE 4: CAL HIGH BITS; IB→AOL
NOTE 5: ACL→DB→ACH; ACH→DO→ACL
NOTE 6: TB (MODIFIED)→DO
NOTE 7: SET IB TO "TRAP"; WRITE IRL
NOTE 8: UPDATE PC; ACL→ACH; TB→ACL
NOTE 9: UPDATE PC; ACL→AOH; TB→AOL
NOTE 10: ACL→AOH; DB→ACH; ACH→DO→ACL
NOTE 11: (ACL→DO) STAT
UPDATE IF REGO GRPO

FIG. 8

| ZONE | GROUP | MEMORY TYPE |
|---|---|---|
| ZONE 3 | 31 | DIAGNOSTIC SPACE |
| | 30 | REPLICATE I/O |
| | 29 | CMOS |
| | 28 | |
| | 27 | WORK REGISTERS |
| | 26 | |
| | 25 | |
| | 24 | |
| ZONE 2 | 23 | DIAGNOSTIC SPACE |
| | 22 | REPLICATE I/O |
| | 21 | CMOS |
| | 20 | |
| | 19 | WORK REGISTERS |
| | 18 | |
| | 17 | |
| | 16 | |
| ZONE 1 | 15 | DIAGNOSTIC SPACE |
| | 14 | REPLICATE I/O |
| | 13 | CMOS |
| | 12 | |
| | 11 | WORK REGISTERS |
| | 10 | |
| | 9 | |
| | 8 | |
| ZONE 0 | 7 | DIAGNOSTIC SPACE |
| | 6 | REPLICATE I/O |
| | 5 | CMOS |
| | 4 | |
| | 3 | WORK REGISTERS |
| | 2 | |
| | 1 | |
| | 0 | |

FIG. 19
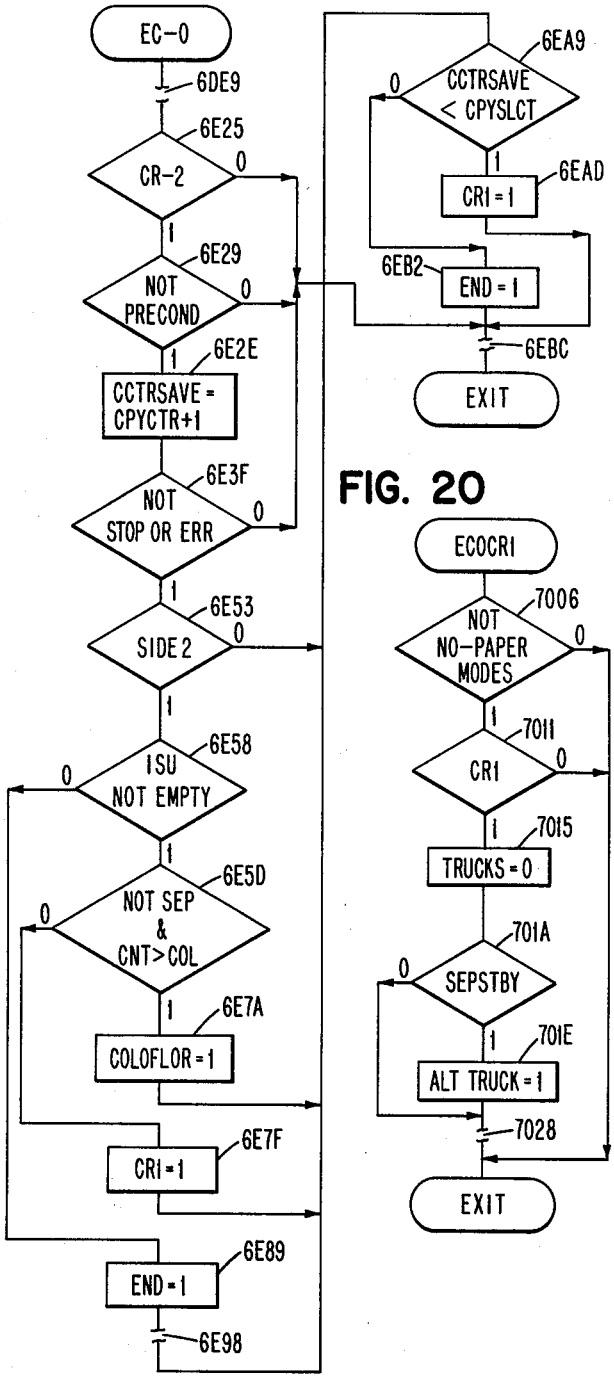
FIG. 20
FIG. 22
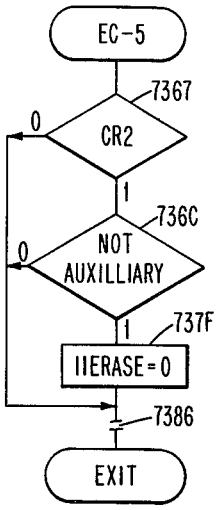
FIG. 23
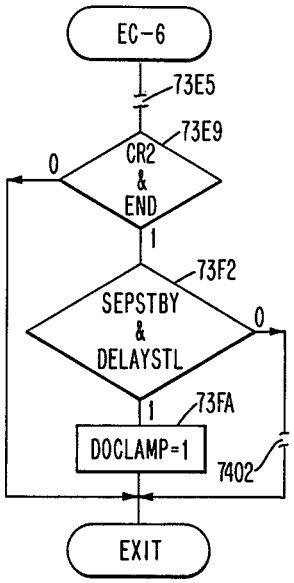

COPY PRODUCTION MACHINES HAVING JOB SEPARATION AND COLLATION CAPABILITIES

DOCUMENT INCORPORATED BY REFERENCE

U.S. Pat. No. 4,114,871 "Collation Controls" (Botte) Ser. No. 794,327 assigned to the same assignee as the present application.

BACKGROUND OF THE INVENTION

The present invention relates to copy production machines, particularly of the convenience copier type, having the capability of producing a succession of copy jobs (which may be unrelated) in a succession of copy runs and of controllng a succession of such copy runs as a single copy job.

Transfer electrographic copy production machines, as well as other copy production machines of diverse types, employ various forms of image transformation for putting an image on a sheet of copy paper. Usually an image in latent form is generated and transferred to a copy sheet. In some convenience copier types of copy production machines, only one run of copies can be produced automatically, i.e., an original document containing a single image is placed on a document glass. Upon actuation of a start button, or suitable document sensing apparatus, the copy production machine produces a given number of copies in accordance with the operator-inserted number in a control panel of the copier. Upon completion of the copies automatically produced, the copy production machine would stop. However, in some instances a semiautomatic document feed (SADF) enables an operator to provide a succession of original documents in a semiautomatic mode to a document glass. In such instances the copy production machine senses the presence of an additional original document and then automatically restarts for making a second run. A succession of related original documents can be conveniently termed as a copy job i.e., an operator wants to produce a given number of copies of a given number of original documents. Accordingly, each copy job is characterized by one or more copy runs.

Some copy production machines have an automatic document feed, i.e., the machine will automatically handle original documents for providing collated sets without collating the produced copies. In such a situation a copy job includes a plurality of successive runs producing a plurality of sets of documents. As used herein, the term set of documents is referred to as a subjob to be separated by a separation sheet, for example. Accordingly, when an automatic document feed handles original documents on the behalf of a copy production machine, a subjob is considered as a complete job for the copy production machine. The automatic document feed then ties a succession of these copy production machine jobs into a complete copy producing job as defined in the automatic document feed.

Furthermore, copy production machines have usually a copy paper sources. Such plurality of copy paper sources are usually referred to as the main supply and as the auxiliary supply. Generally, the main supply has a capability of storing a greater number of copy sheets than the auxiliary supply. By operator selection, the copy production machine will select copy sheets from either of the copy sheet sources. In some machines, a roll of paper provides a source of copy sheets. Along these lines, a plurality of rolls may be provided or a combination of rolls and precut sheets of copy paper may be utilized as a plurality of sources of copy paper.

One feature of copy production machines is that collators for collating produced copies can be attached to such machines. Such collating apparatus is usually quite expensive. Accordingly, it is desired, in order to control cost, to minimize the size of the attached collator. When the collator has reduced size, the copy producing capability of the copy production machine may be limited by the collator capacity. Also, it may be desired not to have a collator, which often occurs in a relatively small office where the number of collated copies is a minor requirement.

It is desirable for operator convenience to enable the copy production machine to produce as many copy jobs as possible without intervention by the operator, i.e., the operator having to remove produced copies from the output portion of the copy production machine.

SUMMARY OF THE INVENTION

It is an object of the invention to provide an enhanced separation mode for use in copy production machines.

It is another object to provide improved means for extending collator capacity by using automatic controls in connection with separation mode. The automatic controls preferably include a programmable controller or computer.

A copy production machine constructed in accordance with the present invention includes means for indicating a standby or copy producing mode, means indicating a desired end-of-run indicator and means responsive to the two indicators to initiate a separation mode run. A separation mode run at the beginning or end of a multi-run job is characterized by placing a single copy separation sheet in each copy receiving bin. When a collator is employed, the number of bins selected in the collator for receiving separation sheets intermediate successive copy runs is in accordance with the number of copies to be produced in the next succeeding copy run of the job.

When the copy production machine has a plurality of copy paper supply sources, it is preferred that the copy be produced from one source and the copy separation sheets be acquired from a second source. The copy paper for producing copies and the copy separation sheets may be selected from the same source.

Preferably either one separation sheet may be provided between two successive jobs or a plurality of separation sheets may be provided. Fully automatic means can be utilized for programming the operation of the copy production machines in accordance with the invention.

Copy jobs requiring more capacity than a connected collator are performed by segmenting the job into segments related to the capacity of the collator. Then, by repeating the segments separated by a separation sheet, an entire collate copy production job is performed with minimal operator inconvenience.

For efficient collation, a number of separator sheets equal to the number of sets yet to be collated in the next succeeding collating segments is supplied, one to each of predetermined bins. Subsequently, collated sets are directed to those predetermined bins on top of such separator sheets.

The foregoing and other objects, features, and advantages of the invention will be apparent from the following more particular description of preferred embodiments of the invention as illustrated in the accompanying drawings.

BRIEF DESCRIPTION OF THE DRAWINGS

FIGS. 7 and 8 are charts showing instruction execution sequencing of the FIG. 6 illustrated programmable processor.

FIG. 13 is a flow chart showing separation mode control procedures.

FIGS. 19 and 20 are flow charts showing actions at EC0 time of a copy production machine relating to separation mode.

FIGS. 21–23 are flow charts showing timed machine actions relating to separation mode.

DETAILED DESCRIPTION

General

Figure 1:
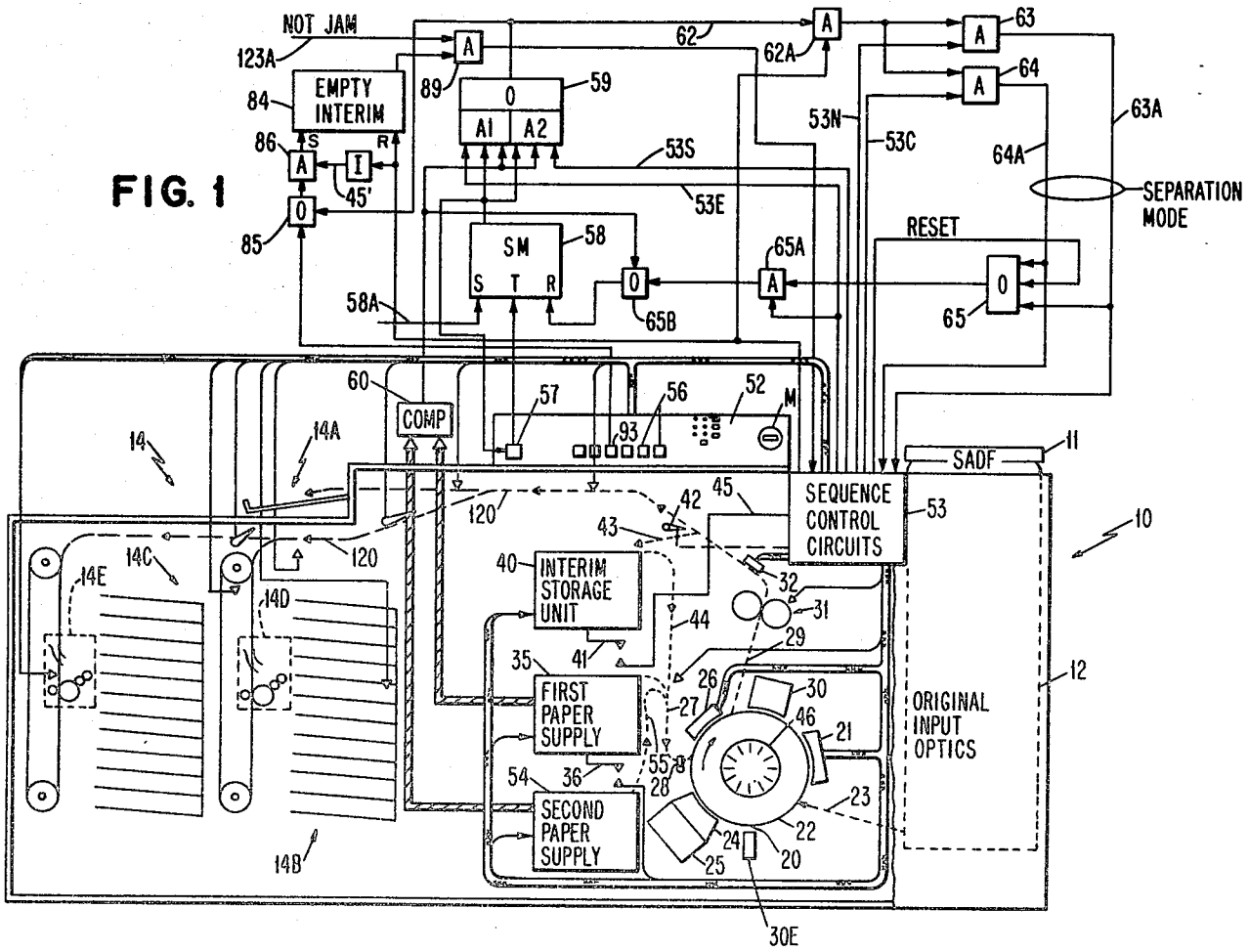
FIG. 1 is a combined schematic and diagram showing a copy production machine employing the present invention and accentuating certain control circuits for implementing the invention.

In the drawing, like numerals indicate like parts and structural features in the various diagrams. A copy production machine 10 employing a first version of the present invention includes a semiautomatic document feed (SADF) 11 for feeding manually inserted original documents to be copied. The document glass (not shown) in SADF 11 is scanned by known optical scanners in original input optics 12 to provide an illuminated image over path 23 to a later described copy production portion 13. Copy production portion 13 transfers the line 23 indicated optical image to copy paper as will be later described, and supplies the produced copies to output portion 14 for pick up by an operator or for automatic transfer to other utilization apparatus (not shown). In a constructed version of the invention output portion 14 includes a copy output tray 14A which receives all produced copies in a noncollate mode. When the copy production machine 10 is to be used in an environment requiring automatic collation, a collator 14B is included in output portion 14. When the number of copies to be collated becomes relatively large, a second collator 14C is connected to the first collator 14B in tandem for receiving copies to be collated.

In accordance with the present invention, control means are provided in the copy production machine 10 for automatically or semiautomatically inserting copy separation sheets from copy production portion 15 and inserting them between copies of successive jobs in output portion 14. This action includes selectively supplying copy separation sheets to copy exit tray 14A and to a selected number of copy receiving bins in collators 14B, 14C. In the latter regard, if ten copies are being made of each image, then ten separation sheets are provided to collator 14B. Similarly, if 15 copies are being made, then 15 copy separation sheets are supplied. If it is desired to have a plurality of copy separation sheets between two successive copy jobs, then the copy production portion 13 is actuated to supply some plurality of copy separation sheets in the manner described for the single copy separation sheet per copy bin. Furthermore, if more copies are to be produced than there are collator bins, then sequence control circuits 53 keep a tally of copies produced for a given copy production job, as later detailed in the section "LOGICAL EXTENSION OF COLLATOR CAPACITY USING THE SEPARATION MODE."

The copy production machine 10 includes an operator's control panel 52 having a plurality of manually actuable switches for introducing copy production parameters to copy production portion 13. Such parameters are well known and are not detailed except for those parameters arbitrarily having an operative and direct relationship with a first constructed embodiment of the present invention.

The operational details of the copy production devices are set forth in detail in U.S. Pat. No. 4,086,658 (assigned to the same assignee as this application) from column 3, line 58 to column 5, line 36.

SEPARATION MODE BASIC OPERATIONS

FIG. 1 also includes circuits brought out for emphasis, showing incorporation of a separation mode control in the illustrated copy production machine 10. Control panel 52 includes separation mode selection switch 57 which, when depressed, actuates separation mode SM trigger 58 to an opposite state from its present state. Normally Sm 58 is in the reset state indicating that no separation sheets are to be provided at the end or beginning of a copy producing run. In addition to switch 57, SM 58 may be set by computerized control (not shown) at its set input S via line 58A. When SM 58 is set to the separation indicating state, it supplies an activating signal to A0 circuit 59 for actuating CPP 13 to supply one or more copy separation sheets to output portion 14. In this regard, the A1 input portion of A0 59 responds to SM 58 being set to the active condition, to a noncollate indicating signal received from sequence control circuits 53 over a line 53E indicating end of a copy run (last copy), and to a compare equal signal from compare circuit 60 to supply a separation mode initiating signal over line 62 to AND circuits 63, 64 via an AND gate 62A. Therefore, the A1 input portion initiates a separation mode run at the end of a copy run. In a similar manner, the A2 input portion of A0 59 responds to a start or beginning of run signal received over line 53S from control circuits 53, to the SM 58 signal and the compare circuit 60 signal to supply a separation mode actuating signal over line 62. This latter A2 signal starts a separation mode at the beginning of a copy run.

AND circuit 63 supplies a noncollate, separation mode actuating signal to control circuits 53 over line 63A. Whenever AND circuit 63 is receiving a noncollate indicating signal over line 53N from control circuit 53, AND 63 responds to the line 62 signal to initiate the separation mode. Similarly, AND circuit 64 responds to a collate indicating signal received over line 53C from control circuits 53 and the line 62 signal to supply a collate type separation mode actuating signal over line 64A to control circuits 53. OR circuit 65 combines the separation mode actuating signals to reset SM 58 via AND circuit 65A at the end of each separation mode run, i.e., deselect separation mode. OR circuit 65B combines the just described reset signal with a later described inhibit signal. In this particular arrangement, the operator selects one separation sheet per actuation of separation mode switch 57. Furthermore, SM 58 is reset by signals from control circuits 53, such as by a timeout timer actuated when the copy production machine is in a standby mode, the stop button is depressed, reset button is depressed, and the like. The separation mode is indicated on panel 52 by a light integral with switch 57 and actuated by a separation mode indicating signal from SM 58.

Line 63A signal, noncollate separation mode, actuates sequence control circuits 53 to cause CPP 13 to supply one copy separation sheet without image transfer to copy exit tray 14A. Upon completion of such transfer, copy production machine 10 is ready for the next copy producing run. Similarly, line 64A signals actuate sequence control circuits 53 to have CPP 13 provide a plurality of copy separation sheets to collators 14B, 14C in accordance with the number of copies selected to be produced, i.e., each bin in the collators 14B, 14C having received produced copies or which will receive produced copies from CPP 13 will receive each one copy separation sheet per actuation of separation mode button 57.

When copy production machine 10 is producing copies, while button 57 is depressed, as machine 10 detects the last copy, a separation mode run is automatically invoked as above described. If, however, button 57 is not depressed until copy production machine 10 is in the standby mode (intermediate successive copy producing runs), then upon starting a copy producing mode, as by insertion of a document into SADF 11, CPP 13 will first provide a copy separation sheet as above described before producing any copies from the original document in SADF 11.

In certain areas of the world, paper sizes vary so substantially that a paper transport path usually does not accommodate different sizes. In such situations separation mode is inhibited whenever the alternate or second paper supply 54 has such a different size but permitted when the sizes are compatible.

Compare circuit 60 indicates to A0 59 whether the size of paper supplies 35 and 54 are compatible or have predetermined differences preventing paper path operation. Copy production machine 10 may be used in many nations which use these different size papers. Within reason, different sized copy paper can be used efficiently for copy separation sheets. For example, USA letter size 8.5×11.0 inches is similar to DIN A4 size paper such that they could be used interchangeably for copy separation sheets and copy producing sheets. Similarly, USA legal sizes 8.5×13.0 inches or 8.5×14.0 inches are similarly suited for interchange with copy producing and copy separation sheets. However, DIN size B4 has a much greater width than the letter, legal, and DIN A4 sizes; therefore, copy transport path characteristics are usually substantially different and copy separation sheets of B4 size would not be suitable for separating A4 size paper in most copy producing machines. Accordingly, if compare 60 senses A4 paper in supply 35 and B4 paper in supply 54, the separation mode is inhibited by a disable signal supplied to A0 59 by compare 60. The compare output also resets SM 58.

In a constructed embodiment, the copier separation sheets were transported from second supply 54 via path 55, 27, 29 to output portion 14. During each such transfer, copy separation operations of CPP 13 were inhibited as will be explained with respect to illustration of the separation mode as incorporated in the copy production machine 10. In a duplex mode of operation, separation sheets are never directed to interim storage unit 40.

Figure 2:
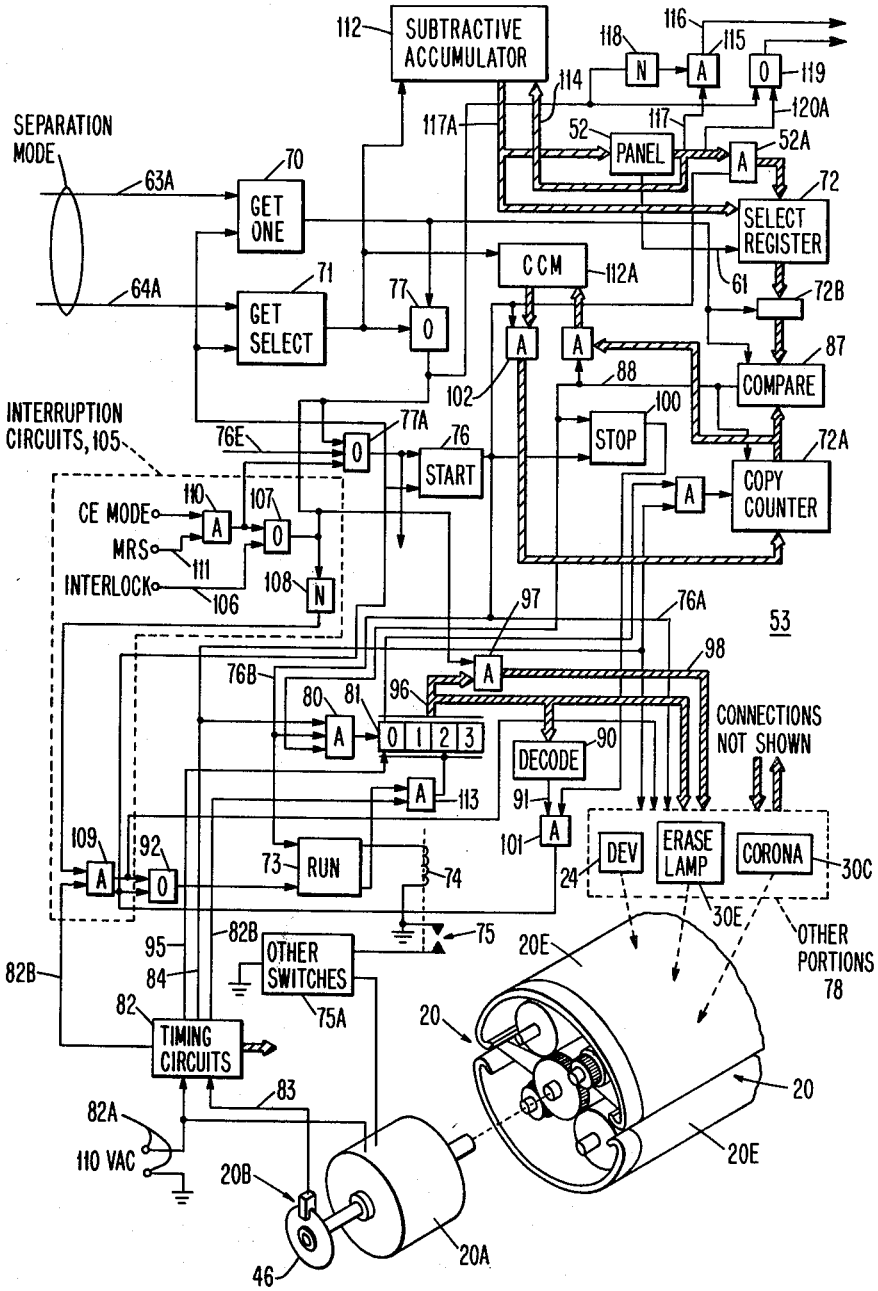
FIG. 2 is a diagram showing control circuits and associated hardware for implementing the separation mode of the present invention in one embodiment.

Operation of a separation mode for copy production machine 10 is best understood from FIG. 2. The separation mode signals on lines 63A, 64A, respectively set GET ONE latch 70 or GET SELECT latch 71. Latch 70 actuates copy production machine 10 to transfer one copy separation sheet from CPP 13 second paper supply 54 to output portion 14, whereas latch 71 actuates CPP 13 to supply a number of such copy separation sheets indicated by copy select register 72 to output portion 14. Latches 70, 71 start copy production machine 10 via its usual starting circuits including start latch 76. OR circuit 77A passes the latch 70, 71 active signals to the set input of start latch 76. OR circuit 77A receives this signal plus other signals for activating start latch 76. Start latch 76, in addition to the functions performed in the illustrated figure, also enables power to be applied to CPP 13 of the copy production machine 10. Repowering copy production machine 10 includes activating power relay PR of U.S. Pat. No. 3,588,242 which is relay 74 of this application, for example. CPP 13 may be controlled as described in U.S. Pat. No. 3,588,242. For enabling repowering, an activating signal is supplied by start latch 76 over line 76A to other portions 78 of the document reproduction machine 10. Other portions 78 represent the xerographic processing stations 21, 24, 30, 30E and 26 of FIG. 1 which are associated with the photoconductor of copy drum 20 as described in U.S. Pat. No. 3,588,242. It is also to be understood that other portions 78 may have interactions not described herein or in U.S. Pat. No. 3,588,242.

Figures 9, 10:
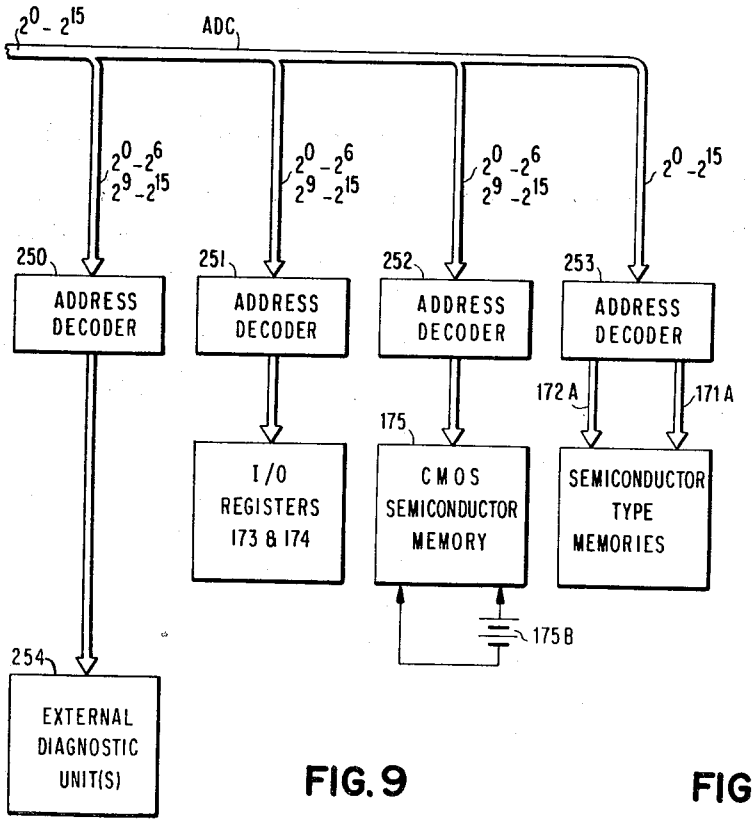
FIG. 9 is a block diagram of a memory addressing system for use with the FIG. 4 illustrated processor control system.
FIG. 10 is a diagram showing register space assignments of the FIG. 4 illustrated processor control system.

Start latch 76 also supplies an activating signal over line 76B for setting run latch 73 to the active condition. Run latch 73, in turn, powers motor control relay 74 (equivalent to PR of U.S. Pat. No. 3,588,242, supra) to close a pair of normally open contacts 75. These contacts 75 provide ground reference potential through other switches 75A, such as shown in FIG. 9 of U.S. Pat. No. 3,588,242, for energizing motor 20A to rotate copy drum 20 and power other mechanical portions of the document reproduction machine 10. Other mechanical portions are included in the diagrammatic representation 78. Motor 20A of the present application corresponds to motor 12 of FIG. 9 of U.S. Pat. No. 3,588,242. Additionally, start latch 76 also enables AND circuit 80 for passing copy cycle indicating signals (later described) for inserting indicating signals into shift register 81 for controlling the copy separation mode as will become more apparent.

Timing circuits 82 provide synchronized and nonsynchronized timing signals for operating the document reproduction machine 10. These timing signals are provided to other portions 78, as well as the illustrated circuits. The AC power supply, indicated by terminals 82A, actuates timing circuits 82 to generate a plurality of timing signals in synchronism with the power frequency. Terminals 82A also supply AC power to motor 20A. Additionally, timing signals synchronous with the reproduction process are derived from emitter wheel 20B on copy drum motor 20A. Emitter wheel 20B fiducial mark signals, i.e., representing image cycles of copy drum 20, are supplied over line 83 to timing circuits 82. As a result, timing circuits 82 generate a copy cycle initiating timing signal supplied over line 84. In addition to synchronizing other portions 78 to the copy drum 20 rotation, the image cycle indicating signal passes through AND circuit 80 to insert binary ones synchronously in the low-order digit position of shift register 81. As such, each binary one in shift register 81 signifies a copy cycle of the document reproduction machine 10. Such binary ones in register 81, as will be later explained, are used to terminate the copy separation mode. Additionally, the copy cycle indicating signals on line 84 travel through AND circuit 85 for incrementing copy counter 72A whenever the lowest digit position 0 of shift register 81 has a binary one. Copy counter 72A is an electronic equivalent of the relay copy counter 140 of U.S. Pat. No. 2,588,242. Accordingly, copy counter 72A signifies the number of copy cycles, or machine cycles, elapsed since start latch 76 was set to the active condition. To determine when the desired number of cycles (copies produced or copy separation sheets transferred) has been completed, compare circuit 87 receives signals from select register 72 and copy counter 72A for detecting equality.

Select register 72 is responsive to operator control panel 52 via AND circuits 52A to indicate the number of copies to be made of a given image usually on an original document. When there is an equality, compare circuit 87 removes a noncompare active signal from line 88 thereby disabling AND circuit 80 and setting stop latch 100. This action inhibits a further introduction of binary ones in the low-order state of shift register 81 while conditioning the illustrated circuits to terminate the copy separation mode or a copy production run.

When a binary zero occurs in the low-order stage of shift register 81, AND circuit 85 is disabled thereby inhibiting further counting action of copy counter 72A. As will become apparent, the binary one in the low-order stage of shift register 81 is then shifted toward the most significant stage three. Eventually, the binary one is shifted out leaving the signal contents of shift register 81 equal to zero. When this occurs and the stop latch 100 has been set, the separation mode has been completed, i.e., all sheets have left CPP 13. Decode circuit 90 responds to an all-zeros condition of shift register 81 to supply a stop signal over line 91 via AND circuit 101 to reset run latch 73 via OR circuit 92 as well as resetting both separation mode latches 70, 71 and start latch 76. Stop latch 100 being set conditions AND circuit 101 to pass the line 91 stop signal. At this time, a new copy run can be initiated from panel 52 and normal operations of the document reproduction machine 10 can ensue.

The signal contents of shift register 81 are shifted to the right, as viewed in the figure, once each copy cycle of drum 20. In this regard, timing circuits 82 provide a time delayed image-indicating pulse over line 95 which follows the line 84 pulse. The line 95 signal shifts the signal contents of shift register 81 to the right once each copy cycle, i.e., once each half rotation of copy drum 20.

The signal contents of shift register 81 cooperate with other portions 78 for controlling the reproduction processes. In this regard, cable 96 carries signals from shift register 81 to other portions 78 for purposes beyond the scope of the present description. Additionally, other machine functions are selectively activated by the shift register 81 signals via AND circuits 97. AND circuits 97 respond to the separation mode signal from OR 77 to pass the control signals over cable 98 to other portions 78. These separation mode control signals disable certain reproduction processes during the separation mode to inhibit any image transfer to copy separation sheets. Those reproduction processes disabled during the separation mode include the panel 52 displays except for a standby indicating signal (not shown). Billing meter M is disabled such that the user will not be charged for operations during the separation mode. Also disabled are the edge erase lamps (not shown), a document scanning lamp (not shown) is not illuminated, and interimage erase (not shown) is not timed (remains on at all times to erase the drum 20 photoconductor surfaces). The latter inhibited function prevents the erase lamp from turning off between image cycles during the copy separation mode. Certain apparatus in other portions 78 which respond to control circuit 53 supplied signals over cable 96 are also inhibited during the separation mode.

During the copy separation mode, the copy production machine 10 may be subjected to interruptions of operation caused by someone opening a panel on the machine (not shown) or the machine being placed in a maintenance or CE mode. In spite of such intended or unintended interruptions, the copy separation mode should be completed as originally contemplated. Accordingly, the illustrated circuits restart the machine in the copy separation mode upon occurrence of any of the above-described interruptions. The interruptions of the machine processing are processed by circuits 105.

For example, if a panel (not shown) is opened on the machine 10, exposing high voltage to an operator, everything must stop. To this end, an interlock signal on line 106 signifies that all panels and doors are properly closed. If any panel or door is opened, the line 106 interlock signal is removed. When active, the line 106 interlock signal passes through OR circuit 107, thence to inverter circuit 108, thence to AND circuit 109. AND circuit 109 responds to the inverse of the OR circuit 107 signal to pass a power derived timing signal received over line 82B from timing circuits 82 to reset run latch 73 and also provide a turnoff procedure to other portions 78, such as removing high voltage, but maintaining low voltage such that machine state indications of the document reproduction machine can be maintained. In this regard, copy separation mode latches 70, 71 are not altered during such interruption.

A second source of interruption is the maintenance or CE mode. AND circuit 110 responds to a maintenance or CE (customer engineer) mode being selected and to a momentary run switch (MRS) (not shown) being depressed, as signified by the signal on line 111, to pass an active signal through OR circuits 77A and 107. If, during the maintenance mode, the MRS is opened, AND circuit 110 removes the enabling signal thereby activating AND circuit 109 to prevent operation of the document reproduction machine 10. Upon restoration of the enabling signal at AND circuit 110, start latch 76 is again set to the active condition. It must be remembered that one of the copy separation latches 70, 71 was in the set condition, providing an AND circuit enabling signal via OR circuit 77. Start latch 76 being set again sets run latch 73 and all procedures of the copy separation mode are restored to the conditions immediately prior to interruption. Start latch 76 being set resets stop latch 100.

When run latch 73 is reset during an interruption, shift register 81 has to start again from the lowest order digit position zero. To this end, timing circuits 82 supply an AC power synchronous timing signal over line 82B to AND circuit 113, which is enabled by run latch 73 being reset. AND circuit 113 then resets all stages of shift register 81 to the zero condition.

Additionally, during a copy separation mode, it is desired that no signals from panel 52 travel through AND circuits 52A to select register 72. In this regard, the start latch 76 supplies an activating signal to a standby circuit (not shown) which supplies a display indicating standby for operator observation. It also supplies a disabling signal preventing AND circuits 52A from transferring any operator initiated signalling to select register 72. The stop signal is acknowledged by means not shown.

The above-described separation mode circuits operate in response to the GET SELECT latch 72 set to the active condition for initiating transfer of a number of copy separation sheets equal to the number of copies to be made in a next succeeding copy production run from paper supply 54 through the illustrated paper paths of FIG. 1 into output portion 14 for the collators 14B and 14C. Not shown but assumed is that the collate mode has been selected as indicated by the signal on line 53C. The collate control circuits are of usual design and are not described herein for purposes of brevity.

Accordingly, the copy separation sheets will be equal to the number of copies to be made in the next succeeding run in accordance with select register 72. It should be noted that SM 58 of FIG. 1 being set activates AND circuit 64 in response to the last copy signal supplied over line 53E. Similarly, if the start button (not shown) is depressed, the signal of line 53S establishes the separation mode in copy production machine 10 for transferring copy separation sheets to collators 14B, 14C. Accordingly, if SM 58 is triggered to the set state by closing switch 57 during a run, one copy separation sheet will be supplied to each bin of the collators 14B, 14C at the end of the run (termed a trailing separation run). Redepressing the switch 57 and then pushing the start button causes a second separation sheet to be transferred to the same number of bins, i.e., copy select register 72 has maintained the copy count selection.

For collating efficiency it is desired that the collators 14B, 14C collate in both directions. Such operations are described in the U.S. Pat. No. 4,114,871 incorporated by reference. An example is that the next succeeding collate run is to produce five sets. If the collator had previously had twenty sets collated, the automatic control still puts five separator sheets, preferably in the top five collator bins, no limitation thereto intended. Then the five succeeding sets are bidirectionally collated into the five top bins. After the five sets are collated, twenty separator sheets can be added. If such twenty additional separator sheets are not desired, then the original five separator sheets are a minimum number of separator sheets to achieve collator set separation.

When exit tray 14A is receiving copies in a noncollate mode, only one copy separation sheet should be supplied to exit tray 14A for each depression of button 57 which coincides with either the end of a copy run or the beginning of a copy run. To this end, the GET ONE latch 70 of FIG. 2 disables AND circuits 72B, preventing the signals from select register 72 from reaching compare circuits 87. Simultaneously, the GET ONE latch 70 signal goes to compare circuits 87 forcing a one copy selected signal. Accordingly, when copy counter 72A equals one, compare circuit 87 emits a complete signal over line 88 for stopping the copy run as aforestated for a single copy run indicated by select register 72.

The selection of the source of paper from supply 35 or supply 54 (FIG. 1) is achieved from panel 52 as shown in FIG. 2. AND circuit 115 supplies an actuating signal over line 116 to paper supply 35 for supplying paper in response to a panel 52 selection supplied over line 117. When the separation mode is incorporated into the document production machine 10 the OR circuit 77 signal is inverted by inverter 118 to inhibit AND circuit 115 during the separation mode. Simultaneously, the OR circuit 77 signal is supplied through OR circuit 119 to activate second supply 54. Panel 52 also includes a switch (not shown) for supplying a second paper supply 54 selection signal over line 120A through OR circuit 119. Accordingly, when copies are produced from paper supplied from supply 35, copy separation sheets are supplied automatically from second supply 54. However, when copies are being produced from second supply 54, the separation sheets are also supplied from second supply 54. It can be easily envisioned that other combinations and controls can be effected for selected copy separation sheet sources while successfully practicing the present invention.

If the separation mode is selected the CE mode depression of the MRS button as signified by the signal on line 111 of FIG. 2 will also activate the separation mode circuits. The line 53S (FIG. 1) signal is supplied from OR circuit 77A of FIG. 2 which sets start latch 76 to the active condition. An AND circuit (not shown) can be interleaved in line 53S for being inhibited during the CE mode or upon a restart of latch 76 not initiated by the start button as received by a signal over line 76E. In the alterative, line 53S may receive signals only from line 76E. In a SADF 11 machine, the line 76E start signals will be either from insertion of the document to be copied in SADF 11 or actuation of a start button (not shown) on panel 52.

Prior to institution of a separation mode, copies residing in ISU 40 are automatically transported to the output portion 14 as completed copies. In this regard, the empty interim latch 84 is set to the active condition when a separation mode has been requested as indicated by AO59 over line 62 and copies are in the interim storage unit 40. Copies in unit 40 are indicated by switch 41 being closed for enabling AND circuit 86 via line 45'. Additionally, empty interm latch 84 is set to the active condition when copies are in the interim storage unit 40 and selection switch 93 either selects the duplex mode or deselects the duplex mode. Such mode change is signaled through OR circuit 85 to AND circuit 86.

Figure 3:
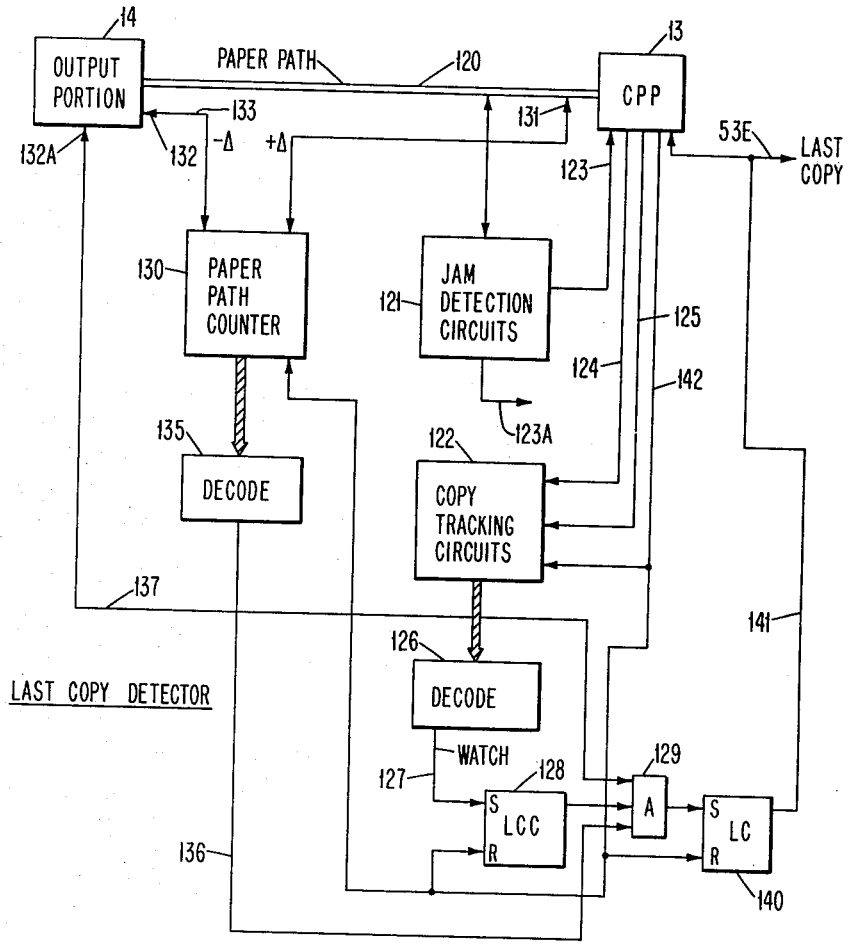
FIG. 3 is a diagram showing a last copy detector usable with the present invention for indicating a change between copy producing and standby machine modes.
Figure 5:
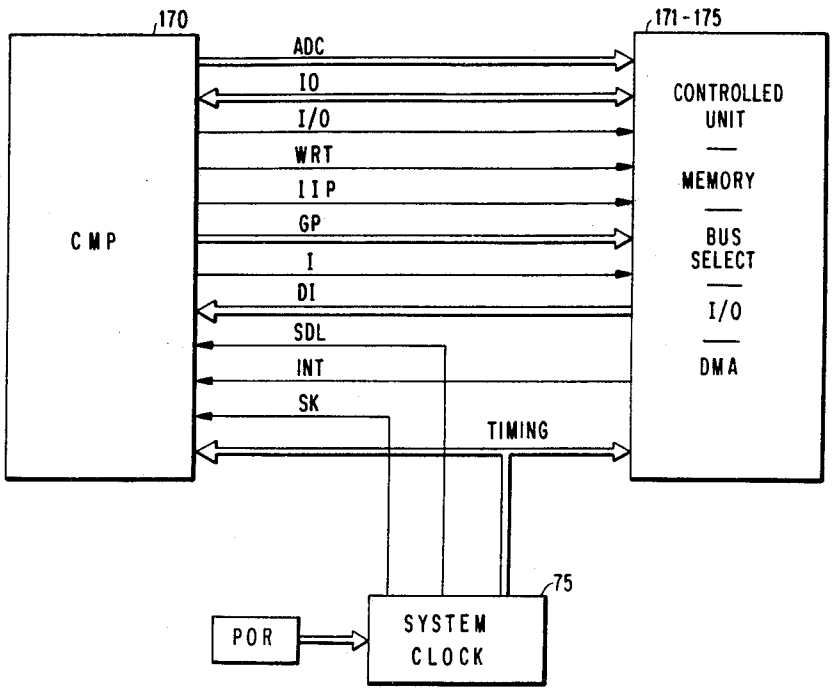
FIG. 5 is a diagram showing the bus control connections for the FIG. 4 illustrated processor control system.

When set to the active condition, empty interim latch 84 output active signal passes through AND circuit 89 during a "not-jam" condition as indicated by the FIG. 3 illustrated circuits over line 123A. From AND circuit 89 the empty interim signal goes to sequence control circuits 53 which then automatically select the interim storage unit 40 as a source of copy sheets, controls other-portions 78, as described later with respect to FIG. 2, for preventing image transfer, and then automatically transfers copy sheets from interim storage unit 40 to output portion 14. Switch 41 opening, i.e., when interim storage unit 40 is empty, resets empty interim latch 84. This action removes the empty interim signal from AND circuit 89 which in turn removes the signal being supplied to sequence control circuits 53. At this time, sequence control circuits 53 know that the separation mode can ensue. This condition is signaled by the same line from sequence control circuits 53 that actuates the line 45', which line goes to AND circuit 62A for passing the line 62 separation mode signals to the pair of AND circuits 63, 64, as previously described, for actuating the separation mode.

Separation mode trigger (SM) 58 is reset from the active condition to the inactive condition by signals passing through OR circuit 65B. A first reset occurs when comparator 60 in a "B4" type machine signals that copy sheets in second paper supply 54 are incompatible with the copy sheets in first paper supply 35. This signal inhibits the separation mode. The second reset signal for SM 58 comes at the end of a separation mode run. AND circuit 65A responds to the output of OR circuit 65, as previously described, and an "end of run" indication from sequence control circuits 53 to supply the second reset signal.

The last copy signal on line 53E is generated by the FIG. 3 illustrated circuits. Detection of last copy is based on monitoring the copy sheet path 120. Path 120 is also monitored for jamming by jam detection circuits 121 in combination with the copy tracking circuits 122. Details and interconnections of these circuits are omitted for brevity. Jam detection circuits 121 normally indicate a nonjam condition on line 123 to CPP 13 permitting document reproduction machine 10 to operate. Upon detecting a jam, the signal on line 123 is changed by circuits 122 to stop machine 10 interrupting copy production, thereby inhibiting detection of a last copy. When stopped, all circuits remain static. In a preferred form, copy tracking circuits 122 consist of a shift register which receives a copy cycle signal over line 125 from CPP 13. The line 124 copy cycle signal sets a stage of the shift register (not shown) in circuits 122 to the active condition. The active condition is then shifted by a shift signal received over line 125 from CPP 13. If copy tracking circuits 122 include an eight-stage shift register and five copies or copy separation sheets are being transported from CPP 13, then five stages will be active with the five active conditions being shifted synchronously with the actual transport of the copy separation sheets in paper path 120 toward the indicated exits in output portion 14. The active conditions of the shift register (not shown) of copy tracking circuits 122 signify a desired paper copy transport status within path 120. Toward the end of a multiple copy run, only those stages of the shift register (not shown) in copy tracking circuits 122 at the terminal end of the shift register (not shown) will be in the active state. For example, in an eight-stage shift register, when the last two stages are in the active state and the preceding six stages are in the inactive state, decode circuit 126 supplies an active or watch signal over line 127 signifying that the last copy of a multiple copy run should be watched for to ensure early starting time of the next succeeding copy run (or a separation mode run). The line 127 signal sets last-copy detector condition (LCC) latch 128 to the active condition, memorizing the watch signal for the remainder of the immediate copy run. Latch 128 being in the active condition partially enables the last-copy detector AND circuit 129.

The paper path monitor, which is up/down counter 130, is incremented in the positive count direction by signals from paper path detecting switch 131. As the copies or copy separation sheets are transferred along paper path 120, exit switch 132 responds to trailing edges of exiting copies to supply a signal over line 133 for decrementing paper path counter 130. Accordingly, the count at any time within counter 130 signifies the number of copies being transferred at that instant through paper path 120. Decode circuit 135 responds to paper path counter 130 having a zero count, or any other reference count, to supply an active signal over line 136 signifying that paper path 120 is clear of copies. The line 136 active signal additionally provides an enabling signal to last-copy detector AND circuit 129.

The last copy or copy separation sheet now is being transferred along one of the paper path branches toward one of the exits 14A, 14B, 14C; each branch has a switch 132 and 132A. Since only one exit is used at a given time then any copy exiting will indicate the last copy has left the machine 10. To this end, the respective copy exit sensing switch 132A detects the trailing edge of the existing copy. The trailing edge indicating output signals from switch 132A on line 137 actuates AND circuit 129 to the active condition. Of course, if the signals on line 136 and latch 128 are inactive, AND circuit 129 does not respond. When actuated, AND circuit 129 immediately sets last-copy latch 140 which, in turn, supplies the memorized last-copy signal over line 141 or a "go" signal to CPP 13 and over line 53E to the separation circuit 59 of FIG. 1. In the collators 14B, 14C a switch (not shown) in the sheet distributing carriages 14D, 14E signals last copy.

Job Segment Connections

Using the above-described separation mode in conjunction with the now to be described control circuits, greater facility for collating sets of copies are provided. For example, the number of copies to be produced as selected via panel 52 may exceed the collating capacity of output portion 14. Nevertheless, the total number of copies may still be selected and produced by segmenting the production job. On the first run of set production, a number of copy sets equal to collator capacity is produced. After the last sheet is produced of the last page of the first group of collated copy sets, the separation button 57 is actuated. Then upon completing the last copy run, copy production machine 10 automatically provides a separation run as above described. If only five more additional sets are needed, then the number of separator sheets supplied by copy production machine 10 is five sheets, i.e., the number of copies to be produced in the next succeeding runs. Furthermore, the automatic control circuits provide for automatically selecting five copies to be produced, for example. This is achieved by adding a subtractive accumulator 112 to the FIG. 2 illustrated circuits. The panel 52 selections are supplied over cable 114 to the subtractive accumulator. In the collate mode a collate signal supplied over line 61 from panel 52 to select register 72 limits the selection to the collating capacity of copy production machine 10. Accordingly, without operator intervention copy production machine 10 produces the first forty copies of a forty-five copy set. Then, during the production of the last sheet of the first group of 40 collated copy sets, the operator actuates button 57 for selecting the separation mode. Since collate has been selected, the get select latch 71 is set to the active condition. At the end of the last copy production run of the first group of collated sets, the get select latch 71 actuates copy counter memory CCM 112A to memorize the previous copy count of forty and also remember that latch 71 had been set to the active condition. Furthermore, subtractive accumulator 112 is actuated by the get select latch 71 to subtract forty from the initial selection of forty-five and transmit five over cable 117 to select register 72. Then the operator can insert more copies in SADF 11 and produce the last five copies as a second group of collated copy sets. All five sets will be separated from the previous sets by separator sheets with a minimal number of separator sheets used. Furthermore, memory CCM 112A indicates that forty sets had been collated. AND circuits 102 respond to the start signal from latch 76 to indicate to copy counter 72A for display on a panel 52 contents of CCM plus the count of counter 72A. In this way the operator sees copies 41–45 being produced during the second group of collated sets. Alternatively, subtractive accumulator 112 may supply signals to panel 52 for indicating the number of sets yet to be produced.

In the above-described manner all counting and figuring is automatically performed by the copy production machine adding to operator convenience. By limiting the number of separator sheets to the number of copies in a next succeeding run or runs, collator efficiency is enhanced. That is, if the number of copies produced in the preceding run were used to indicate the number of separator sheets, then twenty separator sheets will be used. This means the traveling vane in the collator would have to travel the entire height of each collator bin. On the other hand, if less than collator capacity is to be produced, for example, five, then only five bins will be traversed. On the next succeeding run, the traveling vane is already at the fifth bin. It then can start collating upwardly without having any wasted travel to the desired collating position. Furthermore, the number of separator sheets being keyed to the succeeding run will indicate to the operator the number of sets that will be produced in the next succeeding copy production runs.

Copy production machine 10 may have several original document sources which can be automatically, semiautomatically, or manually processed for copy production. In the automatic and semiautomatic feed, the "go" signal on line 141 (FIG. 3) activates the feeding mechanism (not shown) for moving the original to a copy-making position which then institutes the next succeeding copy reproduction run. CPP 13, in receiving the "go" signal on line 141, begins its next run by preparing the FIG. 3 illustrated detection circuit for detecting the end of that next succeeding run. In this regard, an active signal from CPP 13 travels over line 142 resetting counter 130, copy tracking circuits 122, and latches 128 and 140.

Copy tracking circuits 122 may include an up/down counter in a manner similar to paper path counter 130. It is preferred that the methodology of last copy detection, rather than being carried out by the illustrated circuits, be carried out by a microprogrammable processor as later described wherein the paper path counter 130 is a programmed up/down count field, copy tracking circuits 12 constitute a computer program, and the latches 128 and 140 are stages either in memory (local store) or special registers within a register group (not shown).

All of the above-described circuits show a relatively simple application of the present invention. The more productive and valuable aspects are best achieved in a copy production machine 10 by a programmable controller wherein all logic decisions are computer program determined rather than hardware logic circuit determined. Before describing the programmable controller embodiment of the present invention, a processor control system usable as a programmable controller for sequence control circuits 53 is first described. It is understood that the above-described circuits are replaced by a computer program as will become apparent.

Processor Control System

Figure 4:
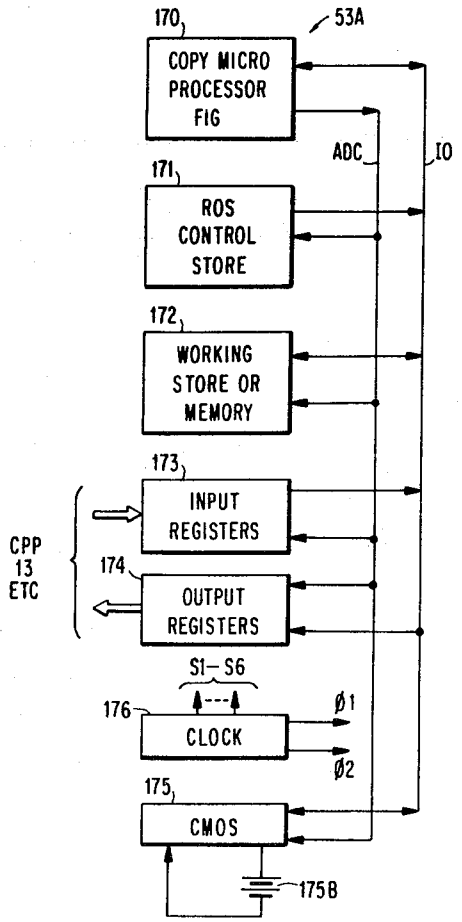
FIG. 4 is a block diagram of a control system employing a programmable processor usable in connection with the present invention.
Figure 6:
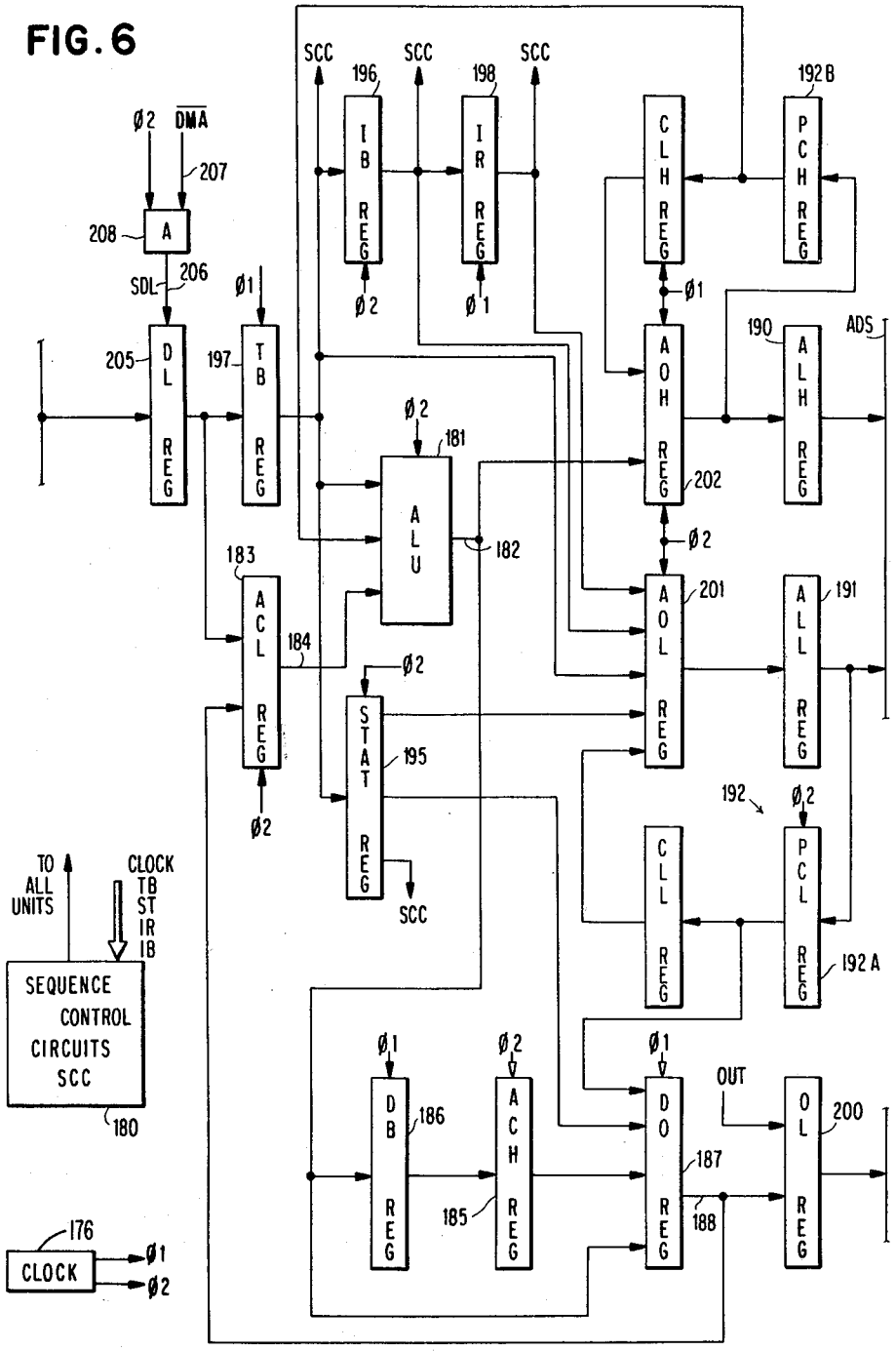
FIG. 6 is a diagram showing a programmable processor data flow usable in the FIG. 4 illustrated processor control system.

Sequence control circuits 53 preferably include a programmable computer control system as shown in FIG. 4.

The operational details and instruction repertoire of a processor suitable for practicing the present invention are described in detail in U.S. Pat. 4,086,658 from column 5, line 38 to column 22, line 11.

DETAILED DESCRIPTION OF THE PREFERRED EMBODIMENT

Figure 11:
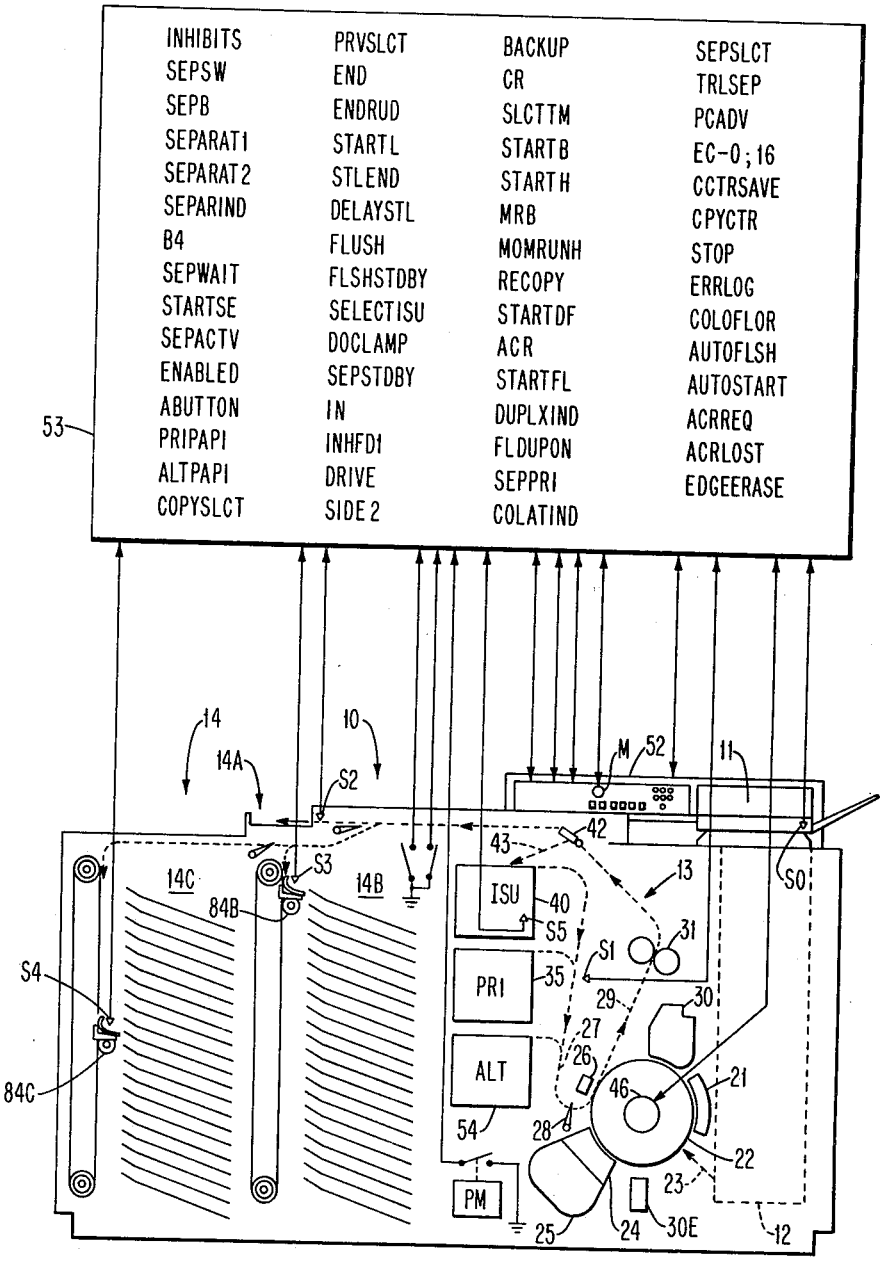
FIG. 11 is a diagram showing a preferred embodiment of the present invention.

FIG. 11 et seq. illustrate a microprocessor controlled embodiment of the invention. In FIG. 11, control 53 is shown as a box containing a plurality of indicators which are used, as will become apparent, in the program control. The program control operates in the computer system shown in FIGS. 4–10, inclusive. The tables in the description of the preferred embodiment contain code executable by the described processor to illustrate the invention. FIGS. 12–29 are flow charts to make it easier to follow the description.

In FIG. 11, it is seen that copy production machine 10 is constructed as shown in FIG. 1. In addition, sensing switches S2, S3, S4 are shown at exit positions of output portion 14. Such sensing switches indicate that a copy is leaving the copy production machine at its designated output port (termed a billing port) and is suitable to be billed or not to be billed, depending upon the status of copy production, i.e., whether copies are actually being produced or an auxiliary mode such as flush or separate runs are being performed. Switch S1 adjacent copy path 27 senses copy sheets entering CPP 13. It should be noted that FIG. 11 is diagrammatic in that the position of S1 and of alternate paper supply 54 appear not to coincide; however, the copy sheets selected from supply 54 actually proceed past S1 before reaching aligner gate 28. All of the status indicators listed in FIG. 11 are described in the ensuing discussion. A pluggable billing meter PM may be installed in machine 10. It has a switch which signals to control 53 the fact the PM meter is plugged in, allowing the machine to operate. If the PM meter is removed, machine 10 cannot operate.

Figure 12:
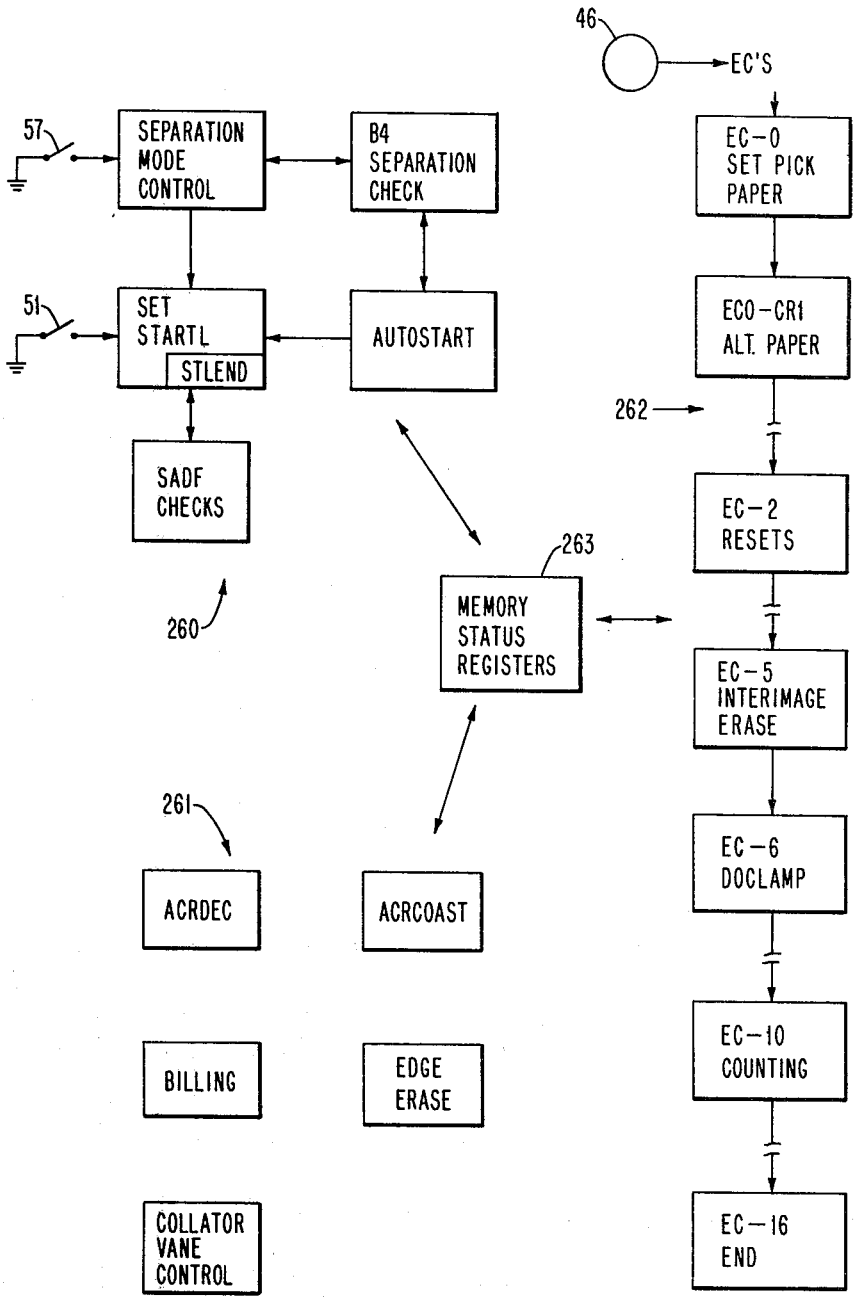
FIG. 12 is a diagram which illustrates program segment calls for implementing the present invention in a best mode.

FIG. 12 is a simplified diagrammatic showing of the various computer programs for the preferred embodiment. In general, the programs are divided into two general categories, asynchronous and synchronous. This division eliminates the need for a master control program or an executive program as is usually required in the data processing and machine controller arts. In contrast to that type of control, the program control of the present invention is slaved to the timing and operation of copy production machine 10 such that the electromechanical portions of copy production machine 10 synchronize the operation of program control 53. In particular, power line zero crossovers are detected by means not shown and are used to invoke the programs indicated generally by numerals 260 and 261, i.e., the asynchronous programs, that is, asynchronous to the copy production process. Even when copies are being actively produced, the asynchronous programs 260, 261 are executed on a power line frequency periodic basis for monitoring the operation of copy production machine 10 including operator control panel 52. It is to be understood that there are many more programs resident for the asynchronous programs, FIG. 12 being limited to those computer programs having a direct bearing on practicing the present invention.

The second set of programs is termed synchronous programs and are timed and instigated by timing signals from emitter wheel 46 of photoconductor drum 20. Emitter wheel 46 emits periodic pulses called emitter control pulses ECs 0–16 for each image area. The photoconductor drum 20 preferably has two image areas, hence there will be two sets of EC0–EC16 pulses for each drum 20 rotation. The computer receives and counts the ECs using software techniques. A fiducial pulse (not shown), also termed a "sync" pulse, defines the image areas on the photoconductor drum 20. A computer is programmed by programs not shown nor described to reset the EC count upon the receipt of each fiducial pulse. Then, for each image area being processed by CPP 13, the computer in control 53 responds to its own software counting to invoke one of the synchronous programs to be executed by the computer. For example, when EC0 is received, a plurality of programs are invoked because EC0 relates to a preparatory portion of each image cycle. Some of the EC0 programs are not shown for purposes of brevity. At EC2 certain resets are employed in connection with practicing the separation mode. At EC5 the inner image erase controls are illustrated whereas EC6 controls the document lamp. Then at EC10, certain counts are effected for controlling the copy production machine 10 using software architecture. Finally, the last EC, EC16, resets the separation mode upon the end of a separation mode run as well as performing other functions not pertinent to the practice of the present invention. Communication between the synchronous programs, the EC0–EC16, and the asynchronous programs 260, 261 are via the memory status registers or indicators listed in FIG. 11 in box 53 and designated in FIG. 12 as registers 263. That is, when a separate button 57 is closed, separate mode control enables control 53 to sense closure and to memorize the closure in a given location of the memory status registers 263. The computer also then invokes the B4 separation check program to ensure compatability of separation sheets with copy sheets. Closure of the start button 51 is sensed by the computer by executing set STARTL (STARTL means start latch program). In connection with starting copy production machine 10, SADF 11 is checked for an original document at the preentry station. Finally, if the copy production had been interrupted or the separation mode had been interrupted, the autostart program enables the computer to restart automatically as will become apparent.

The asynchronous programs 261 enable the computer to extend the capability of the collator 14B, 14C logically by allowing more than one collated set per collator bin. Furthermore, other functions are performed by the computer in response to these stored programs for maximizing the efficiency of copy production machine 10. All of these will become apparent from a continued reading of the specification.

In FIGS. 13–29, the flow chart step designation (reference numeral) corresponds to the "LOC" designation of the source code in the corresponding tables included in this description. The flow chart is first described and then the table included in the specification. For example, in FIG. 13 step 5468 corresponds to an instruction of Table I at LOC 5468.

Figures 13, 21:
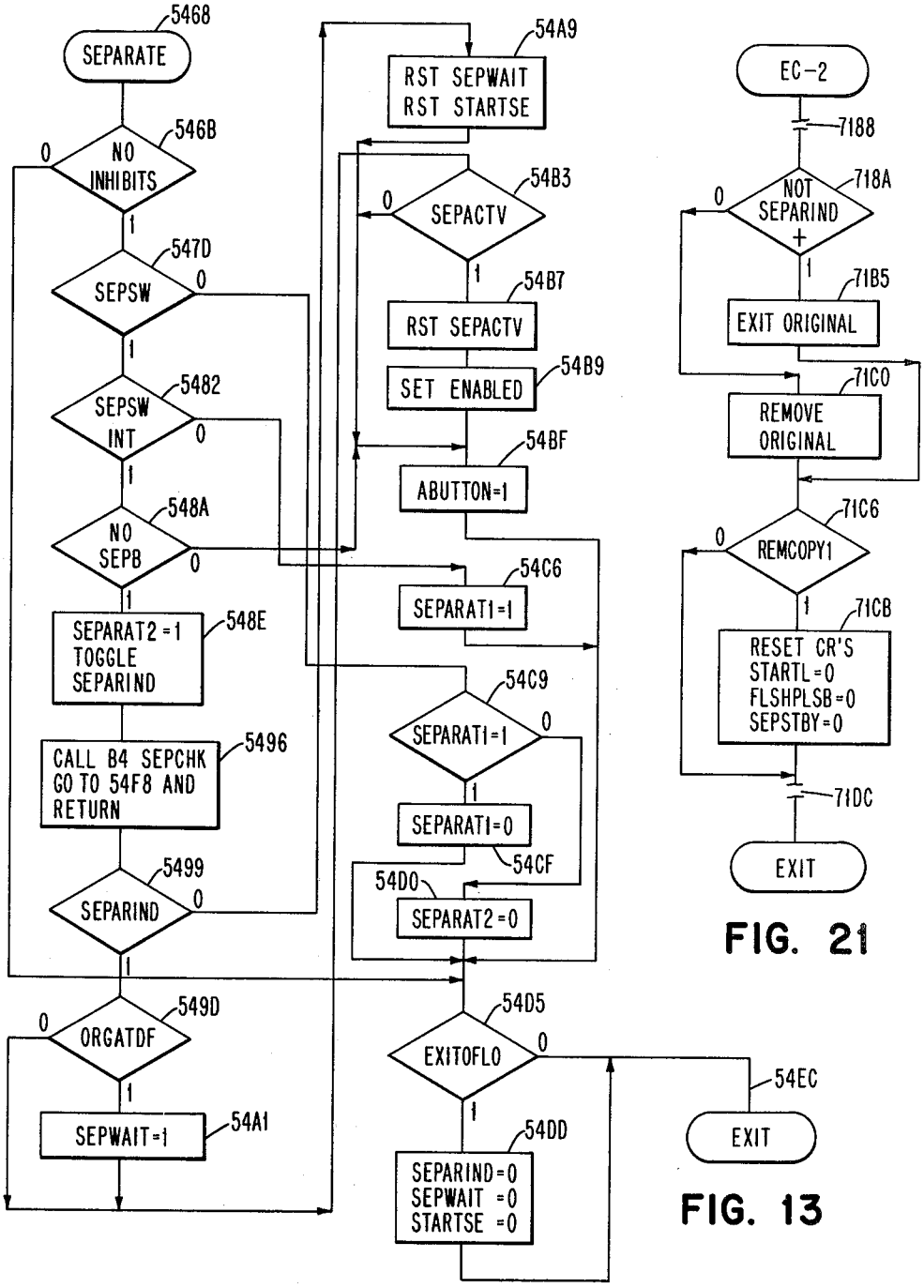

In FIG. 13, the separate mode controls are entered at 5468. First the computer checks for inhibits at 546B, such as check paper path (CPPIND) and the like. If any Table I listed inhibits are present, the separation mode should not be performed.

With no such inhibits, at 547D the computer checks whether the separation switch 57 (SEPSW) has been actuated. If so, the computer checks whether a switch closure integration (software type) indicates actuation is a true actuation or noise. Then at 548A the computer checks whether the separate switch or button 57 had been previously successfully integrated. If not, then at 548E separate indicator SEPARIND is toggled to its opposite signal state and SEPARAT2 flag is set to a 1. SEPARIND is one bit of memory 172 and is listed in FIG. 11. Then at 5496 the computer calls the B4 separation check code shown in FIG. 14 and later described. At 5499 the computer checks the separate indicator. If the separate indicator is off, i.e., the toggling of the separate switch deselected the separate indicator, then the computer at 54A9 resets the separate wait flag and resets the start separate flag STARTSE. If the separate indicator was on at 5499 then the computer checks at 549D whether an original is at the document feed (ORAGTDF). If there is an original at the document feed, then the separate run must wait until after the copy production run for such original document, i.e., one more copy run. The operator by putting originals in SADF 11 inhibits the separation mode until the end of a set to be collated or produced. As implemented, the choice is delay of one copy production run, no limitation thereto intended. In any event, an original at the document feed, the separate wait (SEPWAIT) flag or indicator may be set at 54A1. SEPWAIT inhibits the separation mode. From 54A1 the computer steps the program to 54B3 to determine whether a separation mode is now active (SEPACTV). If separation mode is active, then the computer resets SEPACTV at 54B7 and sets ENABLED at 54B9. The flag enabled in status registers 263 allows the computer to sense the operator parameter selection switches on control panel 52 and indicates all zeros in the numerical display indicating copies made/copies selected. Finally, at 54BF the computer senses whether any button was activated and sensed on panel 52. It should be noted that the computer branches from several points in the separate control program to 54BF. Next, the computer at 54D5 checks for exit overflow. Exit overflow means that the number of copies being made exceeds the capacity of collator 14B, 14C and excess copies are being directed to the exit tray 14A. In the preferred embodiment, this action occurs only when collate mode is selected after side 1 of a duplex job has occurred. Under other circumstances separation mode of this invention is employed. If there is no exit overflow, the computer exits the program at 54EC to execute the next asynchronous program in the line of executions.

In the event of exit overflow, the instruction at 54DD enables the computer to reset the separate indicator (no separation is required or desired), separate wait and STARTSE flags. The computer then exits at 54EC.

At step 546B, if there are inhibits then the instruction at 54D5 is executed and all of the above described intermediate instructions omitted. If the separation switch 57 is sensed as not being pushed at 547D then at 54C9 SEPARAT1 is set to a one. This flag indicates that the separate button had been previously pushed and is not now being pushed. If the SEPARAT1 is equal to zero this means that the separate switch has not recently been pushed. Therefore, at 54D0 SEPART2 is equal to zero, i.e., separation mode will not be honored. On the other hand, if SEPARAT1 is equal to a one at 54C9, SEPARAT1 is reset at 54CF with SEPARAT2 equal to a one allowed to stand for enabling separation mode. At 5482 if the separation switch integration is still a zero, then at 54C6 the above-mentioned SEPARAT1 is set to one.

With regard to the above description, it should be noted that the program was executed at every power line crossover. Therefore, in setting up the separation mode in the computerized embodiment of the invention, asynchronous programs will be executed many times during each set-up. Each pass through the program by the computer will sense the immediate status of the machine for enabling the machine to set up in the separation mode as originally described for the hardware representation of machine functions. The source code for the separate mode control program is set forth below in Table I. LOC means memory location, OBJ means object code, OP1 is operand 1, OP2 is operand 2. The abbreviations in the source statements are as used in the flow charts or elsewhere. The symbols are those symbols used for logic except a logical "not" is "¬". The "PSBs" are program status bytes not pertinent to an understanding of the invention SEP indicates separation mode checkpoint.

TABLE I - SEPARATION MODE CONTROL

```
LOC   OBJ      OP1  OP2     SOURCE STATEMENT

                              1. CALL  CHKINH CHECK FOR (¬CPPIND & ¬CKCOLTRI & ¬REMCOPYI &
                                       ¬PLSTNDBY)  --  Check Inhibits
5468 31583A 0001  3A58           BAL       R1,CHKORG
                              1. IF  (NO INHIBITS FROM ABOVE) & ¬ADDPAPER & ¬ACRREQ &
                                     ¬(CEMODE>5)
546B 3CD3   54D3                 BNZ       SEP06
                                 TPB       PSB07,ADDPAPER
546D A647   0047
546F 94     0004
5470 3CD3   54D3                 BNZ       SEP06      *GO IF ACTIVE
                                 TPB       PSB01,ACRREQ
5472 A641   0041
5474 91     0001
5475 3CD3   54D3                 BNZ       SEP06      *GO IF SET
5477 A662   0062                 LB        CEMODE     GET CE MODE BYTE
5479 A805   0005                 CI        5
547B 3ED3   54D3                 BH        SEP06      *GO IF GREATER THAN 5
                              1. THEN
                              2. . IF  SEPARATE (SEPARATION DEPRESSED)
                                 RIN       CSB05      GET STATUS
547D A6C4   00C4
547F 97     07                   TP        SEPARATE   TEST IF BEING PUSHED
5480 3DC9   54C9                 BZ        SEP03      *GO IF NO
                              2. . THEN
                              3. . . IF  SEPARAT1 SEPARATION BEING INTEGRATED
```

```
LOC  OBJ     OP1  OP2      SOURCE STATEMENT

5482 A9A0    00A0                GI        INTOFF
5484 A641    0041                LB        PSB01      GET STATUS
5486 AF80    0007                TS        SEPARAT1   TEST IF SET
5488 3DC6    54C6                BZ        SEP02      *GO IF NO
                            3. . . THEN
                            4. . . . IF  ¬SEPARAT2 SEPARATION NOT HONORED
548A AF40    0006                TS        SEPARAT2
548C 3CBF    54BF                BNZ       SEP01A     *GO IF YES  -- Separate Pushed
                            4. . . . THEN
                            5. . . . . SEPARAT2=1
548E A141    0041                STB       PSB01      UPDATE
                            5. . . . . TOGGLE SEPIND  --  Memorize
5490 A677    0077                LB        PCB06      GET STATUS
5492 AD04    0004                XI        P1(SEPARIND)
5494 A177    0077                STB       PCB06      UPDATE
                            5. . . . . CALL  B4SEPCHK GO CHECK B4 SEPARATION
5496 33F854  0003 54F8           BAL       R3,B4SEPCHK
                            5. . . . . IF  SEPARIND
                                TPB       PCB06,SEPARIND
5499 A677    0077
549B 92      0002
549C 49      5489                JZ        SEP01      *GO IF NO
                            5. . . . . THEN
                            6. . . . . . IF ORGATDF
                                RIN       CSB09      GET STATUS
549D A6D0    00D0
549F 94      0004                TP        ORGATDF    TEST IF DOC AT SADF
54A0 49      54A9                JZ        SEP01      *GO IF NO
                            6. . . . . . THEN
                            7. . . . . . . SEPWAIT=1
                                TSB       PCB01,SEPWAIT
54A1 A641    0041    --  Separate waits for
54A3 AF20    0005        next run.
54A5 A141    0041
                            6. . . . . . ENDIF
54A7 2CBF    54BF                B         SEP01A     *GO
                            5. . . . . ELSE
             54A9       SEP01    DC        *
                            6. . . . . . RESET SEPWAIT,STARTSE
                                TRB       PSB01,SEPWAIT
54A9 A641    0041
54AB B5      0005
54AC A141    0041
                                TRB       PSB07,STARTSE
54AE A647    0047
54B0 B7      0007
54B1 A147    0047
                            6. . . . . . IF  SEPACTV
54B3 A647    0047                LB        PSB07
54B5 B3      0003                TR        SEPACTV
54B6 4F      54BF                JZ        SEP01A
                            6. . . . . . THEN
                            7. . . . . . . RESET SEPACTV
54B7 A147    0047                STB       PSB07
                            7. . . . . . . SET ENABLED
                                TSB       PSB42,ENABLED
54B9 A66A    006A
54BB AF80    0007
54BD A16A    006A
                            6. . . . . . ENDIF
                            5. . . . . ENDIF
                            4. . . . ENDIF
             54BF       SEP01A   DC        *
                            4. . . . ABUTTON=1
                                TSB       PSB28,ABUTTON
54BF A65C    005C
54C1 AF02    0001
54C3 A15C    005C
54C5 03      54D3                J         SEP06
                            3. . . ELSE
             54C6       SEP02    DC        *
                            4. . . . SEPARAT1=1
54C6 A141    0041                STB       PSB01      UPDATE
                            3. . . ENDIF
```

```
LOC  OBJ     OP1   OP2      SOURCE STATEMENT

54C8 03      54D3                J          SEP06
                             2. . ELSE
             54C9       SEP03    DC         *
                          DEINTEGRATION OF SEPARATION SWITCH
                             3. . . IF  SEPARAT1
54C9 A9A0    00A0                GI         INTOFF
54CB A641    0041                LB         PSB01      GET STATUS
54CD B7      0007                TR         SEPARAT1   TEST IF SET
54CE 40      54D0                JZ         SEP04      *GO IF NO
                             3. . . THEN
                             4. . . . SEPARAT1=0
54CF 01      54D1                J          SEP05
                             3. . . ELSE
             54D0       SEP04    DC         *
                             4. . . . SEPARAT2=0
54D0 B6      0006                TR         SEPARAT2
                             3. . . ENDIF
             54D1       SEP05    DC         *
54D1 A141    0041                STB        PSB01      UPDATE
                             2. . ENDIF
                             1. ENDIF
             54D3       SEP06    DC         *
54D3 A920    0020                GI         INTON      UNMASK INTERRUPTS
                             1. IF  EXITOFLO
                                 SRG        COLRG
54D5 A9D0    00D0
                                 TPB        CPSB05,EXITOFLO
54D7 A616    0016
54D9 95      0005
54DA A989    0089                GI         INTOFFCG+BASERG
54DC 4C      54BC                JZ         SEP10
                             1. THEN
                             2. . SEPARIND=0
                                 TRB        PCB06,SEPARIND
54DD A677    0077
54DF B2      0002
54E0 A177    0077
                             2. . SEPWAIT,STARTSE
                                 TRB        PSB01,SEPWAIT
54E2 A641    0041
54E4 B5      0005
54E5 A141    0041
                                 TRB        PSB07,STARTSE
54E7 A647    0047
54E9 B7      0007
54EA A147    0047
                             1. ENDIF
             54E2                DC         *
54EC A920    0020                GI         INTON
                             ENDBEGIN SEPARATE
```

Figure 14:
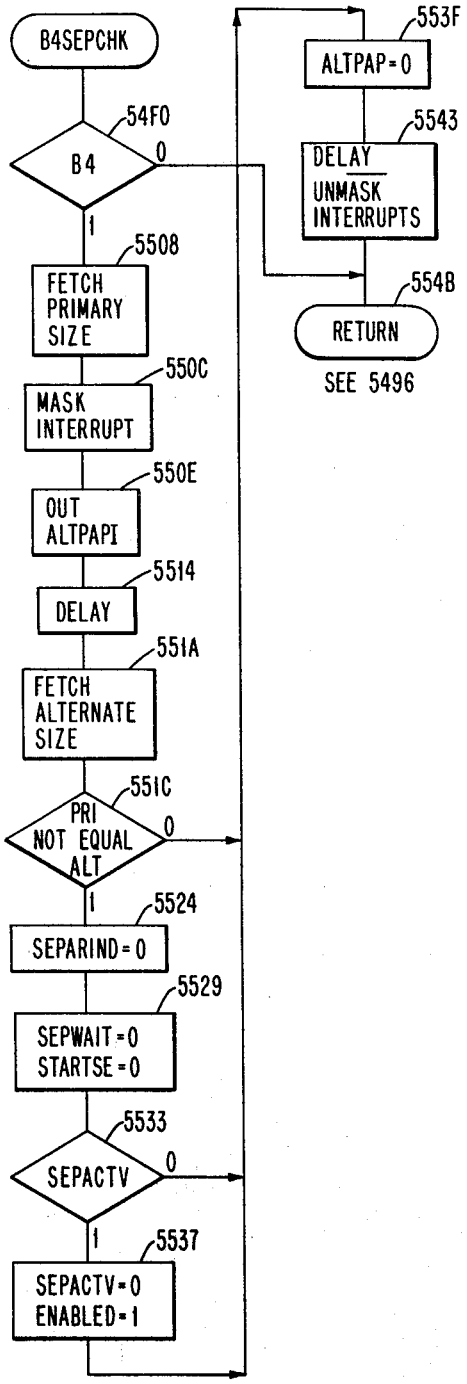
FIG. 14 is a flow chart showing checking paper sizes for copy production and separation.

Next, in FIG. 14, the computer execution of a program for checking proper separation sheet size is described. At 54F8 the computer checks whether the copy production machine is designed to handle B4 sizes. If not, there is no need to inhibit any size of separation sheet and a computer exits the program at 554B, returning to the FIG. 13 illustrated program.

When checking for proper sheet sizes for certain nations, the computer at 5508 fetches the primary size, i.e., the size of copy sheets on which images are being produced. During this checking interrupts are masked beginning at 550C. At 550E the second paper supply or alternate paper bin 54 is selected. The delay at 5514 allows the selection to be completed. At 551A the alternate size, i.e., the size of copy sheets in the second paper supply 54, is determined. If the size of copy sheets indicated for the primary bin 35 is not the same as that indicated for second paper supply 54, then the separation indicator is reset at 5524, i.e., separation mode will not be allowed. Then at 5529 SEPWAIT and STARTSE are also reset. Then at 5533 SEPACTV is checked. If it is active it is reset at 5537 and ENABLED is activated. Finally, at 553F alternate paper is reset with a deselection delay at 5543 and the interrupts being unmasked. The computer then returns to FIG. 13 illustrated program as a preparatory step for executing a separation mode run.

TABLE II - PAPER SIZE CHECK

```
LOC  OBJ     OP1  OP2     SOURCE STATEMENT

             54F8                ORG        B4SEPCHK
                            BEGIN  B4SEPCHK
                           1. TEXT
                               THIS SUBROUTINE GUARANTEES THAT THE LARGEST, SMALLEST
                               AND INTERMEDIATE B4 PAPER SIZES WILL NOT BE MIXED BY
                               SEPARATION MODE ON B4 MACHINES WHILE COLLATE IS SELECTED.
                               REGISTERS USED:
                                    R0 LOW
                                    R3 LINKAGE
                                    R8 ALL
                           1. ENDTEXT
                           1. IF  (B4 &COLATIND &SEPARIND &¬ALTPAPI)
54F8 A6A1    01A1                LBL        COUNTRY
54FA 92      0002                TP         B4
54FB 46      5506                JZ         SEPCHK10
54FC A677    0077                LB         PCB06
54FE 91      0001                TP         COLATIND
54FF 46      5506                JZ         SEPCHK10
5500 92      0002                TP         SEPARIND
5501 46      5506                JZ         SEPCHK10
                                 TPB        PCB05,ALTPAPI
5502 A676    0076
5504 91      0001
5505 48      5508                JZ         SEPCHK20
             5506       SEPCHK10DC           *
5506 3C4B    554B                B          SEPCHK45
                           1. THEN
             5508       SEPCHK20 DC          *
                           2. . INPUT  PRIMARY BIN SIZE AND SAVE
                                RIN        CSB13
5508 A6D4    00D4
550A A120    0120                STBL       BASER0LO
                           2. . MASK INTERRUPTS
550C A9A0    00A0                GI         INTOFF
                           2. . OUTPUT  ALTPAPI=1
550E A676    0076                LB         PCB05
5510 AF02    0001                TS         ALTPAPI
                                 ROUT       CCB05
5512 A1C4    00C4
                           2. . DELAY 115 MICROSECS
                                ZLI        4
5514 25
5515 AE04    0004
5517 88      0008                STR        R8
             5518       SEPCHK25 DC          *
5518 F8      0008                LRD        R8
5519 78      5518                JNZ        SEPCHK25
                           2. . INPUT  ALTERNATE BIN SIZE
                                RIN        CSB13
551A A6D4    00D4
                           2. . IF  (ALTERNATE CONTAINS B5 OR PRIMARY SELPAPE ¬= ALTERNA
                                    SELPAPE)
551C AB1E    001E                NI         P(SELPAPE,SELPAPD,SELPAPC,SELPAPB)
551E 44      5524                JZ         SEPCHK30  * GO IF B5
551F A520    0120                XBL        BASER0LO
5521 94      0004                TP         SELPAPE
5522 3D3F    553F                BZ         SEPCHK35  * GO IF THEY AGREE
                           2. . THEN
             5524       SEPCHK30 DC          *
                           3. . . SEPARIND=0
                                TRB        PCB06,SEPARIND
5524 A677    0077
5526 B2      0002
5527 A177    0077
                           3. . . SEPWAIT,STARTSE= 0
                                TRB        PSB01,SEPWAIT
5529 A641    0041
552B B5      0005
552C A141    0041
                                TRB        PSB07,STARTSE
```

```
LOC  OBJ    OP1  OP2      SOURCE STATEMENT

552E A647   0047
5530 B7     0007
5531 A147   0047
                                3. . . IF  SEPACTV
5533 A647   0047                    LB        PSB07
5535 B3     0003                    TR        SEPACTV
5536 4F     553F                    JZ        SEPCHK35
                                3. . . THEN
                                4. . . . RESET SEPACTV
5537 A147   0047                    STB       PSB07
                                4. . . . SET ENABLED
                                    TSB       PSB42,ENABLED
5539 A66A   006A
553B AF80   0007
553D A16A   006A
                                3. . . ENDIF
                                2. . ENDIF
            553F          SEPCHK35 DC         *
                                2. . OUTPUT   ALTPAPI=0
553F A676   0076                    LB        PCB05
                                    ROUT      CCB05
5541 A1C4   00C4
                                2. . DELAY 115 MICROSECS
                                    ZLI       4
5543 25
5544 AE04   0004
5546 88     0008                    STR       R8
            5547          SEPCHK40 DC         *
5547 F8     0008                    LRD       R8
5548 77     5547                    JNZ       SEPCHK40
                                2. . UNMASK INTERRUPTS
5549 A920   0020                    GI        INTON
                                1. ENDIF
            554B          SEPCHK45 DC         *
                                1. RETURN TO CALLER
554B 23     0003                    RTN       R3
                                ENDBEGIN B4SEPCHK
```

Figures 15, 18:
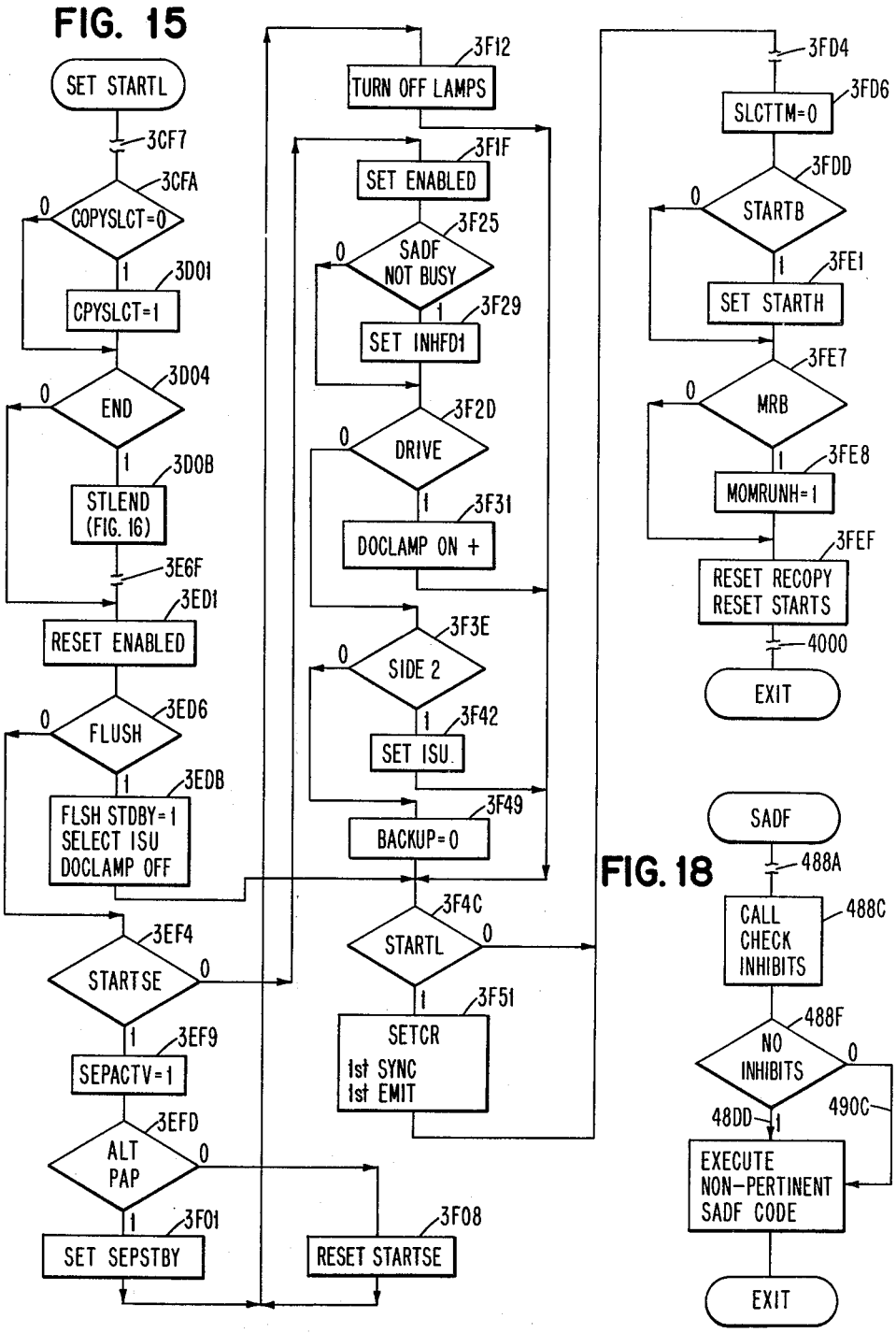
FIGS. 15, 16 and 18 are flow charts showing certain start procedures related to separation mode.
Figure 16:
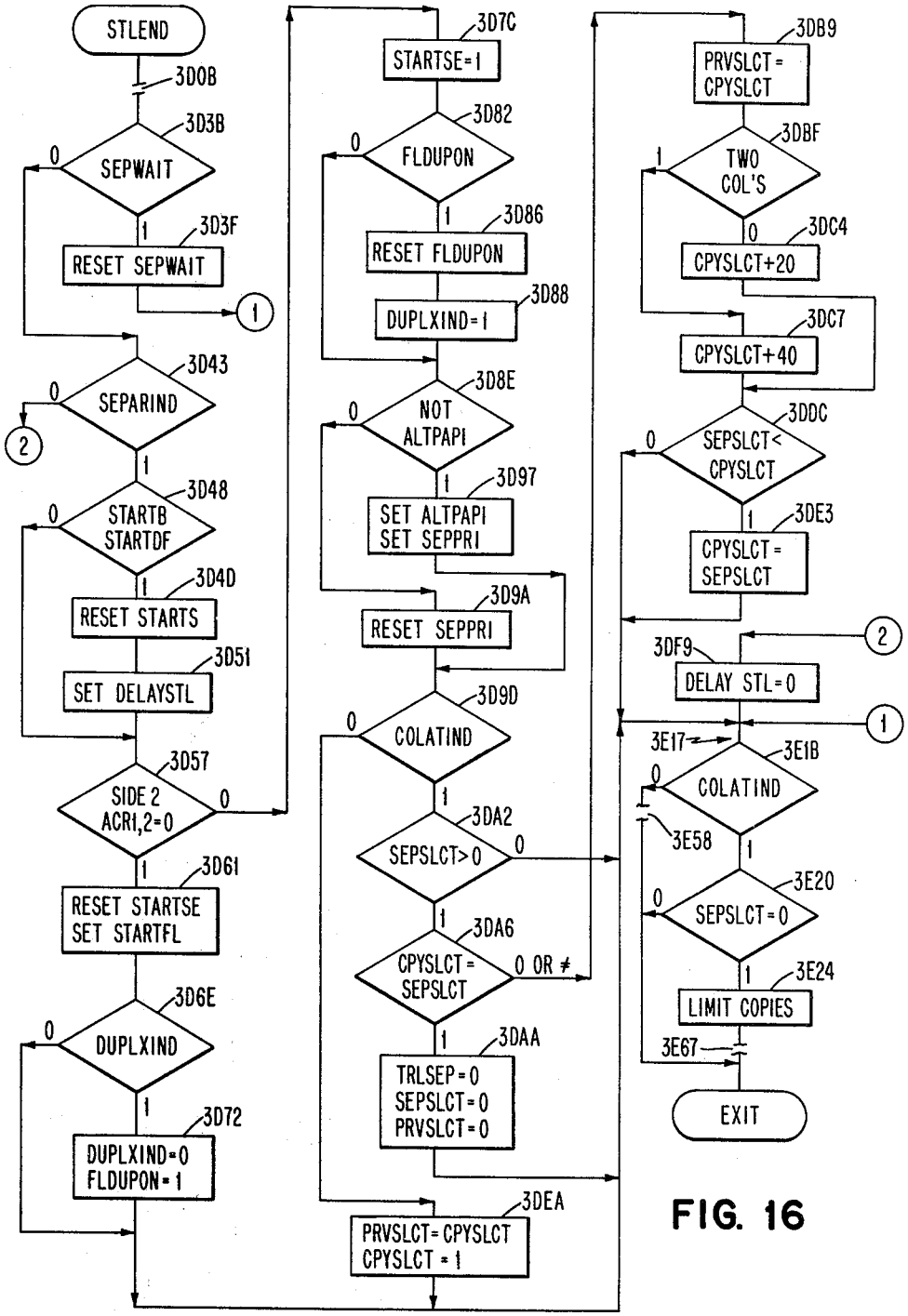

The computer setting start latch (STARTL) is flow charted in FIG. 15 with the source code being shown in Table III. The program is invoked in response to the actuation of the start button on panel 52 or the insertion of an original document into SADF 11. It is to be understood that before a start latch in a copy production machine is activated, several things must be performed and achieved that are not pertinent to the separation mode. For example, nonpertinent code is included at diverse memory locations, such as at 3CF7, 3E6F, 3FD4 and 4000. As to the pertinent code, the computer checks at 3CFA whether the copy selection is equal to zero. If it is zero, then the minimum run for copy production should be one; therefore, the computer sets the copy select to one at 3D01. The end flag, (signal stored in store 172), i.e., signifying the end of a copy producing run, is checked at 3D04. This indicates whether a normal end was achieved by the previous run. If so, the FIG. 16 illustrated program STLEND identified as 3D0B is executed as later described.

Before permitting copy production to ensue, the computer resets the enable flag at 3ED1. The enable flag being reset tells the computer not to honor any selections from panel 52, the sole exception being the stop button for stopping copy production machine 10. Then the computer checks for previous status at 3ED6, i.e., whether the flush flag is on. If the flush flag is on this means copies in ISU 40 must be transported to the output portion 14 without receiving any images. If this flag is active then the computer at 3EDB sets the flush standby flag, selects the ISU as the source of copy sheets for being transported to output portion 14, and turns the document lamp off. The document lamp (not shown) scans the original document on the platen (not shown) of SADF 11 for transferring an optical image to photoconductor drum 20. After this step, the computer proceeds to sense at 3F4C whether the start latch is active. If the start latch is already set, then at 3F51 the computer sets the copy register CR (not shown) within the working memory 172 and looks for a first sync and a first emit pulse from emitter wheel 46. These pulses are timing pulses serving control 53 to drum 20 rotation. The status of the CR register is not pertinent to the operation of the separation mode but is important in copy production. Since machine state registers are so well known in copy production machines, further discussion is dispensed with.

After executing the above steps and nonpertinent code at 3FD4, the computer sets the button select time indicator SLCTTM to zero, i.e., the time is reset such that a button depression timeout can be initiated. Then at 3FDD the start button is sensed whether it is active. If so, the STARTH flag in memory 172 is set at 3FE1. Then the momentary run button MRB is sensed at 3FE7 (MRB is not shown in the drawing). If MRB is active then the flag MOMRUNH is set indicating that the momentary run bottom has been actuated. Then at 3FEF the computer resets all the recopy lights (not shown) which indicate to the operator the number of documents to be recopied for error recovery and then resets the latch STARTS in memory 172. The various start latches are "program flags" for synchronizing the startup procedure and each occupies one bit position (latch) in a register within memory 172. Then the computer can exit the program via the nonpertinent code at 4000.

At to the instruction at 3ED6, if no flush operation is to be performed, then the instruction at 3EF4 determines whether a separation mode is to be started (STARTSE). If not, the instruction 3F1F sets the enable flag for allowing the operator to insert operator parameters via panel 52. Then at 3F25 the computer checks whether SADF 11 is busy. If it is not busy then the flag INHFD1 is set at 3F29. INHFD1 indicates that an operator has lifted the lid (not shown) of SADF 11 and can manually place an original to be copied on the platen (not shown) of SADF 11, i.e., the SADF 11 is not used for transporting an original document in the ensuing copy production run. Otherwise, the SADF is being used. In either case, the status of the main drive motor (not shown) for machine 10 is sensed at 3F2D. If the motor has been turned on, then the document lamp (not shown) is turned on at 3F31 for scanning the original document which is in copying position within SADF 11, whether manually inserted or semiautomatically inserted.

If the drive is still off at 3F2D, then the computer checks for a side 2 indicator at 3F3E. If the side 2 is to be produced, i.e., ISU 40 is to be the source of the copy sheets for duplex copy production, then the computer at 3F42 selects ISU 40 as a source of copy sheets. If it is not side 2, then is must be side 1. The copies to be produced in an ensuing copy production run will either be the first portion of a simplex run or be directed to the interim storage unit 40 as partially completed duplex copies. In either event, the backup register of memory 172 is reset to all zeros at 3F49 for indicating that the original document in SADF 11 to be scanned by the document lamp turned on at 3F31 is the first image in a possible series of images being copied. From 3F49 the computer executes the code beginning at 3F4C as previously described.

When separation mode flag indicates a separation run is to be performed, at 3EF9 the computer sets SEPACTV to "1" for indicating separation mode is active. The computer then checks at 3EFD whether the alternate paper supply 54 has been selected. If it has already been selected, then separation standby flag SEPSDBY is set at 3FO1. On the other hand, if the alternate paper has not yet been selected, STARTSE is reset at 3FO8 requiring the alternate paper supply 54 to be selected before the separation mode can ensue. At 3Fl2 the computer turns off the document lamp (not shown) since no copy images are to be transferred. Then the computer finally reaches 3F4C in the program as above described.

All of the above program execution is shown below in Table III.

TABLE III - SET START LATCH

```
LOC  OBJ     OP1  OP2        SOURCE STATEMENT

                                -- NONPERTINENT CODE --

                                2. . IF COPY SELECT =0
3CFA 24                             CLA
CFB  A009    0009                   CB        CPYSLLO
3CFD 64      3D)4                   JNZ       STAR025
3CFE A019    0019                   CB        CPYSLHI
3D00 64      3D04                   JNZ       STAR025
                                2. . THEN
                                3. . . SET COPY SELECT =1
3D01 2E                             A1
3D02 A109    0009                   STB       CPYSLLO
                                2. . ENDIF
                           STAR025  EQU       *
                                2. . IF  END (PREVIOUS RUN COMPLETED NORMALLY)
3D04 A643    0043                   LB        PSB03
3D06 B7      0007                   TR        END
3D07 6B      3D0B                   JNZ       STAR031X
3D08 30D13E 3ED1 0000               BU        STAR031,R0
                                2. . THEN
                           STAR031X EQU       *
                                3. . . PROCESS STEND PERFORMS CODE REQUIRED WHEN STARTL IS
                                                SET & END IS ON

                                -- SEE TABLE XX --

                           STAR031  EQU       *

                                2. . RESET ENABLED
                                     TRB       PSB42,ENABLED
3ED1 A66A    006A
3ED3 B7      0007
3ED4 A16A    006A
                                2. . IF  FLUSH
                                     TPB       PSB07,FLUSH
3ED6 A647    0047
3ED8 91      0001
3ED9 3DF4    3EF4                   BZ        STAR034
                                2. . THEN
```

```
LOC  OBJ    OP1  OP2        SOURCE STATEMENT

                              3. . . SET FLUSH PLEASE STANDBY
                                  TSB        PSB19,FLSHPLSB
3EDB A653   0053
3EDD AF04   0002
3EDF A153   0053
                              3. . . PICK DUPLEX TRUCK
                                  TSB        PCB02,DPLXTRCK
3EE1 A673   0073
3EE3 AF04   0002
3EE5 A173   0073
                              3. . . TURN OFF DOCUMENT LAMP
                                  TRB        PCB12,DOCLAMP
3EE7 A67C   007C
3EE9 B4     0004
3EEA A17C   007C
                              3. . . TURN OFF ALL EDGE ERASE LAMPS (ERS0, ERS1  ERS2, ERS3,
                                         B4ERS3, B4ERSR1, B4ERSR2)
                                  TRMB       PCB01,P(ERS0,ERS1,ERS2,ERS3,B4ERS3,BR34SR1,
                                             B4ERSR2)
3EEC A672   0072
3EEE AB01   0001
3EF0 A712   0072
3EF2 244C   3F4C                  B          STARC00
                              2. . ELSE
                         STAR034  EQU        *
                              3. . . IF  STARTSE
                                  TPB        PSB07,STARTSE
3EF4 A647   0047
3EF6 97     0007
3EF7 351F   3F1F                  BZ         STAR034A
                              3. . . THEN
                              4. . . . SET SEPACTV
3EF9 AF08   0003                  TS         SEPACTV
3EFB A147   0047                  STB        PSB07
                              4. . . . IF  PAPER PRESENT IN ALTERNATE BIN (CHECK PAPER
                                             PRESENT SW DIRECTLY)
                                  RIN        CSB04
3EFD A6C3   00C3
3EFF 97     0007                  TP         ALTPRES
3F00 48     3F08                  JZ         STARI01
                              4. . . . THEN
                              5. . . . . SET SEPSTBY
                                  TSB        PLSTNDBY,SEPSTBY
3F01 A653   0053
3F03 AF20   0005
3F05 A153   0053
3F07 02     3F12                  J          STARI02
                              4. . . . ELSE
                         STARI01  EQU        *
                              5. . . . . RESET STARTSE, STARTL
                                  TRB        PSB22,STARTL
3F08 A656   0056
3F0A B6     0006
3F0B A156   0056
                                  TRB        PSB07,STARTSE
3F0D A647   0047
3F0F B7     0007
3F10 A147   0047
                              4. . . . ENDIF
                        STARTI02  EQU        *
                              4. . . . TURN OFF DOCUMENT LAMP
                                  TRB        PCB12,DOCLAMP
3F12 A67C   007C
3F14 B4     0004
3F15 A17C   007C
                              4. . . . TURN OFF ALL EDGE ERASE LAMPS (ERS0, ERS1, ERS2, ERS3,
                                         B4ERS3, B4ERSR1, B4ERSR2)
                                  TRMB       PCB01,P(ERS1,ERS2,ERS3,B4ERS3,B4ERSR1,B4ERSR2)
3F17 A672   0072
3F19 AB01   0001
3F1B A172   0072
3F1D 2C4C   3F4C                  B          STARC00
                              3. . . ELSE
                        STAR034A EQU        *
```

```
LOC  OBJ    OP1  OP2        SOURCE STATEMENT

                             4. . . . SET ENABLED
                                 TSB        PSB42,ENABLED
3F1F A66A   006A
3F21 AF80   0007
3F23 A16A   006A

                             4. . . . IF  .SADFBUSY
                                 TPB        PSB31,SADFBUSY
3F25 A65F   005F
3F27 93     0003
3F28 6D     3F2D                 JNZ        STAR034B
                             4. . . . THEN
                             5. . . . . SET INHFD1
3F29 AF20   0005                 TS         INHFD1
3F2B A15F   005F                 STB        PSB31
                             4. . . . ENDIF
                        STAR034B EQU        *
                             4. . . . IF  DRIVE
                                 TPB        PSB21,DRIVE
3F2D A655   0055
3F2F 90     0000
3F30 4E     3F3E                 JZ         STAR049
                             4. . . . THEN
                             5. . . . . OUTPUT  - TURN ON DOCUMENT LAMP
                                 TSB        PCB12,DOCLAMP
3F31 A67C   007C
3F33 AF10   0004
3F35 A17C   007C

                             -- NONPERTINENT INSTRUCTION --

3F37 A66F   006F
3F39 AF10   0004
3F3B A16F   006F
3F3D 0C     3F4C
                             4. . . . ELSE
                        STAR049  EQU        *
                             5. . . . . IF  SIDE-2
                                 TPB        PSB20,DPXSIDE2
3F3E A654   0054
3F40 95     0005
3F41 49     3F49                 JZ         STAR032A
                             5. . . . . THEN
                             6. . . . . . PICK DUPLEX TRUCK
                                 TSB        PCB02,DPLXTRCK
3F42 A673   0073
3F44 AF04   0002
3F46 A173   0073
3F48 0C     3F4C                 J          STAR032B
                             5. . . . . ELSE
                        STAR032A EQU        *
                             6. . . . . . BACKUP=0
3F49 25                          CLA
3F4A A16C   006C                 STB        BACKUP
                             5. . . . . ENDIF
                        STAR032B EQU        *
                             4. . . . ENDIF
                        STAR032  EQU        *
                             3. . . ENDIF
                             2. . ENDIF
                        STARC00  EQU        *
                             1. ENDIF
                        STAR033  EQU        *
                             1. IF  STARTL
                                 TPB        PSB22,STARTL
3F4C A656   0056
3F4E 96     0006
3F4F 3DD4   3FD4                 BZ         STARI00
                             1. THEN
                             2. . PROCESS   SETCR SETS APPROPRIATE CR BIT& 1ST SYNC &
                                              1ST EMIT
```

```
LOC  OBJ    OP1  OP2        SOURCE STATEMENT

                              -- NONPERTINENT CODE --

                              1. SLCTTM=0 -(PREVENTS NUMERIC SELECTION); NEWSLCT=1 -(NEXT
                                          NUMERIC BUTTON IS 1ST)
3FD6 A66A   006A                 LB        PSB42
3FD8 B1     0001                 TR        SLCTTM
3FD9 AF10   0004                 TS        NEWSLCT
3FDB A16A   006A                 STB       PSB42
                              1. IF  STARTB
                                 TPB       PSB22,STARTB
3FDD A656   0056
3FDF 95     0005
3FE0 47     3FE7                 JZ        STAR034C
                              1. THEN
                              2. . SETSTARTH (START BUTTON HONORED)
                                 TSB       PSB23,STARTH
3FE1 A657   0057
3FE3 AF10   0004
3FE5 A157   0057
                              1. ENDIF
                         STAR034C EQU       *
                              1. IF  MOMRUNB
                                 TPB       PSB21,MOMRUNB
3FE7 A655   0055
3FE9 95     0005
3FEA 4F     3FEF                 JZ        STAR024
                              1. THEN
                              2. . MOMRUNH =1 (REQUIRES MOMRUN BUTTON TO BE RELEASED BEFORE
                                              STARTL CAN BE SET AGAIN)
3FEB AF08   0003                 TS        MOMRUNH
3FED A155   0055                 STB       PSB21
                              1. ENDIF
                         STAR024  EQU       *
                              1. RESET ALL RECOPY LIGHTS
                                 TRMB      PCB13,P(RECOPY1,RECOPY2,RECOPY3)
3FEF A67D   007D
3FF1 AB7C   007C
3FF3 A17D   007D
                              1. RESET STLREQ, STARTDF, STARTFL, STARTPC, STARTSE
                                 TRMB      PSB22,P(STLREQ,STARTDF,STARTFL,STARTPC)
3FF3 A656   0056
3FF7 AB74   0074
3FF9 A156   0056
                                 TRB       PSB07,STARTSE
3FFB A647   0047
3FFD B7     0007
                              -- NONPERTINENT CODE --
```

FIG. 16 flowcharts the start-up from normal end of a prior copy production run. As indicated at 3DOB, programming not pertinent to the function of the separation mode is executed in starting up from a normal end. The the separate wait flag is checked at 3D3B. If it is active, it is reset at 3D3F, i.e., the computer now is conditioning copy production machine 10 to begin the separation mode. The SEPWAIT flag set at this point indicates a trailing separator; that is, copies were being produced when the separate button 57 was actuated. From 3D3F the computer proceeds to instruction 3E1B for checking whether the collate mode is active. If not, some nonpertinent code is executed at 3E58 and the program exited. If collate had been selected, the computer checks at 3E20 whether the selection for the number of separation sheets is zero. If it is zero the program is exited. If not, then at 3E24 the number of separator sheets is limited to the selection of the next succeeding copy producing run provided the selection is not greater than forty for a two collator setup in the output portion 14 or greater than twenty for a single collator setup. If the copy selection is greater than 40 or 20, the selection for separate run is limited to the number of collator bins.

On the other hand, if SEPWAIT is not active the computer checks the separate indicator at 3D43. If SEPARIND=0, then at 3DF9 the computer resets the delay start latch; since there will be no separate run, copy production can ensue immediately. If SEPARIND=1 at 3D43, then the computer at 3D48 checks whether the start button had been actuated or a run had been initiated by starting SADF 11. If so, then at 3D4D all the start flags are reset and delay start is set at 3D51. At 3D57 the processor checks for side 2 of a duplex mode production and checks whether there are any copies in the paper path. This is achieved by checking the ACR 1 and 2 registers being equal to zero. ACR means automatic copy recovery and is essentially a software up/down count field for counting the transient copies in the copy path. If ACR1=ACR2=0, then the paper path is clear of copy sheets. If neither of these indicators is true, then at 3D7C separation mode start flag (STARTSE) is set. Then at 3D82 the computer checks whether the flush duplex light of panel 52 has been illuminated. At this point the computer knows that any flush was completed therefore a separation run can be performed. The computer resets the FLDUPON indicator at 3D86 and sets the duplex indicator to one at 3D88. Then at 3D8E the computer checks whether alternate paper has been selected. If not, alternate paper is selected at 3D97. Furthermore, a flag SEPPRI indicates that copies were being made from the first paper supply or primary paper bin 35 and not from the alternate paper bin 54. At the end of separation mode the computer will sense for SEPPRI such that upon resumption of copy production the copy sheets will again be properly selected from first paper supply 35. If alternate paper indicator had already been selected, then at 3D9A SEPPRI would be reset, i.e., the operator had selected the copies to be made from sheets from the second paper supply 54. Then at 3D9D the computer checks for collator selection. If not, i.e., the separation mode will run as a noncollate mode, then the copy select is equal to one such that one separator sheet will be supplied from the alternate paper bin supply 54 to output tray 14A. On the other hand, if the collator indicator is active then at 3DA2 the computer checks whether the separation mode selection is greater than zero. If not (SEPSLCT=0), no more needs to be done and the instructions beginning at 3E1B are executed as above described. On the other hand, if the separate select is greater than zero, then at 3DA6 the computer checks whether the copy select, i.e., the selection made by the operator, is equal to the separation select. If not, (CPYSLCT ≠ SEPSLCT) at 3DB9 the previous separation select for the separation mode is made equal to the copy selection. Then at 3DBF the computer checks whether there are two collators. If not, the copy sheet is increased by twenty at 3DC4, if there are two collators then the copy select is increased by forty at 3DC7. This action enables control 53 to display cumulative copy production for a copy production job that is segmented via the separation mode. This cumulative copy count indicates to an operator how far job execution has progressed.

At 3DDC the computer checks whether the separation mode selection is less than the copy selection. If not, the instruction at 3E1B, as mentioned above, is executed. If so, the instruction at 3DE3 enables the computer to make the copy selection equal to the separation mode selection. This action indicates the last job segment has not yet been reached.

On the other hand, at 3DA6, if the copy select was equal to the separation mode select, the instruction beginning at 3DAA enables the computer to reset the trailing separator flag to set the separate select to zero, and to set the previous selection for the separation mode to zero. This action indicates the last segment of the copy job is to be performed next.

All of the above-described functions are set forth in detail in Table IV below.

TABLE IV - START LATCH AFTER END

```
LOC  OBJ     OP1  OP2        SOURCE STATEMENT

                                -- NONPERTINENT CODE --

                                1. IF  SEPWAIT
3D3B A641    0041                  LB        PSB01
3D3D B5      0005                  TR        SEPWAIT
3D3E 43      3D43                  JZ        STAS01
                                1. THEN
                                2. . RESET SEPWAIT
3D3F A141    0041                  STB       PSB01
3D41 2CFE    3DFE                  B         STAS02
                                1. ELSE
             3D43          STAS01  DC        *
                                2. . IF  SEPARIND
                                     TPB       PCB06,SEPARIND
3D43 A677    0077
3D45 92      0002
3D46 3DF9    3DF9                  BZ        STAS03
                                2. . THEN
                                3. . . IF  STARTB |STARTDF
3D48 A656    0056                  LB        PSB22
                                     TSM       P(STARTB,STARTDF)
3D4A AF28    0028
3D4C 47      3D57                  JZ        STAS04
                                3. . . THEN
                                4. . . . RESET STARTA,STARTB,STARTDF,STLREG
                                     TRM       P(STARTA,STARTB,STARTDF,STLREQ)
3D4D AB47    0047
3D4F A156    0056                  STB       |PSB22
                                4. . . . SET DELAYSTL
                                     TSB       PSB03,DELAYSTL
3D51 A643    0043
3D53 AF04    0002
3D55 A143    0043
                                3. . . ENDIF
             3D57          STAS04  DC        *
                                3. . . IF  SIDE 2 &(ACR1,ACR2=0)
                                     TPB       PSB20,DPXSIDE2
3D57 A654    0054
3D59 95      0005
3D5A 3D7C    3D7C                  BZ        STAS05
3D5C 25                            CLA
```

```
LOC  OBJ    OP1  OP2        SOURCE STATEMENT

3D5D A40E   000E                AB        ACRREGLO
3D5F 3C7C   3D7C                BNZ       STAS05
                            3. . . THEN
                            4. . . . RESET STARTSE, SET FLUSH,STARTFL
3D61 A647   0047                LB        PSB07
3D63 B7     0007                TR        STARTSE
3D64 AF02   0001                TS        FLUSH
3D66 A147   0047                STB       PSB07
                                TSB       PSB22,STARTFL
3D68 A656   0056
3D6A AF01   0000
3D6C A156   0056
                            4. . . . IF  DUPLEX LIGHT
3D6E A676   0076                LB        PCB05
3D70 B2     0002                TR        DPLXIND
3D71 4A     3D7A                JZ        STAS05L
                            4. . . . THEN
                            5. . . . . TURN DUPLEX LIGHT OFF
3D72 A176   0076                STB       PCB05
                            5. . . . . SET FLDUPON
                                TSB       PSB06,FLDUPON
3D74 A646   0046
3D76 AF02   0001
3D78 A146   0046
                            4. . . . ENDIF
                       STAS05L  EQU       *
3D7A 2CF8   3DF8                B         STAS06
                            3. . . ELSE
            3D7C       STAS05   DC        *
                            4. . . . SET STARTSE
                                TSB       PSB07,STARTSE
3D7C A647   0047
3D7E AF80   0007
3D80 A147   0047
                            4. . . . IF  FLDUPON
3D82 A646   0046                LB        PSB06
3D84 B1     0001                TR        FLDUPON
3D85 4E     3D8E                JZ        STAS05M
                            4. . . . THEN
                            5. . . . . RESET FLDUPON
3D86 A146   0046                STB       PSB06
                            5. . . . . TURN ON DUPLEX LIGHT
                                TSB       PCB05,DPLXIND
3D88 A676   0076
3D8A AF04   0002
3D8C A176   0076
                            4. . . . ENDIF
                       STAS05M  EQU       *
                            4. . . . IF  ¬ALTBIN LIGHT
                                TSB       PCB05,ALTPAPI
3D8E A676   0076
3D90 AF02   0001
3D92 A176   0076
3D94 A645   0045                LB        PSB05
3D96 6A     3D9A                JNZ       STAS07
                            4. . . . THEN
                            5. . . . . SET ALT BIN LIGHT
                            5. . . . . SET SEPPRI
3D97 AF08   0003                TS        SEPPRI
3D99 0B     3D9B                J         STAS08
                            4. . . . ELSE
            3D9A       STAS07   DC        *
                            5. . . . . RESET SEPPRI
3D9A B3     0003                TR        SEPPRI
            3D9B       STAS08   DC        *
3D9B A145   0045                STB       PSB05
                            4. . . . ENDIF
                            4. . . . IF  COLLATOR LIGHT
                                TPB       PCB06,COLATIND
3D9D A677   0077
3D9F 91     0001
3DA0 3DEA   3DEA                BZ        STX01
                            4. . . . THEN
                            5. . . . . IF  SEPSLCT>0
3DA2 25                         CLA
3DA3 D9     0009                AR        SEPSLCT
3DA4 3DE9   3DE9                BZ        STX02
```

```
LOC  OBJ     OP1  OP2        SOURCE STATEMENT

                              5. . . . . THEN
                              6. . . . . . IF  CPYSLCT = SEPSLCT
                                  SRG        INTHRG
3DA6 A9C8    00C8
3DA8 C9      0009                 SR         CPYSLCT
3DA9 69      3DB9                 JNZ        STX03
                              6. . . . . . THEN
                              7. . . . . . . SET TRLSEP,SEPSLCT, PRVSLCT=0
                                  SRG        COLRG
3DAA A9D0    00D0
3DAC 8A      000A                 STR        PRVSLCT
                                  SRG        BASERG
3DAD A9C9    00C9
                                  TSB        PSB43,TRLSEP
3DAF A66B    006B
3DB1 AF80    0007
3DB3 A16B    006B
3DB5 25                           CLA
3DB6 89      0009                 STR        SEPSLCT
3DB7 2CE9    3DE9                 B          STX06
                              6. . . . . . ELSE
                         STX03    EQU        *
                              7. . . . . . . PRVSLCT= CPYSLCT
3DB9 E9      0009                 LR         CPYSLCT
                                  SRG        COLRG
3DBA A9D0    00D0
3DBC 8A      000A                 STR        PRVSLCT
                                  SRG        INTHRG
3DBD A9C8    00C8
                              7. . . . . . . IF  ¬MD2PRES
                                  RIN        CSB14
3DBF A6D5    00D5
3DC1 96      0006                 TP         MD2PRES
3DC2 25                           CLA
3DC3 67      3DC7                 JNZ        STXC2
                              7. . . . . . . THEN
                              8. . . . . . . . CPYSLCT=CPYSLCT+ 20
3DC4 AE20    0020                 LI         X'20'
3DC6 09      3DC9                 J          STXC3
                              7. . . . . . . ELSE
             3DC7         STXC2    DC         *
                              8. . . . . . . . CPYSLCT=CPYSLCT+ 40
3DC7 AE40    0040                 LI         X'40'
                              7. . . . . . . ENDIF
3DC9 D9      0009         STXC3    AR         CPYSLCT
3DCA 89      0009                  STR        CPYSLCT
3DCB 25                       CLA
3DCC A609    0009                 LB         CPYSLLO
3DCE ABF0    00F0                 NI         X'F0'
3DD0 AAA0    00A0                 SI         X'A0'
                                  JL         STXC4
3DD2 3FD5    3DD5
3DD4 0C      3DDC
3DD5 A109    0009                 STB        CPYSLLO
3DD7 A619    0019                 LB         CPYSLHI
3DD9 2E                           A1
3DDA A119    0019                 STB        CPYSLHI
             3DDC         STXC4    DC         *
                              7. . . . . . . IF  SEPSLCT<CPYSLCT
3DDC E9      0009                 LR         CPYSLCT
                                  SRG        BASERG
3DDD A9C9    00C9
3DDF C9      0009                 SR         SEPSLCT
                                  JL         STXC7
3DE0 3FE3    3DE3
3DE2 09      3DE9
                              7. . . . . . . THEN
                              8. . . . . . . . CPYSLCT=SEPSLCT
3DE3 E9      0009                 LR         SEPSLCT
3DE4 A109    0009                 STB        CPYSLLO
3DE6 29                           TRA
3DE7 A119    0019                 STB        CPYSLHI
                              7. . . . . . . ENDIF
                         STXC7    EQU        *
                              6. . . . . . ENDIF
                         STX06    EQU        *
```

```
LOC  OBJ     OP1  OP2        SOURCE STATEMENT

                                5. . . . . ENDIF
3DE9 08      3DF8          STX02    J          STX05
                                4. . . . ELSE
                            STX04    EQU        *
                                5. . . . . PRVSLCT=CPYSLCT
                                     SRG        INTHRG
3DEA A9C8    00C8
3DEC E9      0009                    LR         CPYSLCT
                                     SRG        COLRG
3DED A9D0    00D0
3DEF 8A      000A                    STR        PRVSLCT
                                     SRG        BASERG
3DF0 A9C9    00C9
                                5. . . . . CPYSLCT=1
3DF2 25                              CLA
3DF3 A119    0019                    STB        CPYSLHI
3DF5 2E                              A1
3DF6 A109    0009                    STB        CPYSLLO
                                4. . . . ENDIF
                            STX05    EQU        *
                                3. . . ENDIF
             3DF8           STAS06   DC         *
3DF8 0E      3DFE                    J          STAS09
                                2. . ELSE
             3DF9           STAS03   DC         *
                                3. . . RESET DELAYSTL
                                     TRB        PSB03,DELAYSTL
3DF9 A643    0043
3DFB B2      0002
3DFC A143    0043
                                2. . ENDIF
             3DFE           STAS09   DC         *
                                1. ENDIF

                                -- NONPERTINENT CODE --

                                2. . IF  COLLATE LIGHT
                                     TPB        PCB06,COLATIND
3E1B A677    0077
3E1D 91      0001
3E1E 3D58    3E58                    BZ         STARXX4
                                2. . THEN
                                3. . . IF  SEPSLCT=0
3E20 25                              CLA
3E21 D9      0009                    AR         SEPSLCT
3E22 3C50    3E50                    BNZ        STARM01
                                3. . . THEN
                                4. . . . IF  CPYSLCT > 20 (40 IF MOD 2 PRESENT)
3E24 25                              CLA
                                     RIN        CSB14
3E25 A6D5    00D5
3E27 96      0006                    TP         MD2PRES
3E28 AE20    0020                    LI         X'20'
3E2A 4D      3E2D                    JZ         STARM02
3E2B AE40    0040                    LI         X'40'
                            STARM02  SRG        INTHRG
3E2D A9C8    00C8
3E2F C9      0009                    SR         CPYSLCT
3E30 E9      0009                    LR         CPYSLCT
                                     SRG        BASERG
3E31 A9C9    00C9
3E33 3F37    3E37                    BNL        STARM03
                                4. . . . THEN
                                5. . . . . SEPSLCT = CPYSLCT
3E35 89      0009                    STR        SEPSLCT
3E36 0C      3E3C                    J          STARM05
                                4. . . . ELSE
                            STARM03  EQU        *
                                5. . . . . PRVSLCT = CPYSLCT
3E37 A9D0    00D0                    SRG        COLRG
3E39 8A      000A                    STR        PRVSLCT
                                     SRG        BASERG
3E3A A9C9    00C9
                                4. . . . ENDIF
                            STARM05  EQU        *
```

```
LOC  OBJ    OP1  OP2        SOURCE STATEMENT

                          4. . . . LIMIT SELECTION TO 40 OR 20 (MOD2 PRESENT OR
                                        NOT PRESENT)
3E3C 25                       CLA
                              RIN       CSB14
3E3D A6D5   00D5                 \
3E3F 96     0006              TP        MD2PRES
3E40 AE40   0040              LI        X'40'
3E42 65     3E45              JNZ       STARC02
3E43 AE20   0020              LI        X'20'
3E45 80     0000      STARC02 STR       R0
                              SRG       INTHRG
3E46 A9C8   00C8
3E48 C9     0009              SR        CPYSLCT
3E49 3F4F   3E4F              BNL       STARM04
3E4B 25                       CLA
3E4C A620   0120              LBL       BASEROLD
3E4E 89     0009              STR       CPYSLCT
3E4F 06     3E56      STARM04 J         STARM10
                          3. . . ELSE
                      STARM01 EQU       *
                          4. . . . CPYCTR = PRVSLCT
                              SRG       |COLRG
3E50 A9D0   00D0
3E52 EA     000A              LR        PRVSLCT
                              SRG       INTHRG
3E53 A9C8   00C8
3E55 87     0007              STR       CPYCTR
                          3. . . ENDIF
3E56 2C67   3E67      STARM10 B         STARC03
                          2. . ELSE
                      STARXX4 EQU       *
                          3. . . IF  DUPLEX
                              TPB       PCB05,DPLXIND
3E58 A676   0076                 \
3E5A 92     0002
3E5B 47     3E67              JZ        STARXX1
                          3. . . THEN
                          4. . . . LIMIT COPY SELECT TO 100
3E5C AE01   0001              LI        1
3E5E A019   0019              CB        CPYSLHI
3E60 3E67   3E67              BH        STARXX1
3E62 A119   0019              STB       CPYSLHI
3E64 25                       CLA
3E65 A109   0009              STB       CPYSLLO
                          3. . . ENDIF
                      STARXX1 EQU       *
                          2. . ENDIF
                      STARC03 SRG       BASERG
3E67 A9C9   00C9
3E69 A647   0047

                          -- NONPERTINENT CODE --
```

Figure 17:
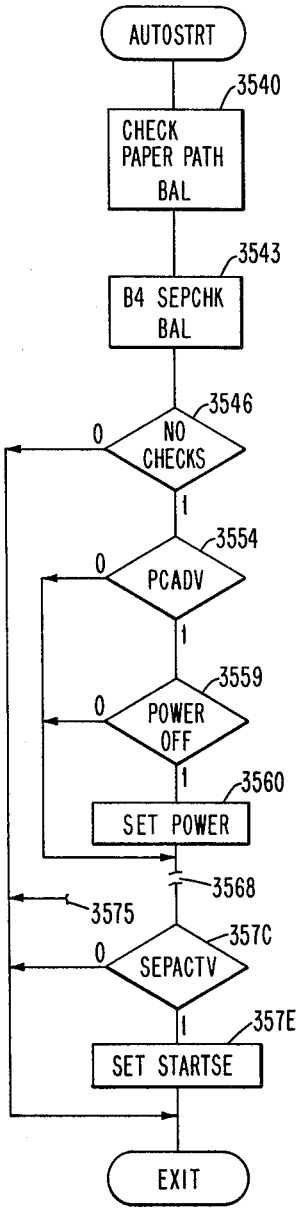
FIG. 17 is a flow chart showing SADF checking inhibits related to separation mode.

A start from a machine 10 interruption, such as by a copy sheet jam, is achieved through the autostart program shown in FIG. 17. The first step in this program is to check the paper path via a branch and link (BAL) instruction at 3540. The routine for checking the paper path is not shown for brevity. It consists of the control 53 computer scanning all of the sensing switches in the paper path of copy production machine 10 to ensure that all the paper has been removed from the paper path. Then a second branch and link at 3543 calls the B4 SEPCHK routine described with respect to FIG. 14. Upon return from the FIG. 14 illustrated code, the computer at 3546 determines whether there are any outstanding machine errors, such as check paper path, check collator, and the like. If there are no checks, the routine can be exited for entering SET STARTL of FIG. 16. If there are checks, the computer must then determine the reason copy production cannot resume. First, the computer checks at 3554 to determine whether a photoconductor (PC) advance was interrupted. A photoconductor advance is an auxiliary operation moving new photoconductor into an imaging location, such as shown in U.S. Pat. 3,588,242. If there was a PC advance, then at 3559 the computer checks whether a so-called secondary power relay (not shown) is off. Such secondary power relay provides power to the fuser 31 and the like. If it is off, a power indicator is set at 3560 for enabling the computer to turn power back on by another program (not shown). Then some nonpertinent code beginning at 3568 is executed. At 357C. SEPACTV is checked. If SEPACTV=1 when the abnormal end or interruption occurred, then the separation mode is restarted by setting the STARTSE flag at 357E. Other programs to be described sense for STARTSE for initiating separation mode. Techniques of ensuring the right number of copies of separation sheets are to be produced and transferred through output portion 14 are not a part of the present invention and will not be described for that reason. Because of the diverse effects of starting from an abnormal end or interruption, it is to be understood that most of the code in the FIG. 7 illustrated program is nonpertinent to separation mode. This nonpertinent code is indicated by the arrow at 3575.

After the start latch has been set, the FIG. 18 illustrated asynchronous program relating to control of SADF 11 checks for SEPWAIT in the inhibits checked at a routine called by a branch and link at 488C. Such inhibits, in addition to separation wait, include some of the doors of copy production machine 10 being open, a flush occurring, copy recovery in progress, and the like. If SEPWAIT is not active (no inhibit), a branch instruction executed at 488F causes nonpertinent SADF code to be executed beginning either at 48DD; with SEPWAIT=1, nonpertinent SADF code beginning at 49OD is executed. This code illustrates the close interaction of all the computer programs illustrated for executing separation mode and the effect of status registers 263 in providing communications between asynchronous programs and synchronous programs 262. Table V below lists the pertinent STLEND source code instructions while Table VI lists the FIG. 18 code.

TABLE V - AUTOSTART

```
LOC  OBJ     OP1  OP2        SOURCE STATEMENT
                                  |
                              BEGIN AUTOSTRT ATTEMPT AN AUTO RESTART WHEN DOORS GO CLOSED
             3540                ORG       AUTORG
                              1. CALL  PATHCHK GO CHECK PAPER PATH
3540 32384D  0002 4D38           BAL       R2,PATHCHK  GO CHECK PAPER PATH
                              1. CALL  B4SEPCHK GO CHECK B4 SEPARATION
3543 33F854  0003 54F8           BAL       R3,B4SEPCHK
                              1. IF  ¬CPP & ¬CHKCOL
3546 25                          CLA
3547 A45D    005D                AB        CPP
3549 3C82    3582                BNZ       MAC057
354B A44D    004D                AB        CPPE1
354D 3C82    3582                BNZ       MAC057
                                 TPB       PCB14,CKCOLTRI
354F A67E    007E
3551 90      0000
3552 3C82    3582                BNZ       MAC057
                              1. THEN
                              2. . IF  (PCADVNCE) ADVANCE WAS INTERRUPTED
                                 TPB       PCB02,PCADVNCE  SEE IF ADVANCE
3554 A673    0073
3556 90      0000
3557 3D68    3568                BZ        MAC053   * GO IF NO
                              2. . THEN
                              3. . . IF  (¬RELAY2) SECONDARY RELAY IS OFF
3559 A9A0    00A0                GI        INTOFF   MASK
355B A67C    007C                LB        PCB12    GET STATUS
355D AF40    0006                TS        RELAY2    SET RELAY2
355F 66      3566                JNZ       MAC052    * GO IF ALREADY ON
                              3. . . THEN
                              4. . . . OUTPUT  RELAY2=1
3560 A17C    007C                STB       PCB12     START RELAY
                              4. . . . SET MTRDLY=16 (130 MSEC)
3562 AE10    0010                LI        16        SET DELAY
3564 A159    0059                STB       MTRDLY    START TIMER
                              3. . . ENDIF
             3566         MAC052 DC        *
3566 A920    0020                GI        INTON     UNMASK
                              2. . ENDIF

                                  -- NONPERTINENT CODE --
```

TABLE VI - SADF CODE

```
LOC  OBJ     OP1  OP2     SOURCE STATEMENT

                              -- NONPERTINENT CODE --

                           4. . . . CALL  CHKINH
                              BAL       R1,CHKORG
                           4. . . . IF  ¬(ANY INHIBITS FOUND ABOVE) & ¬(ACRREQ & (BACKUP>1
                                        |(BACKUP=1 & AUTOFLSH))) & INTLOCK & ¬INDF & ¬INHFD1
                                        & ¬INHFD2 & ¬INHFD3 & ¬COLL DOORS OPEN & PSBIND &
                                        ¬SADFBUSY & (¬ADDPAPER | CPYINDPI) & (¬SEPIND |
                                        SEPWAIT | ¬DRIVE) & ¬FLUSH & (¬SEPACTV | DRIVE)
488F 340C    490C           BNZ       SADF27
                            TPB       PSB01,ACRREQ
4891 A641    0041
4893 91      0001
4894 41      48A1           JZ        SADF19B
4895 A66C    006C           LB        BACKUP
4897 A801    0001           CI        1
4899 360C    490C           BH        SADF27
```

```
LOC  OBJ    OP1  OP2        SOURCE STATEMENT

489B 61     48A1                JNE       SADF19B
                                TPB       PSB01,AUTOFLSH
489C A641   0041
489E 92     0002
489F 340C   490C                BNZ       SADF27
            48A1        SADF19B DC        *
                                RIN       CSB03      GET STATUS
48A1 A6C2   00C2
48A3 97     0007                TP        INTLOCK    TEST FOR PLUGGABLE METER
48A4 350C   490C                BZ        SADF27     *GO IF NO
48A6 A65F   005F                LB        PSB31
48A8 ABF8   00F8                NI        P1(INDF,INHFD1,INHFD2,SADFBUSY,INHFD3)
48AA 340C   490C                BNZ       SADF27
                                SRG       COLRG
48AC A9D0   00D0
48AE A607   0007                LB        CPSB02
                                SRG       BASERG
48B0 A9C9   00C9
                                TSM       P(COLDR12,COLDR22)
48B2 AF50   0050
48B4 340C   490C                BNZ       SADF27
                                TPB       PCB13,PLSSTBY
48B6 A67D   007D
48B8 96     0006
48B9 340C   490C                BNZ       SADF27
                                TPB       PSB07,ADDPAPER
48BB A647   0047
48BD 94     0004
48BE 44     48C4                JZ        SADF24A
                                TPB       PCB13,CPYINDPI
48BF A67D   007D
48C1 93     0003
48C2 350C   490C                BZ        SADF27
            48C4        SADF24A DC        *
                                TPB       PCB06,SEPARIND
48C4 A677   0077
48C6 92     0002
48C7 41     48D1                JZ        SADF24B    *GO IF NOT SEPARATE INDICATOR
                                TPB       PSB01,SEPWAIT
48C8 A641   0041
48CA 95     0005
48CB 61     48D1                JNZ       SADF24B    *GO IF YES
                                TPB       PSB21,DRIVE
48CC A655   0055
48CE 90     0000
48DF 340C   490C                BNZ       SADF27     *GO-CONDITIONS WERE NOT FAVORABLE
                        SADF24B EQU       *
                                TPB       PSB07,FLUSH
48D1 A647   0047
48D3 91     0001
48D4 340C   490C                BNZ       SADF27
48D6 93     0003                TP        SEPACTV
48D7 4D     48DD                JZ        SADF24C
                                TPB       PSB21,DRIVE
48D8 A655   0055
48DA 90     0000
48DB 350C   490C                BZ        SADF27
                        4. . . . THEN

                                -- NONPERTINENT CODE --
                                   (LOCATION 48DD)

                        5. . . . . ELSE

                                -- NONPERTINENT CODE --
                                   (LOCATION 490C)
```

The above-described programs illustrate the preparatory steps in the asynchronous programs necessary for starting a separation mode. Up to this point in time, the asynchronous programs have actually been executed several times; as conditions changed during separation mode preparation, different branches of the programs were correspondingly executed.

It should be noted that if a flush of interim storage unit 40 is required, any separation mode run waits until interium storage unit 40 is empty. When the start button has been pushed, sensed and honored, the photoconductor drum 20 rotates supplying emitter EC pulses from emitter wheel 46 as well as the fiducial or sync pulses. Such pulsing is detected via computer programming such that synchronous programs now are repetitively executed in synchronism with photoconductor drum 20 rotation. It should be remembered that for each rotation of photoconductor drum 20, each of the synchronous programs 262 will be executed twice. As a result of those repetitive executions, the copy production machine 10 is synchronously operated while being simultaneously asynchronously monitored and prepared for operation and stopping by the asynchronous programs 260, 261.

The synchronous programs 262 are executed in the priority over (interrupt) the asynchronous programs; when an EC pulse is received from emitter wheel 46, the respective synchronous program must be executed immediately for ensuring proper operation of copy production machine 10. The control exercised by the computer via the synchronous programs 262 is based upon a machine state field CR contained in status registers 263 and the timing pulses EC0-EC16 supplied by emitter wheel 46. In a constructed embodiment of the invention, the CR field contained eight bits, CR1 to CR8 plus some other bits not pertinent to understanding the operation of the synchronous program 262. Generally, the bit positions correspond to general functions of the copy production machine 10 with respect to transport of copy sheets through the paper. Other functions may be performed in accordance with the bit pattern; however, that is not important for the present discussion. In general, CR1 when active indicates a copy sheet should be picked from the interim storage unit 40, first paper supply 35, or second paper supply 54. Machine functions indicated by bit CR2 are primarily preparatory steps to image transfer from photoconductor drum 20 to the copy sheet. Included in such preparatory steps are lamp control, magnetic brush checking, SADF 11 control, and the like. The bit position CR3, CR4 are primarily concerned with image transfer controls such as fuser opening and closing, early exit arrivals, detach of copy sheets from photoconductor drum 20 and the like. CR5 bit indicates certain post imagetransfer housekeeping chores. Bits CR6, CR7 and CR8 are primarily related to collator controls. The computer is programmed to maintain machine status with respect to each copy sheet being transferred through the machine by inserting a binary one in the respective bit positions such that the associated machine functions can be appropriately performed. The meshing of the timing pulses EC0-EC16 with the CR fields follows the same timing control techniques used by prior relay control machines, such as the IBM Copier II manufactured by International Business Machines Corporation, Armonk, New York.

In to the synchronous programs 262, the EC0 programming (FIG. 19) contains some the preparatory steps necessary for beginning an image cycle. As expected, many functions are performed during this particular synchronous program including nonpertinent code represented by 6DE9. Furthermore, because of the extremely high speed of program execution, the order of execution of synchronous programs 262 in some instances can be somewhat independent of the order in which the machine actually functions and the programs are executed several times for many individual functions of machine 10. For brevity and to avoid describing the program repetitions, the description will follow program execution rather than machine functions.

At 6E25 the computer checks whether the CR2 bit is unity. If CR2=0, no pertinent action need be taken so the program is exited via the nonpertinent code at 6EBC. If CR2=1, certain pertinent preparatory steps have to be performed. Execution of this program assumes that a copy sheet has already been picked. After sensing CR2 active, the computer determines whether preconditioning is occurring at branch instruction 6E29. The term "preconditioning" is defined in copending, commonly assigned patent application Ser. No. 649,755, filed January 15, 1976 and now U.S. Pat. No. 4,036,556. If preconditioning is occurring then no copy sheets will be transported and the EC0 code can be exited via the nonpertinent code at 6EBC. Otherwise, the computer at 6E2E increments the copy-counter-save count field to be equal to the numerical contents of the copy counter field plus one. Then at 6E3F the computer checks whether there is a stop condition or an error condition. If there is, the program is exited via the nonpertinent code at 6EBC. If, on the other hand, the condition of the machine 10 is error-free, then the computer at 6E53 checks whether side 2 indicator is active, i.e., whether the next image transfer will be a side 2 of a duplex copy production run. If it is, then the computer must check at 6E58 whether interim storage unit (ISU) 40 is not empty. If ISU 40 has copies in it, then the computer at 6E5D checks whether separation mode is present in the machine and the copy select (CNT) is greater than the collator capacity (COL). If those conditions are satisfied, then the collator overflow flag is set at 6E7A. This results in action that the copies being produced will be produced from the duplex tray with the excess copies not insertable into the collator being directed to copy output tray 14A. On the other hand, if the condition of branch 6E5D is not true, then bit CR1 is set at 6E7F in preparation for picking a copy sheet from a designated paper supply 35 or 54. On the other hand, if interim storage unit 40 is empty as detected at branch instruction 6E58, then the end flag is set at 6E89. Finally, nonpertinent code at 6E98 is executed before performing the branch at 6EA9 for detecting whether the copy-counter save-field is less than the copy select field. If it is less, copies are yet to be produced and CR1 is set at 6EAD. On the other hand, if counter save is not less than copy select, the run is over and end flag is set at 6EB2. The program is exited via the nonpertinent code beginning with 6EBC.

The source code for the above flow chart is set forth below in Table VII.

TABLE VII - EC0 CODE

```
LOC  OBJ    OP1  OP2        SOURCE STATEMENT

                              --NONPERTINENT CODE--

                              2. . IF  CR2
6E25 E4     0004                 LR        CRREG      CR REGISTERS' REGISTER
6E26 96     0006                 TP        CR2        TEST IF CR2 IS ACTIVE
6E27 3DB8   6EB8                 BZ        EC0E       IF CR2 NOT ACTIVE BRANCH TO CR6 TEST
                              2. . THEN
                              3. . . IF  ¬PRECOND
                                 TPB       PSB07,PRECOND
6E29 A647   0047
6E2B 90     0000
6E2C 3CB8   6EB8                 BNZ       EC0E
                              3. . . THEN
                              4. . . . CCTRSAVE=CPYCTR+ 1
6E2E E7     0007                 LR        CPYCTR
6E2F 2E                          A1
6E30 85     0005                 STR       CCTRSAVE
6E31 AB0F   000F                 NI        X'0F'
6E33 AB0A   000A                 CI        10
6E35 6F     6E3F                 JNE       EC0D3A1
6E36 E5     0005                 LR        CCTRSAVE
6E37 AC06   0006                 AI        6
6E39 A A0   00A0                 CI        X'A0'
6E3B 6E     6E3E                 JNE       EC0D3A
6E3C AC60   0060                 AI        X'60'
            6E3E         EC0D3A  DC        *
6E3E 85     0005                 STR       CCTRSAVE
            6E3F         EC0D3A1 DC        *
                              4. . . . IF  ¬STOP2 &¬TNRFAIL &¬TNRCPP &¬COLSTOP
                                 TPB       PSB23,STOP2
6E3F A657   0057
6E41 91     0001
6E42 3CB8   6EB8                 BNZ       EC0E
6E44 A65D   005D                 LB        CPP
                                 TSM       P(TNRFAIL,TNRCPP)
6E46 AF82   0082
6E48 3CB8   6EB8                 BNZ       EC0E
                                 SRG       COLRG
6E4A A9D0   00D0
                                 TPB       CPSB08,COLSTOP
6E4C A619   0019
6E4E 97     0007
                                 SRG       INTHRG
6E4F A9C8   00C8
6E51 3CB8   6EB8                 BNZ       EC0E
                              4. . . . THEN
                              5. . . . . IF  SIDE_2 ACTIVE
                                 TPB       PSB20,DPXSIDE2
6E53 A654   0054
6E55 95     0005
6E56 3DA9   6EA9                 BZ        EC0D3
                              5. . . . . THEN
            6E58         EC0D    DC        *
                              6. . . . . . IF  COPIES IN DUPLEX
                                 RIN       CSB06
6E58 A6C5   00C5
6E5A 92     0002                 TP        CPYINDP
6E5B 3D89   6E89                 BZ        EC0D1
                              6. . . . . . THEN
                              7. . . . . . . IF  COLLATE IND & (CCTRSAVE>19 -39 IF MOD2
                                                 PRESENT) & SEPSLCT=0 & ¬COLOFLO
                                 TPB       PCB06,COLATIND
6E5D A675   0075
6E5F 91     0001
6E60 3D7F   6E7F                 BZ        EC0W01
6E62 25                          CLA
                                 RIN       CSB14
6E63 A6D5   00D5
6E65 96     0006                 TP        MD2PRES
6E66 AE19   0019                 LI        X'19'      19 COPIES
6E68 4B     6E6B                 JZ        EC0W02
6E69 AE39   0039                 LI        X'39'     39 COPIES
6E6B C5     0005         EC0W02  SR        CCTRSAVE
6E6C 3F7F   6E7F                 BNL       EC0W01
                                 SRG       BASERG
```

```
LOC  OBJ    OP1  OP2      SOURCE STATEMENT

6E6E A9C9   00C9
6E70 25                       CLA
6E71 D9     0009              AR        SEPSLCT
6E72 3C7F   6E7F              BNZ       EC0W01
                              SRG       COLRG
6E74 A9D0   00D0
                              TPB       CPSB04,COLOFLO
6E76 A609   0009
6E78 95     0005
6E79 6F     6E7F              JNZ       EC0W01
                         7. . . . . . . THEN
                         8. . . . . . . . SET COLOFLOR
6E7A AF40   0006              TS        COLOFLOR
6E7C A109   0009              STB       CPSB04
6E7E 05     6E85              J         EC0W03
                         7. . . . . . . ELSE
                    EC0W01    EQU       *
                         8. . . . . . . . SET CR1
                              SRG       INTHRG
6E7F A9C8   00C8
6E81 E4     0004              LR        CRREG
6E82 AF80   0007              TS        CR1
6E84 84     0004              STR       CRREG
                         7. . . . . . . ENDIF
                    EC0W03    SRG       INTHRG
6E85 A9C8   00C8
6E87 2CA8   6EA8              B         EC0D2
                         6. . . . . . ELSE
            6E89        EC0D1 DC        *
                         7. . . . . . . SET END=1
                              TSB       PSB03,END
6E89 A643   0043
6E8B AF80   0007
6E8D A143   0043

                         --NONPERTINENT CODE--

                         6. . . . . . IF  CCTRSAVE LESS THAN CPYSLCT
6EA9 E5     0005              LR        CCTRSAVE
6EAA C9     0009              SR        CPYSLCT
6EAB 3FB2   6EB2              BNL       EC0D4
                         6. . . . . . THEN
                         7. . . . . . . SET CR1=1
6EAD E4     0004              LR        CRREG
6EAE AF80   0007              TS        CR1
6EB0 84     0004              STR       CRREG
6EB1 08     6EB8              J         EC0E
                         6. . . . . . ELSE
            6EB2        EC0D4 DC        *
                         7. . . . . . . SET END=1
                              TSB       PSB03,END
6EB2 A643   0043
6EB4 AF80   0007
6EB6 A143   0043
                         6. . . . . . ENDIF
                         5. . . . . ENDIF
                         4. . . . ENDIF
                         3. . . ENDIF
                         2. . ENDIF

                         --NONPERTINENT CODE--
```

Next, in next to FIG. 20, the code EC0 CR1 is flowcharted. In the sequence of machine preparation for copy production, EC0-CR1 code has an effect before the FIG. 19 illustrated EC0 code, it being understood that several repetitions of code execution occur during each machine preparation. In EC0-CR1 the computer checks at 7006 whether there are no-paper modes, i.e., the machine operation will not require transport of copy sheets from any of the paper supplies. If it is a no-paper mode there is no need to pick paper. Therefore the entire code element is bypassed. If, on the other hand, a paper mode is indicated, the computer checks for CR1 at 7011. If CR1 field bit is not set, there is no need to pick paper, and the remaining code can be bypassed. If CR1 is set, then the trucks are set to zero at 7015. The trucks are those mechanisms in copy production machine 10 which reach into the paper supply bins for removing a copy sheet for copy production or for separation sheets. Such devices are shown in the IBM TECHNICAL DISCLOSURE BULLETIN, February 1974 on pages 2966 and 2967. With the trucks being reset to an out of supply bin, a no-pick position, the computer is in a better position to select from which of the supplies to pick a copy sheet.

At 701A the computer checks for the separate standby (SEPSTBY) flag. If it is active, it means the separation mode is being performed; then the alternate truck for supply 54 is selected at 701E. Nonpertinent code is executed beginning at 7028 and this synchronous program is exited to other EC0 codes (not shown) not pertinent to the present invention.

TABLE VIII - EC0 CR1 CODE

```
LOC  OBJ     OP1  OP2      SOURCE STATEMENT

                             BEGIN  EC0CR1
                           1. IF  ¬PRECOND &¬CENOPAPR
                                TPB        PSB07,PRECOND
7006 A647    0047
7008 90      0000
7009 3C7D    707D                BNZ        EC0K5
700B A662    0062                LB         CEMODE
700D A803    0003                CI         CENOPAPR
700F 3D7D    707D                BE         EC0K5
                           1. THEN
                           2. . IF  CR1
7011 E4      0004                LR         CRREG
7012 97      0007                TP         CR1
7013 3D7D    707D                BZ         EC0K5
                           2. . THEN
                           3. . . RESET ALL TRUCKS
7015 A671    0071                LB         PCB02
                                 TRM        P(DPLXTRCK,ALTTRUCK,PRMTRCK) RESET ALL TRUCKS
                                              FIRST
7017 ABE3    00E3
7019 29                          TRA
                           3. . . IF  SEPSTBY
                                TPB        PLSTNDBY,SEPSTBY
701A A653    0053
701C 95      0005
701D 43      7023                JZ         EC0K1      *GO TO NEXT TEST IF NOT SEPARATION
                           3. . . THEN
                           4. . . . SET ALTERNATE TRUCK
701E 29                          TRA        RETURN TRUCK STATUS BYTE
701F AF08    0003                TS         ALTTRUCK  SET ALTERNATE TRUCK
7021 2C61    7061                B          EC0K4

                           --NONPERTINENT CODE--
```

The next synchronous program pertinent to practicing the present invention is the EC2 code shown in FIG. 21. Ignoring the nonpertinent code including code location 7188, the computer checks via the branch instruction at 718A whether the separate indicator (SEPARIND) is active plus other conditions as seen in Table IX. If the separate indicator is not active and the other conditions are met, the original on the platen of SADF 11 is exited via output instruction 71B5. Otherwise, the remove original light (not shown) on panel 52 is illuminated by the instruction at 71C0. Then at 71C6, the remove copy 1 flag is checked. If it is active then at 71CB the indicated flags are reset and the CR field is reset to all zeros. Nonpertinent code is executed at 71DC and this synchronous program is exited. The above code illustrates one intimate relationship between the synchronous programs and the asynchronous program control operations of SADF 11. The described code is shown below in source code form in Table IX.

TABLE IX - EC2 CODE

```
LOC  OBJ     OP1  OP2      SOURCE STATEMENT

                           -- NONPERTINENT CODE--

                         5. . . . . IF  (¬COLBNFL &¬SEPARATE &(¬B4 |(¬BNLGTB4 &(SELPAPE
                                        |SELPAPD |SELPAPC |SELPAPB)) |(SELPAPE &¬IMPACTU)
                                        |((SELPAPD |SELPAPC |SELPAPB) &IMPACTU)))
                           RIN        CSB14
718A A6D5    00D5
718C 91      0001          TP         COLBNFL
718D 3CC0    71C0          BNZ        EC2COL3
                           TPB        PCB06,SEPARIND  --  Separate mode.
718F A677    0077
7191 92      0002
7192 3CC0    71C0          BNZ        EC2COL3  --  EC2 time.
7194 A6A1    01A1          LBL        COUNTRY
7196 92      0002          TP         B4
7197 3DB5    71B5          BZ         EC2COL2E
                           RIN        CSB13
```

```
LOC  OBJ     OP1  OP2        SOURCE STATEMENT

7199 A6D4    00D4
719B 29                          TRA
                                 RIN        CSB14
719C A6D5    00D5
719E 97      0007                TP         BNLGTB4
719F 29                          TRA
71A0 65      71A5                JNZ        EC2COL2A
71A1 AB1E    001E                NI         P(SELPAPE,SELPAPD,SELPAPC,SELPAPB)
71A3 3CB5    71B5                BNZ        EC2COL2E
             71A5        EC2COL2A DC        *
71A5 94      0004                TP         $ELPAPE
71A6 4C      71AC                JZ         EC2COL2B
71A7 A681    0181                LBL        PSB65
71A9 90      0000                TP         IMPACTU
71AA 45      71B5                JZ         EC2COL2E
71AB 03      71B3                J          EC2COL2C
             71AC        EC2COL2B DC        *
71AC AB0E    000E                NI         P(SELPAPD,SELPAPC,SELPAPB)
71AE 43      71B3                JZ EC2COL2C
71AF A681    0181                LBL        PSB65
71B1 90      0000                TP         IMPACTU
71B2 65      71B5                JNZ        EC2COL2E
             71B3        EC2COL2C DC        *
71B3 2CC0                        B          EC2COL3
                             5. . . . . THEN
             71B5        EC2COL2E DC        *
                             6. . . . . . EXITOFLO=1  --  Exit original from SADF.
                                 SRG        COLRG
71B5 A9D0    00D0
                                 TSB        CPSB05,EXITOFLO
71B7 A616    0016
71B9 AF20    0005
71BB A116    0016
                                 SRG        INTHRG
71BD A9C8    00C8
71BF 06      71C6                J          EC2COL4
                             5. . . . . ELSE
             71C0        EC2COL3  DC        *
                             6. . . . . . REMCOPYI=1
                                 TSB        PCB05,REMCOPYI
71C0 A676    0076
71C2 AF01    0000
71C4 A176    0076
                             5. . . . . ENDIF
                             4. . . . ENDIF
                             3. . . ENDIF
             71C6        EC2COL4  DC        *
                             3. . . IF  REMCOPYI
                                 TPB        PCB05,REMCOPYI
71C6 A676    0076
71C8 90      0000
71C9 3DDC    71DC                BZ         EC2A
                             3. . . THEN
                             4. . . . DEACTIVATE CR1 &RESET
                                                (CRB,CRA,CRA0,CRA1,CRA3,CRA3,CRA4,CRA5)
71CB E4      0004                LR         CRREG     LOAD OR REGISTERS' REGISTER
71CC B7      0007                TR         CR1       DEACTIVATE CR1
71CD 84      0004                STR        CRREG     STORE OR REGISTERS' REGISTER
71CE 25                          CLA        CLEAR ACCUM
71CF A114    0014                STB        CRHI      RESET HIGH BYTE OF CR REGISTER
                             4. . . . RESET STARTL
                                 TRB        PSB22,STARTL
71D1 A656    0056
71D3 B6      0006
71D4 A156    0056
                             4. . . . RESET FLUSH_PLEASE_STANDBY (FLSHPLSB) AND
                                          SEPARATION_PLEASE_STANDBY (SEPSTBY)
                                 TRMB       PLSTNDBY,P(FLSHPLSB,SEPSTBY)
71D6 A653    0053
71D8 ABDB    00DB
71DA A153    0053
                             3. . . ENDIF
                             2. . ENDIF
                             1. ENDIF

                             -- NONPERTINENT CODE --
```

The computer responds to the EC5 code with respect to the separation mode as shown in FIG. 22. First, CR2 is checked at 7367 to determine whether the inner image erase lamp should be turned off as the image area is just beginning to pass the interimage erase lamp 30E. Branch instruction at 736C checks if the next operation is not auxiliary to copy production. During auxiliary operations (copies not produced) such as the separation mode, the inner image erase lamp 30E is left on to erase the image area. A flush, separate mode, a preconditioning, or other auxiliary functions of a copy production machine require no image transfers. If copy production is to ensue (not auxiliary), then the inner image erase lamp 30E is turned off at 737F to allow an image to be imposed upon the image area of photoconductor drum 20. Nonpertinent code 7386 completes the EC5 code. Source code is in Table X.

Similarly, the EC6 code shown in FIG. 23 enables the computer to control the document lamp. Again, nonpertinent code is omitted at 73E5. The branch at 73E9 checks for CR2 and end, i.e., whether the last time CR2 will be used in the particular copy production run. If so, then at 73F2 the computer checks for separation mode (SEPSTBY) and a delay start, i.e., whether this is a leading separation mode run a separation mode run followed by copy production run. If so, then the document lamp is turned on at 73FA. Otherwise, nonpertinent code at 7402 is executed.

Tables X and XI for the EC5 and EC6 code, respectively, are included below,

TABLE X - EC5 CODE

```
LOC  OBJ    OP1  OP2      SOURCE STATEMENT

                            BEGIN  EC5 CODE
            7367               DC        *
                            1. IF  CR2
7367 A604   0004               LB        CRREG     LOAD CR REGISTERS' REGISTER
7369 96     0006               TP        CR2      TEST FOR CR2
736A 3D86   7386               BZ        EC5A      IF CR2 NOT ACTIVE JUMP TO CR3 TEST
                            1. THEN
                            2. . IF  ¬FLUSH &¬FUSER BYPASS &¬PRECOND &(¬SEPSTBY)
                               TP        PLSTNDBY,FSRPLSB
736C A653   0053
736E 91     0001
736F 3C86   7386               BNZ       EC5A
7371 A647   0047               LB        PSB07     GET STATUS
                               TSM       P(PRECOND,FLUSH)
7373 AF03   0003
7375 3C86   7386               BNZ       EC5A
                               TPB       PLSTNDBY,SEPSTBY
7377 A653   0053
7379 95     0005
737A 4F     737F               JZ        EC5S1
737B EE     000E               LR        ACRREG
737C ABF0   00F0               NI        X'F0'
737E 46     7386               JZ        EC5A
                            2. . THEN
            737F               DC  EC5S1 *
                            3. . . INTERIMAGE ERASE OFF
737F A67D   007D               LB        PCB15
7381 B4     0004               TR        INTIMGER
                               STOUT     15
7382 A17D   007D               STB   PCB15
7384 A1D6   00D6               STB   CCB15
                            2. . ENDIF
                            1. ENDIF

                               --NONPERTINENT CODE--
```

TABLE XI - EC6 CODE

```
LOC  OBJ    OP1  OP2      SOURCE STATEMENT

                            1. IF  CR2 &END
73E9 E4     0004               LR        CRREG     GET CR REG
73EA 96     0006               TP        CR2       SEE IF CR2
73EB 3512   7412               BZ        EC6B      * GO IF YES
                               TPB       PSB03,END
73ED A643   0043
73EF 97     0007
73F0 3512   7412               BZ        EC6B
                            1. THEN
                            2. . IF  SEPSTBY &DELAYSTL
                               TPB       PLSTNDBY,SEPSTBY
73F2 A653   0053
73F4 95     0005
73F5 42     7402               JZ        EC6A
                               TPB       PSB03,DELAYSTL
```

```
LOC  OBJ    OP1  OP2        SOURCE STATEMENT

73F6 A643   0043
73F8 92     0002
73F9 42     7402                JZ        EC0A
                          2. . THEN
                          3. . . DOCLAMP ON
                              TSB       PCB12,DOCLAMP
73FA A67A   007A
73FC AF10   0004
73FE A17A   007A
7400 2C12   7412                B         EC0B

                         --NONPERTINENT CODE--
```

Figure 24:
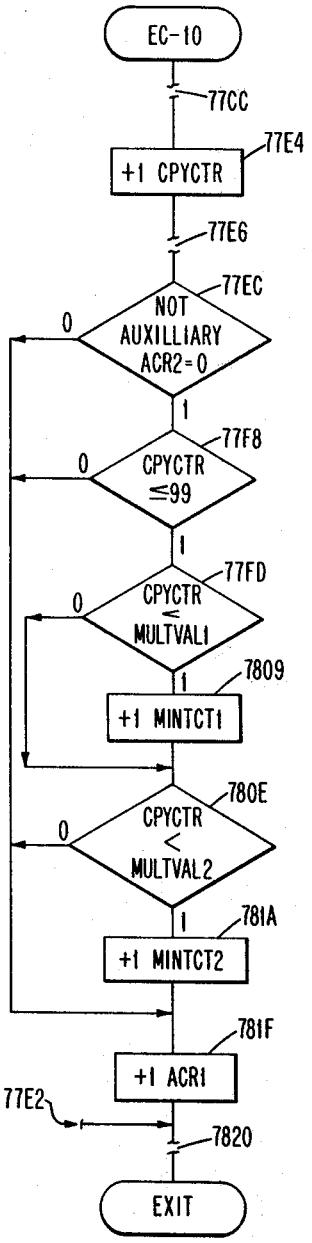
FIG. 24 is a flow chart showing certain counting actions related to the separation mode at EC10 time of the copy production machine.

The EC10 code, among other things, provides for incrementing certain counters. As seen in FIG. 24, after executing the nonpertinent code 77CC which verifies that CR2 is set and that paper has been picked satisfactorily, the copy counter field (CPYCTR) is incremented at 77E4. This field is used in counting the number of separation sheets used during the separation mode as well as counting copies in copy production runs. More nonpertinent code follows at 77E6 which includes a series of branches and counting steps occur that are not directly pertinent to the separation mode. The branch at 77EC senses whether an auxiliary function is being performed, i.e., separation, flush, etc. If an auxiliary function is not being performed (copies are being produced), the ACR1 register is incremented at 781F. The ACR register contains a count indicating the number of copies produced from a given image and is used primarily for copy error recovery. However, ACR1 is also a count field which keeps a tally of the number of copies in the paper path when one image is being produced or if no images are being transferred, i.e., counts separation sheets. The code at 77F8 through 781A concerns counting steps pertinent to copy production. Then more nonpertinent code at 7820 or from a branch of nonpertinent code at 77E2 is executed before the program is exited. The Table XII below shows source code associated with the FIG. 24 flow chart.

TABLE XII EC10 COUNT CONTROL CODE

```
LOC  OBJ    OP1  OP2        SOURCE STATEMENT

                          4. . . . INCREMENT COPY COUNTER- CPYCTR=CCTRSAVE
77E4 E5     0005                LR        CCTRSAVE
77E5 B7     0007                STR       CPYCTR
                          4. . . . IF  ¬CENOPAPR
77E6 A662   0062                LB        CEMODE     GET CEMODE
77E8 A803   0003                CI        CENOPAPR   SEE IF CE NO PAPER MODE
77EA 3520   7820                BE        EC10B      *GO IF YES
                          4. . . . THEN
                          5. . . . . IF  ¬FLUSH &¬(SEPACTV &ACR2=0)
77EC A647   0047                LB        PSB07      GET STATUS
77EE 91     0001                TP        FLUSH      TEST FOR FLUSH
77EF 341F   781F                BNZ       EC10D3
77F1 93     0003                TP        SEPACTV    TEST FOR SEPARATION MODE
77F2 48     77F8                JZ        EC10Z      *GO IF NO
77F3 EE     000E                LR        ACRREG     LOAD ACR REGISTER
77F4 ABF0   00F0                NI        X'F0'      TEST VALUE OF ACR2
77F6 351F   781F                BZ        EC10D3     *GO IF 0
                          5. . . . . THEN
            77F8        EC10Z   DC        *
                          6. . . . . . IF  CPYCTR<=99
77F8 25                         CLA       CLEAR ACCUM
77F9 A417   0017                AB        CPYCTHI
77FB 341F   781F                BNE       EC10D3
                          6. . . . . . THEN
                          7. . . . . . . IF  CPYCTR<MULTVAL1
77FD A6B6   01B6                LBL       MULTVAL1
                                SHLM      4
77FF 2B
7800 2B
7801 2B
7802 2B
7803 A7B7   01B7                OBL       MULTVAL1+1
7805 A207   0007                SB        CPYCTLU
                                JNC       EC10D2
7807 2D
7808 4E     780E
                          7. . . . . . . THEN
                          8. . . . . . . . INCREMENT MINTCT1
7809 A644   0044                LB        PSB04
780B 2E                         A1
780C A144   0044                STB       PSB04
```

```
LOC  OBJ     OP1  OP2        SOURCE STATEMENT

                          7. . . . . . . ENDIF
             780E      EC10D2   DC        *
                          7. . . . . . . IF  CPYCTR<MULTVAL2
780E A6BE    01BE                LBL       MULTVAL2
                                 SHLM      4
7810 2B
7811 2B
7812 2B
7813 2B
7814 A7BF    01BF                OBL       MULTVAL2+1
7816 A207    0007                SB        CPYCTLO
                                 JNC       EC10D3
7818 2D
7819 4F      781F
                          7. . . . . . . THEN
                          8. . . . . . . . INCREMENT MINTCT2
781A A651    0051                LB        PSB17
781C 2E                          A1
781D A151    0051                STB       PSB17
                          7. . . . . . . ENDIF
                          6. . . . . . ENDIF
                          5. . . . . ENDIF
             781F      EC10D3   DC        *
                          5. . . . . INCREMENT ACR1
781F FE      000E                LRB       ACRREG
                          4. . . . ENDIF
                          3. . . ENDIF
```

Figure 25:
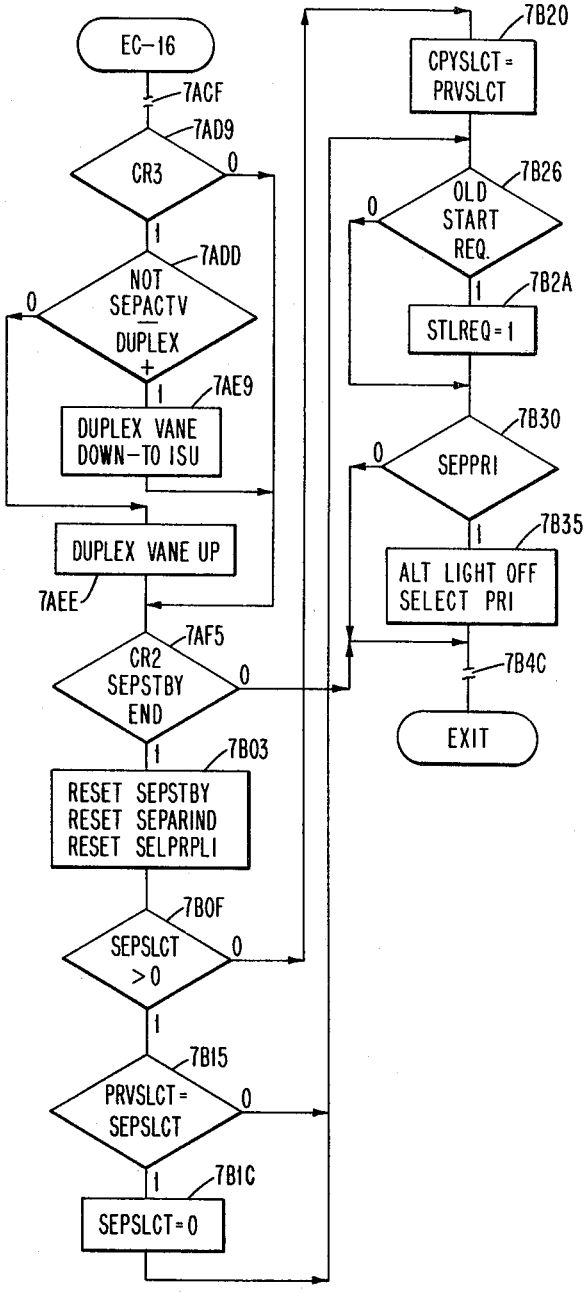
FIG. 25 is a flow chart showing certain copy count controls related to separation mode implemented at EC16 time of the copy production machine.

The last synchronous program portion to be described is EC16 shown in FIG. 25. After executing nonpertinent code at 7ACF, the status of the CR3 bit is sensed at 7AD9. If it is active (CR3=1) then the branch at 7ADD enables the computer to sense whether separation mode is not active or if there is a duplex mode. If so, the instruction at 7AE9 moves the duplex vane down so that copies will go to the interim storage unit 40. On the other hand, if separate mode is active or it is not duplex, then the instruction at 7AEE enables the computer to move the duplex vane up for directing copy sheets to output portion 14.

At 7AF5 the computer checks CR2, separate standby, and end, i.e., whether the last separation sheet been already picked from the alternate paper bin 54. If so, then the instruction at 7B03 enables the computer to reset separate standby, separate indicator, and the select primary paper bin memory indicator.

Following 7B03 the computer checks at 7B03 whether the separation is greater than zero. If it is, then at 7B15 the previous separation select (PRVSLCT) is checked for equality with the present separation select. The previous select is a memory field for indicating to other programs the number of separation sheets transported during the last previous separation mode run. Upon equality, the computer at 7B1C makes separation select equal to zero (end of the separation run).

If, on the other hand, the separation select at 7B0F was not greater than zero, i.e., equal to zero, then at 7B20 the copy select field is made equal to the previous separation select count. Then at 7B26 the program paths join where the computer senses whether there is an outstanding start request. If so, the start latch request is set at 7B2A. Then at 7B30 the computer checks whether the copies previously made used copy sheets from the primary paper bin 35. If the copies were made from the primary bin, which is the usual case, the alternate light is turned off and the primary bin is selected at 7B35. After executing nonpertinent code at 7B4C the program is exited. Note that if the branch at 7AF5 indicates that the end of the separation run has not occurred or other conditions outside of separation runs have occurred, the program is then exited via the nonpertinent code 7B4C. The source code for the above-described flow chart is shown below in Table XIII.

TABLE XIII - EC16 SEPARATION MODE CODE

```
LOC  OBJ     OP1  OP2        SOURCE STATEMENT

                          1. IF  CR3
7AD9 E4      0004                LR        CRREG      GET CR REGISTER
7ADA 95      0005                TP        CR3        TEST FOR CR3
7ADB 3DF5    7AF5                BZ        EC16C      *GO IF NO
                          1. THEN
                          2. . IF  ¬SEPACTV &DUPLEX IND &¬SIDE2
                                  TPB       PSB07,SEPACTV
7ADD A647    0047
7ADF 93      0003
7AE0 6E      7AEE                JNZ       EC16B      *GO IF YES
                                  TPB       PCB05,DPLXIND
7AE1 A676    0076
7AE3 92      0002
7AE4 4E      7AEE                JZ        EC16B      *GO IF NO
                                  TPB       PSB20,DPXSIDE2
```

```
LOC  OBJ    OP1  OP2        SOURCE STATEMENT

7AE5 A654   0054
7AE7 95     0005
7AE8 6E     7AEE                JNZ       EC16B     *GO IF YES
                             2. . THEN
                             3. . . DUPLEX VANE DOWN
7AE9 A673   0073                LB        PCB02     GET STATUS
7AEB AF40   0006                TS        DPLXVANE
7AED 01     7AF1                J         EC16B1    * CONTINUE
                             2. . ELSE
            7AEE        EC16B   DC        *
                             3. . . DUPLEX VANE UP
7AEE A673   0073                LB        PCB02     GET STATUS
7AF0 B6     0006                TR        DPLXVANE
            7AF1        EC16B1  DC        *
                                STOUT     02
7AF1 A173   0073                STB   PCB02
7AF3 A1C1   00C1                STB   CCB02
                             2. . ENDIF
            7AF5        EC16C   DC        *
                             1. ENDIF
                             1. IF  CR2 &END &SEPSTBY
7AF5 E4     0004                LR        CRREG     GET CR REGISTER
7AF6 96     0006                TP        CR2       TEST FOR CR2
7AF7 354C   7B4C                BZ        EC16E     *GO IF NO
                                TPB       PSB03,END
7AF9 A643   0043
7AFB 97     0007
7AFC 354C   7B4C                BZ        EC16E     *GO IF END NOT SET
7AFE A653   0053                LB        PLSTNDBY
7B00 B5     0005                TR        SEPSTBY
7B01 3D4C   7B4C                BZ        EC16E     *GO IF NOT SEPARATE
                             1. THEN
                             2. . RESET SEPSTBY,SEPARATION LIGHT,SELPRPLI
7B03 A153   0053                STB       PLSTNDBY
                                TRB       PCB06,SEPARIND
7B05 A677   0077
7B07 B2     0002
7B08 A177   0077

                                TRB       PCB13,SELPRPLI
7B0A A67D   007D
7B0C B4     0004
7B0D A17D   007D
                             2. . IF  SEPSLCT>0
7B0F 25                         CLA
                                SRG       BASERG
7B10 A9C9   00C9
7B12 D9     0009                AR        SEPSLCT
7B13 3D20   7B20                BZ        EC16C5
                             2. . THEN
                             3. . . IF  PRVSLCT=SEPSLCT
                                SRG       COLRG
7B15 A9D0   00D0
7B17 EA     000A                LR        PRVSLCT
                                SRG       BASERG
7B18 A9C9   00C9
7B1A C9     0009                SR        SEPSLCT
7B1B 6D     7B1D                JNZ       EC16C1
                             3. . . THEN
                             4. . . . SEPSLCT=0
7B1C 89     0009                STR       SEPSLCT
                             3. . . ENDIF
                        EC16C1  SRG       INTHRG
7B1D A9CB   00C8
7B1F 06     7B26                J         EC16C7
                             2. . ELSE
            7B20        EC16C5  DC        *
                             3. . . CPYSLCT=PRVSLCT
                                SRG       COLRG
7B20 A9D0   00D0
7B22 EA     000A                LR        PRVSLCT
                                SRG       INTHRG
7B23 A9C8   00C8
```

```
LOC  OBJ     OP1  OP2        SOURCE STATEMENT

7B25 89      0009                 STR        CPYSLCT
                              2. . ENDIF
             7B26        EC16C7   DC         *
                              2. . IF  DELAYSTL
                                  TPB        PSB03,DELAYSTL
7B26 A643    0043
7B28 92      0002
7B29 40      7B30                 JZ         EC16D
                              2. . THEN
                              3. . . SET STLREQ
                                  TSB        PSB22,STLREQ
7B2A A656    0056
7B2C AF80    0007
7B2E A156    0056
                              2. . ENDIF
             7B30        EC16D    DC         *
                              2. . IF  SEPPRI
                                  TPB        PSB05,SEPPRI
7B30 A645    0045
7B32 93      0003
7B33 3D4C    7B4C                 BZ         EC16E
                              2. . THEN
                              3. . . TURN OFF ALTERNATE BIN LIGHT
                                  TRB        PCB05,ALTPAPI
7B35 A676    0076
7B37 B1      0001
7B38 A176    0076
                              3. . . PICK PRIMARY TRUCK (RESET OTHERS)
7B3A A673    0073                 LB         PCB02
                                  TRM        P(ALTTRUCK,DPLXTRCK)
7B3C ABF3    00F3
7B3E AF10    0004                 TS         PRMTRCK
7B40 A173    0073                 STB        PCB02
                              3. . . SET PRIMPICK (RESET OTHERS)
7B42 A670    0070                 LB         PCB16
7B44 AF08    0003                 TS         PRIMPICK
                                  TRM        P(ALTPICK,DUPPICK)
7B46 ABCF    00CF
                                  STOUT      16
7B48 A170    0070                 STB   PCB16
7B4A A1DA    00DA                 STB        CCB16
                              2. . ENDIF
                              1. ENDIF
```

Figure 26:
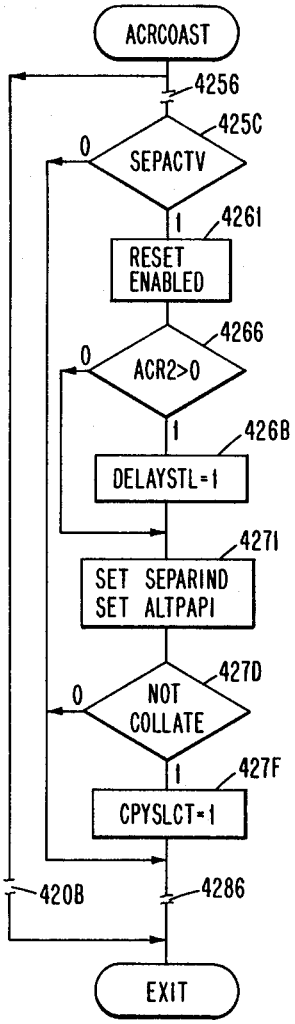
FIG. 26 is a flow chart showing certain separation mode related functions performed after an end of a copy production run.

Interleaved with execution of the synchronous programs are the asynchronous programs 260, 261. The asynchronous programs 261 are directed toward job control of copy production machine 10. That is, these programs 261 tie the various copy production runs and separation runs and flush runs together for completing a job, particularly as to logically extending the storage capacity of the collators in output portion 14. A first of these job control asynchronous programs is shown in FIG. 26 which is executed each time the machine 10 stops, that is, when photoconductor drum 20 has stopped rotating. At this time many tasks have to be performed by the computer relating to the next startup of copy production machine 10 so that job continuity can be preserved or a job can be terminated. As can be expected, programming at the end of such a run is quite complex, having an effect on all operational features of the copy production machine. Accordingly, nonpertinent code indicated at 4256, 420B and 4286 is substantial. That portion of ACRCOAST that pertains to the separation mode includes instruction 425C wherein the computer senses whether the copy production machine is in a separation mode run (SEPACTV). If it is in a separation mode run, then at 4261 the computer resets the enable flag, thereby disabling the computer from sensing inputted operator parameters. Then at 4266 the computer determines whether a copy recovery register termed ACR2 is greater than zero. If it is greater than zero then an ensuing copy production run will be overlapped with the present separation run. This overlap is indicated by delaying the start at 426B (DELAYSTL=1). This delayed start memorizes the fact that a start has been requested and will be used by other programs executed by the computer. Then at 4271 the computer sets the separate indicate flag SEPARIND which turns on the separate indicator associated within switch 57 of panel 52. Also, the alternate paper supply 54 is selected. Then at 427D the computer determines whether the collate mode has been selected by the operator. If so, the nonpertinent code at 4286 is executed. On the other hand, if collate was not selected then the copy select is equal to one at 427F. That is, only one separation sheet will be supplied in a noncollate mode to exit tray 14A. The source code associated with the FIG. 26 illustrated flow chart is listed in Table XIV below.

TABLE XIV - ACR COAST

```
LOC  OBJ    OP1  OP2        SOURCE STATEMENT

                              2. . IF  SEPACTV
                                  TPB        PSB07,SEPACTV
425C A647   0047
425E 93     0003
425F 3D86   4286                  BZ         ACRCP02
                              2. . THEN
                              3. . . RESET ENABLED
                                  TRB        PSB42,ENABLED
4261 A66A   006A
4263 B7     0007
4264 A16A   006A
                              3. . . IF  ACR2]0
4266 A60E   000E                  LB         ACRREGLO
4268 ABF0   00F0                  NI         X'F0'
426A 41     4271                  JZ         ACRCPX1
                              3. . . THEN
                              4. . . . SET DELAYSTL - IMPLIES SEPARATION OVERLAPPED BY
                                             COPY
                                  TSB        PSB03,DELAYSTL
426B A643   0043
426D AF04   0002
426F A143   0043
                              3. . . ENDIF
                        ACRCPX1   EQU        *
                              3. . . SET ALTPAPI, SEPARIND
                                  TSB        PCB05,ALTPAPI
4271 A676   0076
4273 AF02   0001
4275 A176   0076
                                  TSB        PCB06,SEPARIND  PCB06 LEFT IN ACCUM FOR NEXT
                                             INSTR.
4277 A677   0077
4279 AF04   0002
427B A177   0077
                              3. . . IF  .COLATIND
427D 91     0001                  TP         COLATIND        PCB06 STILL IN ACCUM FROM PRV.
                                             INSTR
427E 66     4286                  JNZ        ACRCP02
                              3. . . THEN
                              4. . . . CPYSLCT=1
427F 25                           CLA
4280 2E                           A1
                                  SRG        INTHRG
4281 A9C8   00C8
4283 89     0009                  STR        CPYSLCT
                                  SRG        BASERG
4284 A9C9   00C9
                              3. . . ENDIF
                              2. . ENDIF

                              -- NONPERTINENT CODE --
```

Figure 27:
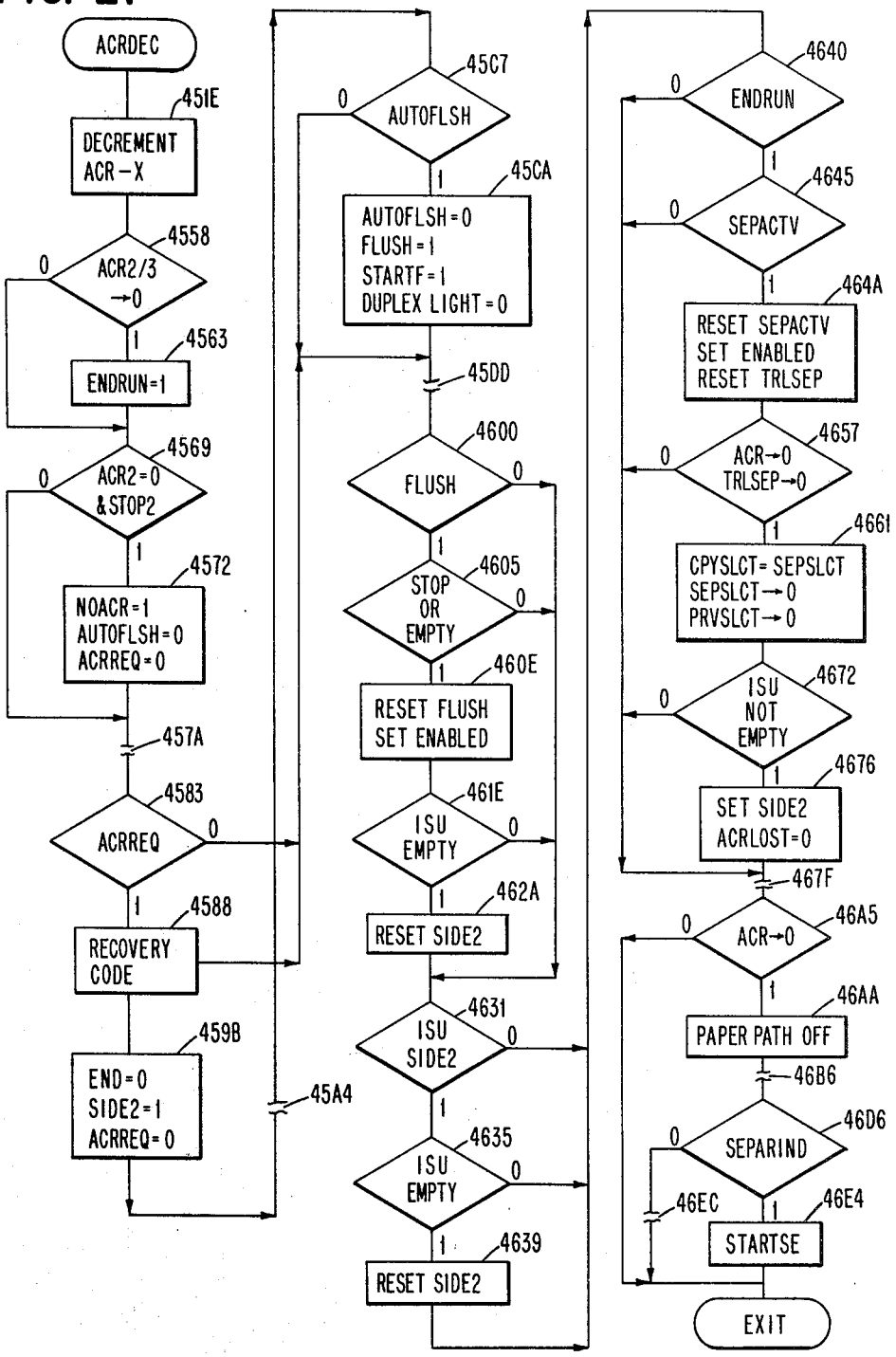
FIG. 27 is a flow chart showing certain run tie together functions which, in combination with other functions shown in other figures, relate to doing a complete separation mode job by logically extending collator capacity.

An important job control asynchronous program ACRDEC is shown in FIG. 27. Before proceeding with the details of the program, is should be noted that the ACR count fields are divided into a plurality of subfields. For example, ACR1 is a count field indicating a number of copies of a given image just entering a copy path of copy production machine 10. ARC2 is a count field of copies of a single image different from the ARC1 indicated image which copies entered the copy path just prior to the ACR1 counted copies. Similarly, ACR3, 4, 5 and so forth, indicate the number of copies of respective images. As copies leave the copy path, as sensed and indicated by switches S2 through S4 (FIG. 1), the ACR count field of the first inserted image, i.e., a nonzero ACR count field having the highest numeral, is decremented. This ACR is designated as ACRX. Accordingly, as each copy leaves the copy path the computer follows the instruction at 451E to decrement ACRX. Accordingly, the numerical content of the various ACR count fields indicate the number of copies of each respective image currently in the copy production routine copy path.

After decrementing ACRX, the computer at 4558 determines whether ACR2 or 3 has just gone to zero. If either of these have gone to zero, the endrun bit is set at 4563. This bit indicates that the copy path now contains the copies of the last image to be reproduced. By way of explanation, when more than one ACR count field is nonzero, the number of copies made from each image is less than that necessary to completely fill the copy path. Accordingly, when the higher numbered ACRs have all gone to zero, including ACR2 or 3, then the computer knows that all of the copies of the last image are the only ones remaining in the copy path. The ENDRUN bit is a cautioning bit indicating the end of a run is imminent.

Then at 4569, the computer checks whether ACR2 is equal to zero and the STOP2 bit is active. If so, then at 4572 the computer can indicate that no copy recovery (NOACR and ACRREQ=0) is required and that there is no requirement for emptying interim storage unit 40 (AUTOFLSH=0). Then some nonpertinent code 457A is executed.

The branch at 4583 determines whether an error recovery request has been made. If not, nonpertinent code beginning at 45DE is executed. On the other hand, if there is an error recovery request certain recovery code indicated by 4588 is executed. After the recovery code, which can cause a branch also to 45DD, the computer resets the end indicator, sets SIDE2, and resets the error recovery request. Then after executing nonpertinent code 45A4, at 45C7 the computer checks whether the interim storage unit 40 is to be emptied (AUTOFLSH). If it is to be emptied, AUTOFLSH is reset, and flush is set (indicating that the interim storage unit 40 will be emptied), a start latch F is set, and the duplex light on panel 52 is extinguished. After the nonpertinent code 45DD, the computer checks at 4600 whether the flush indicator is active. If it is active, then at 4605 the computer checks whether the stop indicator is on or the interim storage unit 40 is empty. If either one of those occur, then at 460E the flush bit is reset and enabled is set indicating operator selections are permitted as copy production machine 10 is stopping. At branch instruction 461E the computer checks whether interim storage unit 40 is empty. If unit 40 is empty, at 461E the computer resets the SIDE2 indicator at 462H. The program paths join again at 4631 where the computer checks for the SIDE2 indicator. If it is active, then at 4635 the computer again checks whether interim storage unit 40 is empty. If it is empty, SIDE2 is reset at 4639. Then at 4640 and 4645 the computer checks for the ENDRUN flag, i.e., the end of the run is in sight, and whether separate is active. If both conditions occur, then at 464A, the computer resets separate active, sets the enabled flag for enabling operator input, and resets the trailing separator flag. From an operator view, when the separate indicator at button 57 goes off, additional parameters can be entered. When SEPTACTV is reset, other programs, as described, reset SEPARIND.

AT 4657 the computer checks whether any ACR has gone to zero and the trailing separator has been set to zero. If the conditions are met, then at 4661 the copy select field is made equal to the separate select field, i.e., the number of copies to be produced will equal the number of separator sheets provided. Also the two fields, separate select and previous separate select, are set to zero. At 4672 the computer checks whether interim storage unit 40 is empty. If not, it sets SIDE2 and sets ACRLOST equal to zero at instruction 4676. ACRLOST is a register in area 263 indicating the number of copies lost from ISU 40 in a copy transport error. Then nonpertinent code is executed at 467F.

At 46A5 the computer checks whether any ACR has gone to zero. If so, at 46AA the paper pick trucks are reset, i.e., returned to their inactive position. Nonpertinent code is executed at 46B6. The separate indicator is checked at 4606 to determine whether a separation mode should be started at 46E4. Otherwise, nonpertinent code is executed at 46EC. Source code for implementing the above-described flow chart is shown below in Table XV.

TABLE XV - ACRDEC

```
LOC  OBJ    OP1  OP2      SOURCE STATEMENT

                            BEGIN  ACRDEC SUBROUTINE
                                   DECREMENTS THE APPROPRIATE NON-0 ACR_X
            4518
                   ***********************************************************************
                     NOTE: DO NOT USE ACRBILL2, IT WILL BE USED TO DENOTE THAT ACR2
                           HAS GONE TO 0,  IT CAN BE USED A LITTLE LATER, SEE NEXT NOTE.
                   ***********************************************************************

                              -- NONPERTINENT CODE --

                            1. DECREMENT ACR_X (WHERE X = 4,3,2OR 1: THE FIRST NON-0
                                          COUNTER). (IF ACR2 GOES TO 0, RESET ACRBILL2)
451E 25                          CLA
451F A41E   001E                 AB        ACRREGHI
4521 3D39   4539                 BZ        ACRD008   J MEANS ACR3,4 BOTH 0
4523 ABF0   00F0                 NI        X'F0'
4525 A61E   001E                 LB        ACRREGHI
4527 6F     452F                 JNZ       ACRD009   J MEANS ACR4 =0
4528 2A                          S1                  DECREMENT ACR3
4529 A11E   001E                 STB       ACRREGHI
452B 3D58   4558                 BZ        ACRD008C  J MEANS ACR3 DID  GO TO 0
452D 2C55   4555                 B         ACRD007
452F AA10   0010        ACRD009  SI        X'10'     DECREMENT ACR4
4531 A11E   001E                 STB       ACRREGHI
4533 ABF0   00F0                 NI        X'F0'
4535 3D58   4558                 BZ        ACRD008C  J MEANS ACR4 DID GO TO 0
4537 2C55   4555                 B         ACRD007
4539 A40E   000E        ACRD008  AB        ACRREGLO
453B 3D55   4555                 BZ        ACRD007   J MEANS ACR1,2 BOTH 0
453D ABF0   00F0                 NI        X'F0'
453F A60E   000E                 LB        ACRREGLO
4541 68     4548                 JNZ       ACRD009A  J MEANS ACR2 =¬0
4542 2A                          S1                  DECREMENT ACR1
4543 A10E   000E                 STB       ACRREGLO
```

```
LOC  OBJ     OP1  OP2        SOURCE STATEMENT

4545 3D58    4558                 BZ        ACRD008C  J MEANS ACR1 DID GO TO 0
4547 05      4555                 J         ACRD007
4548 AA10    0010        ACRD009A SI        X'10'     DECREMENT ACR2
454A A10E    000E                 STB       ACRREGLO
454C ABF0    00F0                 NI        X'F0'
454E 65      4555                 JNZ       ACRD007   J MEANS ACR2 DID NOT GO TO 0
                                  TRB       PSB43,ACRBILL2
454F A66B    006B
4551 B4      0004
4552 A16B    006B
4554 08      4558                 J         ACRD00BC
                              1. IF  THAT ACR X JUST WENT TO 0
4555 30FE46 46FE 0000  ACRD007    BU        ACRD003,R0  ACRD007  MEANS SOME ACR DID NOT
                                            GOTO 0
                        ACRD008C EQU        *          ACRD008C MEANS SOME ACR DID   GOTO 0
                              1. THEN
                              2. . IF  (ACR2 |ACR3 WENT TO 0) |END
                                  TPB       PSB43,ACRBILL2
4558 A66B    006B
455A 94      0004
455B 43      4563                 JZ        ACRDY1
455C 25                           CLA
455D DE      000E                 AR        ACRREG
455E 63      4563                 JNZ       ACRDY1
                                  TPB       PSB03,END
455F A643    0043
4561 97      0007
4562 49      4569                 JZ        ACRDY2
                              2. . THEN
             4563       ACRDY1    DC        *
                              3. . . SET ENDRUN
                                  TSB       PSB43,ENDRUN
4563 A66B    006B
4565 AF40    0006
4567 A16B    006B
                              2. . ENDIF
             4569       ACRDY2    DC        *
                              2. . IF  ACR2=0 & STOP2
4569 A60E    000E                 LB        ACRREGLO
456B ABF0    00F0                 NI        X'F0'
456D 6A      457A                 JNZ       ACRD01
                                  TPB       PSB23,STOP2
456E A657    0057
4570 91      0001
4571 4A      457A                 JZ        ACRD01
                              2. . THEN
                              3. . . NOACR=1, AUTOFLSH=0, ACRREQ=0
4572 A641    0041                 LB        PSB01
4574 AF01    0000                 TS        NOACR
                                  TRM       P(AUTOFLSH,ACRREQ)
4576 ABF9    00F9
4578 A141    0041                 STB       PSB01
                              2. . ENDIF

                              -- NONPERTINENT CODE --
                              3. . . IF  ACRREQ
                                  TPB       PSB01,ACRREQ
4583 A641    0041
4585 91      0001
4586 3DDD    45DD                 BZ        ACRD02
                              3. . . THEN

                              -- RECOVERY CODE 4588 --

                              5. . . . . THEN
                              6. . . . . . RESET END,ENDRUN
                                  TSB       PSB43,ENDRUN
459B A66B    006B
459D AF40    0006
459F A16B    006B

                              -- NONPERTINENT CODE --

                              6. . . . . . IF  AUTOFLSH
45C7 B2      0002                 TR        AUTOFLSH
45C8 3DDD    45DD                 BZ        ACRD05
                              6. . . . . . THEN
```

```
LOC  OBJ    OP1  OP2      SOURCE STATEMENT

                          7. . . . . . . RESET AUTOFLSH
45CA A141   0041              STB        PSB01
                          7. . . . . . . FLUSH, STARTFL = 1
                              TSB        PSB07,FLUSH
45CC A647   0047
45CE AF02   0001
45D0 A147   0047
                              TSB        PSB22,STARTFL
45D2 A656   0056
45D4 AF01   0000
45D6 A156   0056
                          7. . . . . . . TURN OFF DUPLEX LIGHT
                              TRB        PCB05,DPLXIND
45D8 A676   0076
45DA B2     0002
45DB A176   0076
                          6. . . . . . ENDIF
                          5. . . . . ENDIF
                     ACRD05   EQU        *
                          4. . . . ENDIF
                          3. . . ENDIF

                          -- NONPERTINENT CODE --

                          2. . IF  FLUSH
                              TPB        PSB07,FLUSH
4600 A647   0047
4602 91     0001
4603 3D31   4631              BZ         ACRL01
                          2. . THEN
                          3. . . IF  STOP| ¬COPIES_IN_DUPLEX_SW
                              TPB        PSB23,STOP2
4605 A657   0057
4607 91     0001
4608 6E     460E              JNZ        ACRL05
                              RIN        CSB06
4609 A6C5   00C5
460B 92     0002              TP         CPYINDP
460C 3C2F   462F              BNZ        ACRL03
                          3. . . THEN
                     ACRL05   EQU        *
                          4. . . . RESET FLUSH, FLSHPLSTBY
                              TRB        PSB07,FLUSH
460E A647   0047
4610 B1     0001
4611 A147   0047
                              TRB        PLSTNDBY,FLSHPLSB
4613 A653   0053
4615 B2     0002
4616 A153   0053
                          4. . . . SET ENABLED
                              TSB        PSB42,ENABLED
4618 A66A   006A
461A AF80   0007
461C A16A   006A
                          4. . . . IF  ¬( DUPLEX_LIGHT & STOP & COPIES_IN_DUPLEX_SW )
                              TPB        PCB05,DPLXIND
461E A676   0076
4620 92     0002
4621 4A     462A              JZ         ACRL06
                          TPB PSB23,STOP2
4622 A657   0057
4624 91     0001
4625 4A     462A              JZ         ACRL06
                          RIN CSB06
4626 A6C5   00C5
4628 92     0002              TP         CPYINDP
4629 6F     462F              JNZ        ACRL04
                          4. . . . THEN
                     ACRL06   EQU        *
                          5. . . . . RESET SIDE-2
                              TRB        PSB20,DPXSIDE2
462A A654   0054
462C B5     0005
462D A154   0054
                          4. . . . ENDIF
                     ACRL04   EQU        *
```

```
LOC  OBJ    OP1  OP2          SOURCE STATEMENT

                          3. . . ENDIF
462F 2C7F   467F       ACRL03  B        ACRL02
                          2. . . ELSE
                       ACRL01  EQU      *
                          3. . . IF  SIDE-2
                               TPB      PSB20,DPXSIDE2
4631 A654   0054
4633 95     0005
4634 40     4640               JZ       ACRL09
                          3. . . THEN
                          4. . . .   IF  ¬COPIES_IN_DUPLEX_SW
                               RIN      CSB06
4634 A6C5   00C5
4637 92     0002               TP       CPYINDP
4638 6E     463E               JNZ      ACRL08
                          4. . . . THEN
                          5. . . . . RESET SIDE-2
                               TRB      PSB20,DPXSIDE2
4639 A654   0054
463B B5     0005
463C A154   0054
                          4. . . . ENDIF
463E 2C7F   467F       ACRL08  B        ACRL07
                          3. . . ELSE
                       ACRL09  EQU
                          4. . . . IF  ENDRUN
                               TPB      PSB43,ENDRUN
4640 A66B   006B
4642 96     0006
4643 3D7F   467F               BZ       ACRL11
                          4. . . . THEN
                          5. . . . . IF  SEPACTV
4645 A647   0047               LB       PSB07
4647 B3     0003               TR       SEPACTV
4648 3D72   4672               BZ       ACRL10
                          5. . . . . THEN
                          6. . . . . . RESET SEPACTV
464A A147   0047               STB      PSB07
                          6. . . . . . SET ENABLED
                               TSB      PSB42,ENABLED
464C A66A   006A
464E AF80   0007
4650 A16A   006A
                          6. . . . . . RESET TRLSEP
                               TRB      PSB43,TRLSEP
4652 A66B   006B
4654 B7     0007
4655 A16B   006B
                          6. . . . . .IF  TRLSEP WAS 1 &ACR1 WENT TO 0
4657 3D6E   A66E               BZ       ACRL11W
                               TPB      PSB43,ACRBILL2
4659 A66B   006B
465B 94     0004
465C 25                        CLA
465D 4E     466E               JZ       ACRL11W
465E A40E   000E               AB       ACRREGLO
4660 6E     466E               JNZ      ACRL11W
                          6. . . . . . THEN
                          7. . . . . . . CPYSLCT = SEPSLCT
                               SRG      BASERG
4661 A9C9   00C9
4663 E9     0009               LR       SEPSLCT
                               SRG      INTHRG
4664 A9C8   00C8
4666 89     0009               STR      CPYSLCT
                          7. . . . . . . SEPSLCT, PRVSLCT = 0
4667 25                        CLA
                               SRG      BASERG
4668 A9C9   00C9
466A 89     0009               STR      SEPSLCT
                               SRG      COLRG
466B A9D0   00D0
466D 8A     000A               STR      PRVSLCT
                          6. . . . . . ENDIF
                       ACRL11W SRG      INTHRG
466E A9C8   00C8
4670 2C7F   467F               B        ACRL11
```

```
LOC  OBJ    OP1  OP2      SOURCE STATEMENT

                            5. . . . . ELSE
                      ACRL10   EQU       *
                            6. . . . . . IF  COPIES_IN_DUPLEX_LIGHT
                                TPB       PCB13,CPYINDFI
4672 A67D   007D
4674 93     0003
4675 4F     467F                JZ        ACRL12
                            6. . . . . . THEN
                            7. . . . . . . SET SIDE-2
                                TSB       PSB20,DPXSIDE2
4676 A654   0054
4678 AF20   0005
467A A154   0054

                            7. . . . . . . ACRLOST=0
467C 25                         CLA
467D A15B   005B                STB       ACRLOST
                            6. . . . . . ENDIF
                      ACRL12   EQU       *
                            5. . . . . ENDIF
                            4. . . . ENDIF
                      ACRL11   EQU       *
                            3. . . ENDIF
                      ACRL07   EQU       *
                         2. . ENDIF


                         -- NONPERTINENT CODE --

                         2. . IF  ACR1 WENT TO 0
46A5 25                      CLA
46A6 A40E   000E             AB        ACRREGLO
46A8 3CFE   46FE             BNZ       ACRL14
                         2. . THEN
                         3. . . TURN TRUCKS OFF
                             TRMB      PCB02,P(PRMTRCK,ALTTRUCK,DPLXTRCK)
46AA A673   0073
46AC ABE3   00E3
46AE A173   0073
46B0 A670   0070
46B2 ABF8   00F8
46B4 A170   0070

                         -- NONPERTINENT CODE --

                         4. . . . IF  SEPARIND & ¬SEPWAIT & ¬ACRREQ & DRIVE
                             TPB       PCB06,SEPARIND
46D6 A677   0077
46D8 92     0002
46D9 3DEC   46EC             BZ        ACRCD01
46DB A641   0041             LB        PSB01
46DD AB22   0022             NI        P1(SEPWAIT,ACRREQ)
46DF 6C     46EC             JNZ       ACRCD01
                             TPB       PSB21,DRIVE
46E0 A655   0055
46E2 90     0000
46E3 4C     46EC             JZ        ACRCD01
                          4. . . . THEN
                          5. . . . . SET STARTSE
                              TSB       PSB07,STARTSE
46E4 A647   0047
46E6 AF80   0007
46E8 A147   0047
46EA 2CFE   46FE              B         ACRCD02
                          4. . . . ELSE

                          -- NONPERTINENT CODE --

                              5. . . . . ENDIF
            46FE      ACRCD02  DC        *
                          4. . . ENDIF
                      ACRL15   EQU       *
                          3. . . ENDIF
                      ACRL14   EQU       *
                          2. . ENDIF
                          1. ENDIF

                          -- NONPERTINENT CODE --
```

Figure 28:
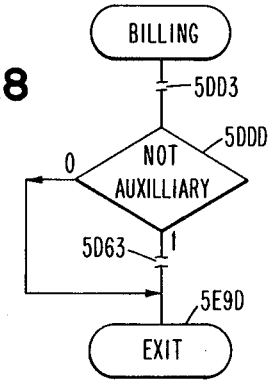
FIG. 28 is a flow chart showing inhibiting of billing for separation and flush copy operations.
Figure 29:
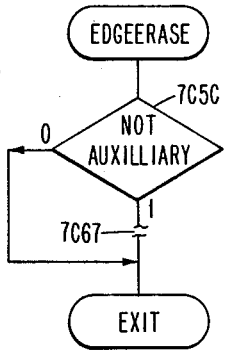
FIG. 29 is a flow chart showing inhibiting of edge controls during an auxiliary operation.

Finally, in FIGS. 28 and 29 the billing and edge erase programs are shown as they relate to the separation mode. Only one instruction in each of the programs is pertinent; in FIG. 28 instruction 5DDD and in FIG. 29 instruction 7C5C are pertinent. Both are identical in that the computer branches on whether or not an auxiliary operation (separate, flush, etc.) is being performed. These two instructions are identical to the instruction 77EC of FIG. 24 as detailed in source code in Table XII.

In summary, the copy production machine 10 can either be hardware or software controlled for effecting the separation mode which effects a logical extension of the capability of collators in that plural sets of copies can be inserted into given collator bins with a separator sheet and with a minimal operator inconvenience. The automatic controls described above can take any of a plurality of forms including programmable logic arrays, read only memories, hard logic as indicated in the first part of the application, or a programmed computer as set forth in the preferred embodiment. The form of technology involved in implementing the present invention is not pertinent to the practice of the invention, the important features being the machine functions performed in implementing the separation mode.

Inhibiting billing for separation sheets is intended to include separately counting separation sheets. Then, the separate separation count can be used for a reduced billing rate (regular copy billing rate inhibited) or as a basis for relating copy billing. In the broad method aspects, the billing meter could, in fact, be actuated and the separate separation count used to adjust the total bill—this is still inhibiting billing.

While the invention has been particularly shown and described with references to a preferred embodiment thereof, it will be understood by those skilled in the art that various changes in form and details may be made therein without departing from the spirit and scope of the invention.

What is claimed is:

1. A copy production machine having a copy producing portion, plural output portions for receiving produced copies from said copy production portion, and an image input section for supplying images to said copy producing portion for use in producing copies of said supplied images on copy sheets, one of said output portions having a given number of copy receiving bins (capacity) having different images carried thereby, for receiving said produced copies, means indicating an end of a copy producing run, means storing copy sheets, said copy producing portion having copy producing and standby modes, and capable of switching between said modes;

the improvement including in combination:

a control means having, a copy select register for indicating a first number of copies to be produced, said first number capable of indicating a number of copies greater than said given capacity, a copy count register for indicating the total number of copies of one image produced in a given copy production job; said copy production job being one or more copy producing runs of each image to be reproduced as said copies, separation initiating means indicating completion of a job segment, said job segment including one or more of said copy producing runs, separation sheet transporting means responsive to said separation initiating means to activate said copy production portion to transfer from said means for storing copy sheets as job segment separation sheets intermediate any two successive copy runs of a given copy producing job to said one output portion in accordance with a number of copies of each said image to be produced in a next successive given one of said job segments, and accumulating means operative in response to said separation indicating means indicating a job segment for accumulating a count from all prior job segments and supplying same to said copy count register whereby said total number of copies indicated is for all job segments produced.

2. The copy production machine set forth in claim 1 further including means responsive to said separation initiating means being actuated after a last one of a series of copy producing runs in a job consisting of a series of such copy producing runs to supply separate sheets to said one output portion equal to its capacity to retain a collate copies carrying different images.

3. The copy production machine set forth in claim 1 wherein said control means is responsive to said change in mode from said copy producing mode to said standby mode to transfer a first copy sheet to each of said bins to receive said copy sheets during a next succeeding run and to a change in mode from said standby mode to said copy producing mode to transfer a second sheet to said bins to receive a copy sheet during a next succeeding run whereby two sheets are supplied to such bins intermediate to successive copy producing runs.

4. The copy production machine set forth in claim 3 further including means indicating a last copy job segment and means in said control means responsive to said indicating means and to said separation initiating means to supply a separator sheet to each of said copy receiving bins.

5. The method of operating a collator having a predetermined number of bins comprising the steps of:

indicating a given number to be collated greater than the number of bins, collating said given number of copysets until a remaining number of copysets to be collated is less than said given number, between each group of said given number of copysets, supplying a separator sheet to each of said bins, and before collating said remaining number of copysets, supplying only said remaining number of separator sheets to a like number of said bins.

6. The method set forth in claim 5 further including collating all said numbers of copysets in alternating directions of collation.

7. The method set forth in claim 5 further including the step of supplying one separator sheet to each of the bins after all copies have been produced.

8. The method of operating a collator having relatively movable sheet distributor and a given number of sheet receiving bins, the steps of:

indicating a plurality of sheets to be distributed into a predetermined number of sets, said predetermined number being greater than said given number, collating said given number of sets, then supplying a number of separator sheets equal to said predetermined number less said given number in a like number of said sheet receiving bins, and then collating said predetermined number less said given number of sets into said sheet receiving bins which received one of said separator sheets.

9. The method of claim 8 further including the steps of:

supplying an additional separator sheet to each of said bins that received a separator sheet between two sets of copies.

10. The method of claim 8 further including supplying a plurality of separator sheets to each bin that would receive one separator sheet.

11. The method of operating a copy production machine having a copy production portion and having a plurality of output portions for receiving produced copies, each said output portion having one or more copy receiving bins, means directing produced copies to a given one of said output portions, said copy production portion having control means imposing a standby or producing mode therein, plural copy paper supply means in said copy production portion for supplying sheets of copy paper;

the improvement including the steps of:

signifying that a given number of copies are to be produced having a given image;

indicating a job separation request;

indicating a change in modes between said standby and producing modes; and just after indicating said change in mode, transferring a number of copy sheets from said copy production portion to said given one output portion related to said number of copy bins in said given one output portion and to said given number of copies to be produced in a next succeeding run for separating produced copies.

* * * * *